US008788135B2

(12) United States Patent
Daum et al.

(10) Patent No.: US 8,788,135 B2
(45) Date of Patent: Jul. 22, 2014

(54) SYSTEM, METHOD, AND COMPUTER SOFTWARE CODE FOR PROVIDING REAL TIME OPTIMIZATION OF A MISSION PLAN FOR A POWERED SYSTEM

(75) Inventors: Wolfgang Daum, Erie, PA (US); Ajith Kuttannair Kumar, Erie, PA (US); Glenn Robert Shaffer, Erie, PA (US); Joseph Forrest Noffsinger, Lees Summit, MO (US); Robert James Foy, Melbourne, FL (US); David Lowell McKay, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 1339 days.

(21) Appl. No.: 12/365,359

(22) Filed: Feb. 4, 2009

(65) Prior Publication Data

US 2009/0187291 A1 Jul. 23, 2009

Related U.S. Application Data

(63) Continuation-in-part of application No. 11/765,443, filed on Jun. 19, 2007, and a continuation-in-part of application No. 11/669,364, filed on Jan. 31, 2007, and a continuation-in-part of application No. 11/385,354, filed on Mar. 20, 2006.

(60) Provisional application No. 61/060,785, filed on Jun. 11, 2008, provisional application No. 60/894,039, filed on Mar. 9, 2007, provisional application No. 60/939,852, filed on May 24, 2007, provisional application No. 60/849,100, filed on Oct. 2, 2006, provisional application No. 60/850,885, filed on Oct. 10, 2006.

(51) Int. Cl.

| | |
|---|---|
| ***G01C 22/00*** | (2006.01) |
| ***G05D 1/00*** | (2006.01) |
| ***B61L 3/00*** | (2006.01) |

(52) U.S. Cl.

CPC ..... *B61L 3/006* (2013.01)
USPC ..... 701/26

(58) Field of Classification Search

USPC ..... 701/19, 20, 23, 24, 25, 26
See application file for complete search history.

(56) References Cited

U.S. PATENT DOCUMENTS

| | | | |
|---|---|---|---|
| 2,104,652 | A | 1/1938 | Inman |
| 2,601,634 | A | 6/1952 | William |

(Continued)

FOREIGN PATENT DOCUMENTS

| | | |
|---|---|---|
| CH | 642 418 | 4/1984 |
| DE | 197 26 542 | 11/1998 |

(Continued)

OTHER PUBLICATIONS

Razouqi et al. RYNSORD: A Novel, Decentralized Algorithm for Railway Networks with 'Soft Reservation', VTC, 1998, pp. 1585-2589, V3, New York, NY.

(Continued)

*Primary Examiner* — Khoi Tran
*Assistant Examiner* — Nicholas Kiswanto
(74) *Attorney, Agent, or Firm* — GE Global Patent Operation; John A. Kramer

(57) ABSTRACT

A method for operating a powered system, the method including determining whether a mission plan of the powered system is correct to satisfy at least one mission objective of the powered system, if not, updating information used to establish the mission plan, revising the mission plan based on the updated information to satisfy the at least one mission objective, and operating the powered system based on the revised mission plan. A system and a computer software code for operating a powered system are also disclosed.

47 Claims, 23 Drawing Sheets

(56) References Cited

U.S. PATENT DOCUMENTS 2,927,711 A 3/1960 Yervant
3,519,805 A 7/1970 Thorne-Booth
3,650,216 A 3/1972 Harwick et al.
3,655,962 A 4/1972 Koch
3,781,139 A 12/1973 Lohse
3,794,833 A 2/1974 Blazek
3,865,042 A 2/1975 DePaola et al.
3,886,870 A 6/1975 Pelabon
3,948,314 A 4/1976 Creswick
4,005,838 A 2/1977 Grundy
4,041,283 A 8/1977 Mosier
4,042,810 A 8/1977 Mosher
4,136,432 A 1/1979 Melley, Jr.
4,159,088 A * 6/1979 Cosley ..... 244/182
4,181,943 A 1/1980 Mercer, Sr.
4,253,399 A 3/1981 Spigarelli
4,279,395 A 7/1981 Boggio et al.
4,344,364 A * 8/1982 Nickles et al. ..... 105/62.1
4,401,035 A 8/1983 Spigarelli et al.
4,548,164 A 10/1985 Ylonen
4,561,057 A 12/1985 Haley, Jr. et al.
4,602,335 A 7/1986 Perlmutter
4,617,627 A 10/1986 Yasunobu
4,644,705 A 2/1987 Saccomani
4,663,713 A 5/1987 Cornell
4,711,418 A 12/1987 Aver, Jr. et al.
4,735,385 A 4/1988 Nickles et al.
4,794,548 A 12/1988 Lynch et al.
4,827,438 A 5/1989 Nickles et al.
4,843,575 A * 6/1989 Crane ..... 701/99
4,853,883 A 8/1989 Nickles et al.
5,109,343 A 4/1992 Budway
5,181,541 A 1/1993 Bodenheimer
5,187,945 A 2/1993 Dixon
5,197,627 A 3/1993 Disabato
5,239,472 A 8/1993 Long
5,240,416 A 8/1993 Bennington
5,253,153 A 10/1993 Mathews
5,316,174 A 5/1994 Schutz
5,363,787 A 11/1994 Konopasek
5,388,034 A 2/1995 Allen
5,398,186 A * 3/1995 Nakhla ..... 701/16
5,398,894 A 3/1995 Pascoe
5,437,422 A 8/1995 Newman
5,440,489 A 8/1995 Newman
5,459,666 A * 10/1995 Casper et al. ..... 701/123
5,460,013 A 10/1995 Thomsen
5,487,516 A 1/1996 Murata
5,600,558 A * 2/1997 Mearek et al. ..... 701/32.6
5,623,413 A 4/1997 Matheson
5,642,827 A 7/1997 Madsen
5,651,330 A 7/1997 Jewett
5,676,059 A 10/1997 Alt
5,744,707 A 4/1998 Kull
5,755,349 A 5/1998 Brundle
5,758,299 A 5/1998 Sandborg et al.
5,785,392 A 7/1998 Hart
5,794,172 A 8/1998 Matheson
5,803,411 A 9/1998 Ackerman
5,828,979 A 10/1998 Polivka et al.
5,950,967 A 9/1999 Montgomery
5,957,571 A 9/1999 Koster
5,983,144 A * 11/1999 Bonissone et al. ..... 701/19
5,998,915 A 12/1999 Scholz
6,092,021 A 7/2000 Ehlbeck
6,112,142 A 8/2000 Shockley et al.
6,123,111 A 9/2000 Nathan
6,125,311 A 9/2000 Lo
6,129,025 A 10/2000 Minakami
6,144,901 A * 11/2000 Nickles et al. ..... 701/19
6,198,993 B1 3/2001 Higashi
6,216,957 B1 4/2001 Turunen
6,219,595 B1 * 4/2001 Nickles et al. ..... 701/19
6,230,668 B1 5/2001 Marsh
6,243,694 B1 6/2001 Bonissone
6,263,265 B1 * 7/2001 Fera ..... 701/19
6,263,266 B1 * 7/2001 Hawthorne ..... 701/19
6,269,034 B1 7/2001 Shibuya
6,270,040 B1 8/2001 Katzer
6,308,117 B1 10/2001 Ryland et al.
6,325,050 B1 12/2001 Gallagher et al.
6,332,106 B1 * 12/2001 Hawthorne et al. ..... 701/19
6,363,331 B1 3/2002 Kyrtsos
6,380,639 B1 4/2002 Soucy
6,404,129 B1 6/2002 Hendricx et al.
6,434,452 B1 8/2002 Gray
6,459,964 B1 10/2002 Vu et al.
6,487,488 B1 11/2002 Peterson, Jr. et al.
6,501,393 B1 * 12/2002 Richards et al. ..... 340/993
6,505,103 B1 1/2003 Howell et al.
6,516,727 B2 2/2003 Kraft
6,520,124 B2 2/2003 Bohm
6,522,958 B1 * 2/2003 Dwyer et al. ..... 701/3
6,549,803 B1 4/2003 Raghavan et al.
6,591,758 B2 7/2003 Kumar
6,609,049 B1 8/2003 Kane et al.
6,612,245 B2 9/2003 Kumar et al.
6,612,246 B2 9/2003 Kumar
6,615,118 B2 9/2003 Kumar
6,647,328 B2 11/2003 Walker
6,676,089 B1 1/2004 Katzer
6,691,957 B2 2/2004 Hess, Jr. et al.
6,694,231 B1 2/2004 Rezk
6,698,913 B2 3/2004 Yamamoto
6,702,235 B2 3/2004 Katzer
6,732,023 B2 5/2004 Sugita et al.
6,763,291 B1 7/2004 Houpt et al.
6,789,005 B2 9/2004 Hawthorne
6,810,312 B2 10/2004 Jammu et al.
6,824,110 B2 11/2004 Kane et al.
6,845,953 B2 1/2005 Kane et al.
6,853,888 B2 2/2005 Kane et al.
6,856,865 B2 2/2005 Hawthorne
6,863,246 B2 3/2005 Kane et al.
6,865,454 B2 3/2005 Kane et al.
6,873,888 B2 3/2005 Kumar
6,903,658 B2 6/2005 Kane et al.
6,910,792 B2 6/2005 Takada et al.
6,915,191 B2 7/2005 Kane et al.
6,922,619 B2 7/2005 Baig et al.
6,948,837 B2 9/2005 Suzuki
6,953,272 B2 10/2005 Hayakawa et al.
6,957,131 B2 10/2005 Kane et al.
6,973,947 B2 12/2005 Penaloza et al.
6,978,195 B2 12/2005 Kane et al.
6,980,894 B1 12/2005 Gordon et al.
6,996,461 B2 2/2006 Kane et al.
7,021,588 B2 4/2006 Hess, Jr. et al.
7,021,589 B2 4/2006 Hess, Jr. et al.
7,024,289 B2 4/2006 Kane et al.
7,036,774 B2 5/2006 Kane et al.
7,072,747 B2 7/2006 Armbruster et al.
7,072,757 B2 7/2006 Adams et al.
7,073,753 B2 7/2006 Root et al.
7,079,926 B2 7/2006 Kane et al.
7,092,800 B2 8/2006 Kane et al.
7,092,801 B2 8/2006 Kane et al.
7,096,171 B2 8/2006 Hawthorne et al.
7,131,403 B1 11/2006 Banga et al.
7,161,500 B2 * 1/2007 Alfredsson et al. ..... 340/961
7,164,975 B2 1/2007 Bidaud
7,302,895 B2 12/2007 Kumar et al.
7,347,168 B2 3/2008 Reckels et al.
7,349,797 B2 3/2008 Donnelly et al.
7,497,201 B2 3/2009 Hollenbeck
7,500,436 B2 3/2009 Kumar et al.
7,509,193 B2 3/2009 Kustosch
7,522,990 B2 4/2009 Daum et al.
7,618,011 B2 11/2009 Oleski et al.
7,667,611 B2 2/2010 Lindsey et al.
7,822,491 B2 * 10/2010 Howlett et al. ..... 700/28
8,068,975 B2 * 11/2011 Jensen et al. ..... 701/124
2001/0029411 A1 10/2001 Hawthorne
2001/0047241 A1 11/2001 Khavakh

(56) References Cited

U.S. PATENT DOCUMENTS

| | | | |
|---|---|---|---|
| 2002/0059075 | A1 | 5/2002 | Schick et al. |
| 2002/0072833 | A1 | 6/2002 | Gray |
| 2002/0093201 | A1 | 7/2002 | Soucy |
| 2002/0096081 | A1 | 7/2002 | Kraft |
| 2002/0107618 | A1 | 8/2002 | Deguchi |
| 2002/0174653 | A1 | 11/2002 | Uzkan |
| 2003/0001050 | A1 | 1/2003 | Katzer |
| 2003/0034423 | A1 | 2/2003 | Hess |
| 2003/0076221 | A1 | 4/2003 | Akiyama |
| 2003/0091017 | A1 | 5/2003 | Davenport |
| 2003/0104899 | A1 | 6/2003 | Keller |
| 2003/0105561 | A1 | 6/2003 | Nickles |
| 2003/0120400 | A1 | 6/2003 | Ahmed Baig |
| 2003/0183729 | A1 | 10/2003 | Root |
| 2003/0213875 | A1 | 11/2003 | Hess, Jr. et al. |
| 2003/0222981 | A1 | 12/2003 | Kisak |
| 2003/0229446 | A1 | 12/2003 | Boscamp |
| 2003/0233959 | A1 | 12/2003 | Kumar |
| 2004/0010432 | A1 | 1/2004 | Matheson et al. |
| 2004/0068359 | A1 | 4/2004 | Neiss |
| 2004/0098142 | A1 | 5/2004 | Warren |
| 2004/0104312 | A1 | 6/2004 | Hess |
| 2004/0108814 | A1 | 6/2004 | Tsuda |
| 2004/0122569 | A1 | 6/2004 | Bidaud |
| 2004/0129289 | A1 | 7/2004 | Hafemann |
| 2004/0133315 | A1 | 7/2004 | Kumar et al. |
| 2004/0172175 | A1 | 9/2004 | Julich |
| 2004/0174121 | A1 | 9/2004 | Tsuda |
| 2004/0245410 | A1 | 12/2004 | Kisak et al. |
| 2005/0007020 | A1 | 1/2005 | Tsuda |
| 2005/0055287 | A1 | 3/2005 | Schmidtberg |
| 2005/0065674 | A1 | 3/2005 | Houpt et al. |
| 2005/0085961 | A1 | 4/2005 | Kane |
| 2005/0109882 | A1 | 5/2005 | Armbruster |
| 2005/0120904 | A1 | 6/2005 | Kumar et al. |
| 2005/0121005 | A1 | 6/2005 | Edwards |
| 2005/0171655 | A1 | 8/2005 | Flynn |
| 2005/0171657 | A1 | 8/2005 | Kumar |
| 2005/0188745 | A1 | 9/2005 | Staphanos |
| 2005/0196737 | A1 | 9/2005 | Mann |
| 2005/0205719 | A1 | 9/2005 | Hendrickson |
| 2005/0251299 | A1 | 11/2005 | Donnelly |
| 2005/0288832 | A1 | 12/2005 | Smith |
| 2006/0041341 | A1 | 2/2006 | Kane |
| 2006/0047379 | A1 | 3/2006 | Schullian |
| 2006/0060345 | A1 | 3/2006 | Flik |
| 2006/0085103 | A1 | 4/2006 | Smith |
| 2006/0085363 | A1 | 4/2006 | Cheng |
| 2006/0116789 | A1 | 6/2006 | Subramanian |
| 2006/0116795 | A1 | 6/2006 | Abe |
| 2006/0122737 | A1 | 6/2006 | Tani |
| 2006/0155434 | A1 | 7/2006 | Kane |
| 2006/0162973 | A1 | 7/2006 | Harris |
| 2006/0212188 | A1 | 9/2006 | Kickbusch |
| 2006/0277906 | A1 | 12/2006 | Burk |
| 2006/0282199 | A1 | 12/2006 | Daum |
| 2007/0061053 | A1 | 3/2007 | Zeitzew |
| 2007/0112475 | A1 | 5/2007 | Koeble |
| 2007/0219680 | A1 | 9/2007 | Kumar et al. |
| 2007/0219681 | A1 | 9/2007 | Kumar |
| 2007/0219683 | A1 | 9/2007 | Daum |
| 2007/0233364 | A1 | 10/2007 | Kumar |
| 2007/0260369 | A1 | 11/2007 | Philp |
| 2007/0261648 | A1 | 11/2007 | Reckels |
| 2008/0004721 | A1 | 1/2008 | Huff |
| 2008/0128563 | A1 | 6/2008 | Kumar |
| 2008/0147256 | A1 | 6/2008 | Liberatore |
| 2008/0208393 | A1 | 8/2008 | Schricker |
| 2009/0140574 | A1 | 6/2009 | Gorman |
| 2009/0177345 | A1 | 7/2009 | Severinsky |
| 2009/0254239 | A1 | 10/2009 | Daum |
| 2009/0319092 | A1 | 12/2009 | Piche |
| 2010/0152998 | A1 | 6/2010 | Schwarzmann |

FOREIGN PATENT DOCUMENTS

| | | |
|---|---|---|
| DE | 198 30 353 | 2/2001 |
| DE | 199 35 349 | 2/2001 |
| DE | 199 35 353 | 2/2001 |
| DE | 100 45 921 | 3/2002 |
| EP | 0 594 226 | 9/1990 |
| EP | 0 428 113 | 11/1990 |
| EP | 0 554 983 | 8/1993 |
| EP | 1 136 969 | 9/2001 |
| EP | 1 136 969 | 7/2002 |
| EP | 1 297 982 | 4/2003 |
| EP | 1 466 803 | 10/2004 |
| EP | 1 253 059 | 8/2006 |
| FR | 2 129 215 | 10/1972 |
| FR | 2 558 806 | 1/1984 |
| FR | 2 767 770 | 9/1997 |
| FR | 2 767 770 | 3/1999 |
| GB | 482 625 | 12/1936 |
| JP | 60 028153 | 2/1985 |
| JP | 50-32733 | 9/1993 |
| JP | 06-108869 | 4/1994 |
| JP | 2001-065360 | 3/2001 |
| WO | WO 95/25053 | 9/1995 |
| WO | WO 99/14093 | 3/1999 |
| WO | WO 03/097424 | 11/2003 |
| WO | WO 2004/023517 | 3/2004 |
| WO | WO 2004/051699 | 6/2004 |
| WO | WO 2004/051700 | 6/2004 |
| WO | WO 2004/052755 | 6/2004 |
| WO | WO 2004/059446 | 7/2004 |
| WO | WO 2005/061300 | 7/2005 |
| WO | WO 2007/027130 | 3/2007 |
| WO | WO 2007/091270 | 8/2007 |

OTHER PUBLICATIONS

ISR and WO pertaining to International application No. PCT/US2009/032933 dated Nov. 3, 2009.

Chang et al. "Cycle Detection in Repair-Based Railway Scheduling System", Robotics and Automation, 1996 pp. 2517-2522, V3, New York, NY.

Grabs, Ulrike, "Modification of Electronic Interlocking EL S in Service", Signal + Draht, Telzlaff Verlag GmbH, 1995, pp. 254-258, V87(7/08), Darmstadt, DE.

Cheng, Yu, "Hybrid Simulation for Resolving Resource conflicts in Train Traffic Rescheduling", Computers in Industry, 1998, pp. 233-246, V35(3), Amsterdam, NL.

ISR and WO pertaining to International application No. PCT US2006/032893 dated Aug. 24, 2006.

ISR and WO pertaining to International application No. PCT/US2007/001428 dated Jan. 18, 2007.

ISR and WO pertaining to International application No. PCT/US2007/066697 dated Apr. 16, 2007.

ISR and WO pertaining to International application No. PCT/US2007/076699 dated Aug. 24, 2007.

ISR and WO pertaining to International application No. PCT/US2007/078001 dated Sep. 10, 2007.

ISR and WO pertaining to International application No. PCT/US2007/078016 dated Sep. 10, 2007.

ISR and WO pertaining to International application No. PCT/US2007/078118 dated Sep. 11, 2007.

ISR and WO pertaining to International application No. PCT/US2007/078340 dated Sep. 13, 2007.

ISR and WO pertaining to International application No. PCT/US2008/063193 dated May 9, 2008.

ISR and WO pertaining to International application No. PCT/US2008/083526 dated Nov. 14, 2008.

ISR and WO pertaining to International application No. PCT/US2009/031740 dated Jan. 23, 2009.

ISR and WO pertaining to International application No. PCT/US2009/032933 dated Feb. 3, 2009.

ISR and WO pertaining to International application No. PCT/US2009/037293 dated Mar. 16, 2009.

(56) References Cited

OTHER PUBLICATIONS

ISR and WO pertaining to International application No. PCT/US2009/045004 dated May 22, 2009.

ISR pertaining to International application No. PCT/US2010/035058 dated May 17, 2010.

ISR pertaining to International application No. PCT/US2010/047251 dated Aug. 31, 2010.

* cited by examiner

SYSTEM, METHOD, AND COMPUTER SOFTWARE CODE FOR PROVIDING REAL TIME OPTIMIZATION OF A MISSION PLAN FOR A POWERED SYSTEM

CROSS-REFERENCE TO RELATED APPLICATIONS

This application claims the benefit of U.S. Provisional Application No. 61/060,785 filed Jun. 11, 2008, and incorporated herein by reference in its entirety.

This application also claims priority to and is a Continuation-In-Part of U.S. application Ser. No. 11/765,443 filed Jun. 19, 2007, which claims priority to U.S. Provisional Application No. 60/894,039 filed Mar. 9, 2007, and U.S. Provisional Application No. 60/939,852 filed May 24, 2007, and incorporated herein by reference in its entirety.

U.S. application Ser. No. 11/765,443 claims priority to and is a Continuation-In-Part of U.S. application Ser. No. 11/669,364 filed Jan. 31, 2007, which claims priority to U.S. Provisional Application No. 60/849,100 filed Oct. 2, 2006, and U.S. Provisional Application No. 60/850,885 filed Oct. 10, 2006, and incorporated herein by reference in its entirety.

U.S. application Ser. No. 11/669,364 claims priority to and is a Continuation-In-Part of U.S. application Ser. No. 11/385,354 filed Mar. 20, 2006, and incorporated herein by reference in its entirety.

BACKGROUND OF THE INVENTION

This invention relates to a powered system, such as a train, an off-highway vehicle, a marine vessel, a transport vehicle, an agriculture vehicle, and/or a stationary powered system and, more particularly to a system, method, and computer software code for real time optimization of at least fuel usage, emission output, and/or speed of a powered system while performing a mission.

Some powered systems, such as, but not limited to, off-highway vehicles, marine diesel powered propulsion plants, stationary diesel powered system, agricultural vehicles, and trains or other rail vehicle systems, are powered by one or more diesel power units, or diesel-fueled power generating units. With respect to rail vehicle systems, a diesel power unit is usually a part of at least one locomotive powered by at least one diesel internal combustion engine, and with the locomotive being part of a train that further includes a plurality of rail cars, such as freight cars. Locomotives are complex systems with numerous subsystems, with each subsystem being interdependent on other subsystems.

An operator is usually aboard a locomotive to ensure the proper operation of the locomotive, and when there is a locomotive consist, the operator is usually aboard a lead locomotive. A locomotive consist is a group of locomotives that operate together in operating a train. In addition to ensuring proper operations of the locomotive, or locomotive consist, the operator also is responsible for determining operating speeds of the train and forces within the train. To perform this function, the operator generally must have extensive experience with operating the locomotive and various trains over the specified terrain. This knowledge is needed to comply with prescribed operating parameters, such as speeds, emissions, and the like that may vary with the train location along the track. Moreover, the operator is also responsible for assuring in-train forces remain within acceptable limits.

In marine applications, an operator is usually aboard a marine vessel to ensure the proper operation of the vessel, and when there is a vessel consist, the lead operator is usually in control of a lead vessel. As with the locomotive example cited above, a vessel consist is a group of vessels that operate together in carrying out a combined mission. In addition to ensuring proper operations of the vessel, or vessel consist, the lead operator also is responsible for determining operating speeds of the consist and forces within the consist. To perform this function, the operator generally must have extensive experience with operating the vessel and various consists over the specified waterway or mission. This knowledge is needed to comply with prescribeable operating speeds and other mission parameters that may vary with the vessel location along the mission. Moreover, the operator is also responsible for ensuring that intra-vessel and inter-vessel forces and mission location remain within acceptable limits.

When operating a train, train operators typically call for the same notch settings when operating the train, which in turn may lead to a large variation in fuel consumption and/or emission output, such as, but not limited to, $NO_x$, $CO_2$, etc., depending on a number of locomotives powering the train. Thus, the operator usually cannot operate the locomotives so that the fuel consumption is minimized and emission output is minimized for each trip, since the size and loading of trains vary, and locomotives and their power availability may vary by model type.

However, with respect to a locomotive, even with knowledge to ensure safe operation, the operator cannot usually operate the locomotive so that the fuel consumption and emissions are minimized for each trip. For example, other factors that must be considered may include emission output, operator's environmental conditions like noise/vibration, a weighted combination of fuel consumption and emissions output, etc. This is difficult to do since, as an example, the size and loading of trains vary, locomotives and their fuel/emissions characteristics are different, and weather and traffic conditions vary.

Similar issues arise when an operator attempts to optimize speed of a train. Though an operator may be skilled at operating various train configurations, ensuring an optimized mission speed is not uniformly possible across various train configurations. Furthermore, situations may arise where improper information is initially provided when establishing a mission plan. Though not detrimental to the operation of the train, having improper information may result in the train not operating where optimized fuel use and/or emission output is realized.

A train owner usually owns a plurality of trains, wherein the trains operate over a network of railroad tracks. Since individual operators are required for each train, wherein each operator's skill and ability to optimize a train's performance varies, the number of factors relating to ensuring optimization of fuel use, emission output, and speed, to ensure proper use of all resources in the network, increases exponentially. Because of the integration of multiple trains running concurrently within the network of railroad tracks, wherein scheduling issues must also be considered with respect to train operations, train owners would benefit from a way to optimize fuel efficiency and emission output in real time so as to save on overall fuel consumption, while minimizing emission output of multiple trains, and while meeting mission trip time constraints. Furthermore, owners and operators of individual trains, or other powered systems, would realize similar financial benefits if real time information were to be provided to optimize the powered systems' performance throughout a mission being performed.

BRIEF DESCRIPTION OF THE INVENTION

Embodiments of the present invention relate to a system, method, and a computer software code for providing current information for a mission plan of a powered system. In one aspect, the method includes determining whether a mission plan is correct to satisfy at least one mission objective. Information used to establish the mission plan is updated. The mission plan is revised based on the updated information to satisfy the at least one mission objective.

In another embodiment, the method includes evaluating a current mission plan against updated information received that is indicative of a preferred mission plan. The current mission plan is updated based on the updated information to establish the preferred mission plan as the current mission plan.

In another embodiment, the computer software code is stored on a computer readable media and is executed with a processor. The computer software code includes a computer software module for evaluating a current mission plan against received updated information that is indicative of a preferred mission plan, when executed with the processor. A computer software module is further disclosed for updating the current mission plan based on the updated information to establish the preferred mission plan as the current mission plan, when executed with the processor.

In another embodiment, the system includes a processor configured to determine whether a mission plan is correct to satisfy at least one mission objective of the mission plan. A communication system is configured to receive information from a remote location, wherein the information is used to update the mission plan. For example, the system may include computer-readable instructions that when executed by the processor cause the processor to update the mission plan based on the received information.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, exemplary embodiments of the invention will be described and explained with additional specificity and detail through the use of the accompanying drawings in which.

DETAILED DESCRIPTION OF THE INVENTION

Figure 1:
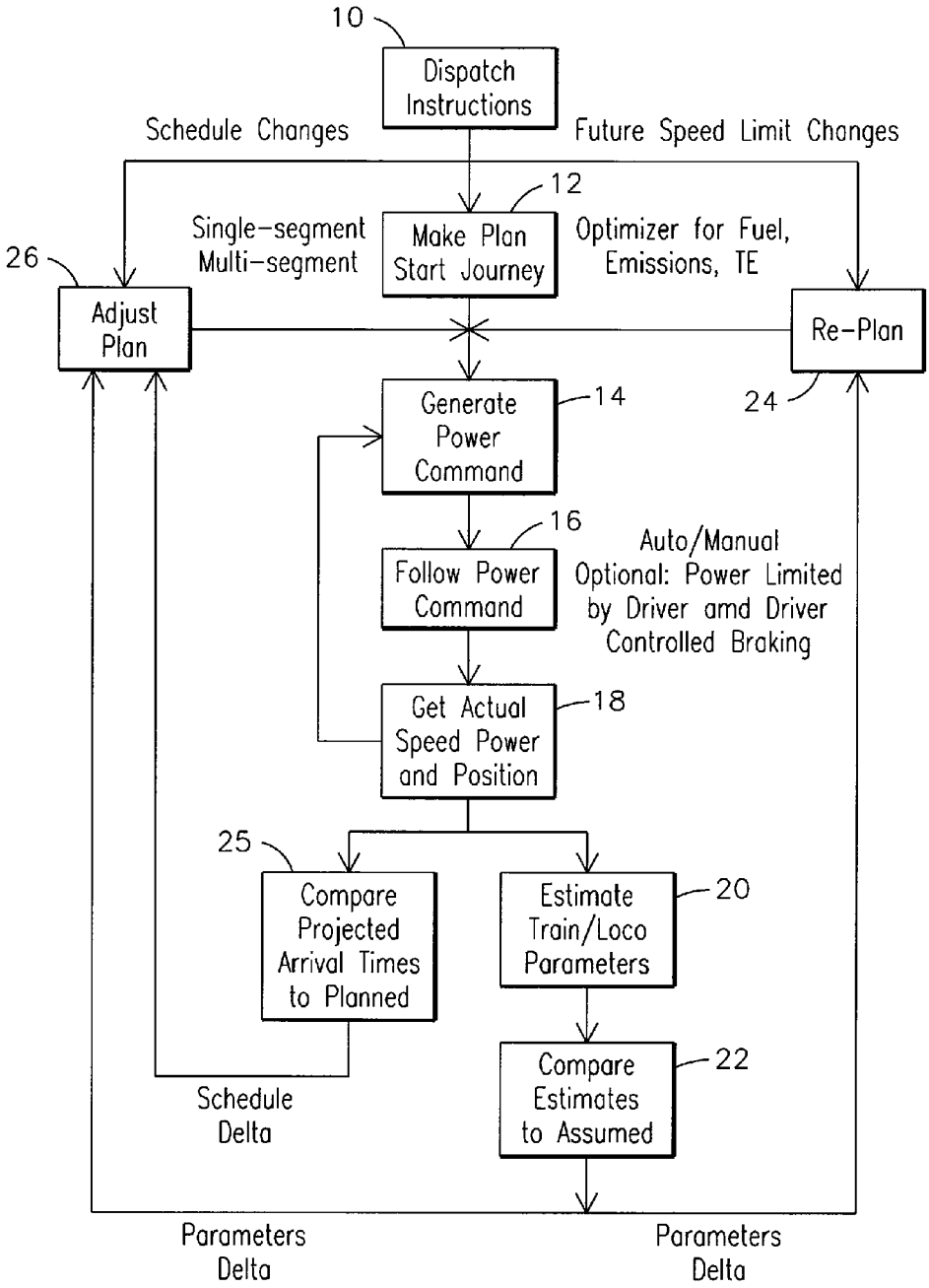
FIG. 1 is a flowchart that depicts a method of trip optimization, according to an embodiment of the present invention.

Reference will now be made in detail to the embodiments consistent with the invention, examples of which are illustrated in the accompanying drawings. Wherever possible, the same reference numerals used throughout the drawings refer to the same or like parts.

Though exemplary embodiments of the present invention are described with respect to rail vehicles, or railway transportation systems, specifically trains and locomotives having diesel engines, exemplary embodiments of the invention are also applicable for other uses, such as but not limited to off-highway vehicles, marine vessels, stationary units, and other vehicles such as agricultural vehicles and transport buses, each which may use at least one diesel engine, or diesel internal combustion engine. Towards this end, when discussing a specified mission, this includes a task or requirement to be performed by the diesel powered system. Therefore, with respect to railway, marine, transport vehicles, agricultural vehicles, or off-highway vehicle applications this may refer to the movement of the system from a present location to a destination.

In the case of stationary applications, such as but not limited to a stationary power generating station or network of power generating stations, a specified mission may refer to an amount of wattage (e.g., MW/hr) or other parameter or requirement to be satisfied by the diesel powered system. Likewise, operating conditions of the diesel-fueled power generating unit may include one or more of speed, load, fueling value, timing, and the like. Furthermore, though diesel powered systems are disclosed, those skilled in the art will readily recognize that embodiments of the invention may also be utilized with non-diesel powered systems, such as but not limited to natural gas powered systems, bio-diesel powered systems, etc.

Furthermore, as disclosed herein, such non-diesel powered systems, as well as diesel powered systems, may include multiple engines, other power sources, and/or additional power sources, such as, but not limited to, battery sources, voltage sources (such as but not limited to capacitors), chemical sources, pressure based sources (such as but not limited to spring and/or hydraulic expansion), electrical current sources (such as but not limited to inductors), inertial sources (such as but not limited to flywheel devices), gravitational-based power sources, and/or thermal-based power sources. Additionally, the power source may be external, such as but not limited to, an electrically powered system, such as a locomotive or train, where power is sourced externally from overhead catenary wire, third rail, and/or magnetic levitation coils.

In one example involving marine vessels, a plurality of tugs may be operating together where all are moving the same larger vessel, where each tug is linked in time to accomplish the mission of moving the larger vessel. In another example, a single marine vessel may have a plurality of engines. Off-highway vehicle (OHV) applications may involve a fleet of vehicles that have a same mission to move earth, from location "A" to location "B," where each OHV is linked in time to accomplish the mission. With respect to a stationary power generating station, a plurality of stations may be grouped together for collectively generating power for a specific location and/or purpose. In another exemplary embodiment, a single station is provided, but with a plurality of generators making up the single station. In one example involving locomotive vehicles, a plurality of diesel powered systems may be operated together, where all are moving the same, larger load, e.g., a plurality of rail cars, and where each system is linked in time to accomplish the mission of moving the larger load. In another exemplary embodiment a locomotive vehicle may have more than one diesel powered system.

Exemplary embodiments of the invention solve problems in the art by providing a system, method, and computer implemented method, such as a computer software code and/or computer readable media, for providing real time optimization of an operating parameter, such as but not limited to at least fuel usage, emission output, and/or speed, of a powered system while performing a mission. With respect to at least locomotives, exemplary embodiments of the present invention are also operable when the locomotive consist is in distributed power operations. Those skilled in the art will recognize that other powered systems may also operate in a distributed power configuration.

Persons skilled in the art will recognize that an apparatus, such as a data processing system, including a CPU, memory, I/O, program storage, a connecting bus, and other appropriate components, could be programmed or otherwise designed to facilitate the practice of the method of the invention. Such a system would include appropriate program means for executing the method of the invention.

Also, an article of manufacture, such as a pre-recorded disk or other similar computer program product, for use with a data processing system, could include a storage medium and program means recorded thereon for directing the data processing system to facilitate the practice of the method of the invention. Such apparatus and articles of manufacture also fall within the spirit and scope of the invention.

Broadly speaking, a technical effect is providing real time optimization of an operating parameter, such as but not limited to at least fuel usage, emission output, and/or speed, of a powered system while performing a mission, and operating the powered system based at least in part on the optimized operating parameter. To facilitate an understanding of the exemplary embodiments of the invention, it is described hereinafter with reference to specific implementations thereof. Exemplary embodiments of the invention may be described in the general context of computer-executable instructions, such as program modules, being executed by any device, such as but not limited to a computer, designed to accept data, perform prescribed mathematical and/or logical operations usually at high speed, where results of such operations may or may not be displayed. Generally, program modules, or computer software modules, include routines, programs, objects, components, data structures, etc., that perform particular tasks or implement particular abstract data types. For example, the software programs, or computer software code, that underlie exemplary embodiments of the invention can be coded in different programming languages, for use with different devices, or platforms. In the description that follows, examples of the invention may be described in the context of a web portal that employs a web browser. It will be appreciated, however, that the principles that underlie exemplary embodiments of the invention can be implemented with other types of computer software technologies as well.

Moreover, those skilled in the art will appreciate that exemplary embodiments of the invention may be practiced with other computer system configurations, including hand-held devices, multiprocessor systems, microprocessor-based or programmable consumer electronics, minicomputers, mainframe computers, and the like. Exemplary embodiments of the invention may also be practiced in distributed computing environments where tasks are performed by remote processing devices that are linked through a communications network. In a distributed computing environment, program modules may be located in both local and remote computer storage media including memory storage devices. These local and remote computing environments may be contained entirely within the locomotive, or adjacent locomotives in a consist, or off-board in wayside or central offices where wireless communication is used.

Throughout this document the term "locomotive consist" is used. As used herein, a locomotive consist may be described as having one or more locomotives in succession, connected together so as to provide motoring and/or braking capability. In many cases, the locomotives are connected together where no train cars are in between the locomotives. The train can have more than one locomotive consist in its composition. Specifically, there can be a lead consist and one or more remote consists, such as midway in the line of cars and another remote consist at the end of the train. Each locomotive consist may have a first locomotive and trail locomotive(s). Though a first locomotive is usually viewed as the lead locomotive, those skilled in the art will readily recognize that the first locomotive in a multi locomotive consist may be physically located in a physically trailing position.

Though a locomotive consist is usually viewed as involving successive locomotives, those skilled in the art will readily recognize that a group of locomotives may also be recognized as a consist even when one or more rail cars separate the locomotives, such as when the locomotive consist is configured for distributed power operation, wherein throttle and braking commands are relayed from the lead locomotive to the remote trains by a radio link or physical cable. Towards this end, the term locomotive consist should be not be considered a limiting factor when discussing multiple locomotives within the same train.

As disclosed herein, the idea of a consist may also be applicable when referring to other types of powered systems, including, but not limited to, marine vessels, off-highway vehicles, and/or stationary power plants, that operate together so as to provide motoring, power generation, and/or braking capability. Therefore, even though the term locomotive consist is used herein in regards to certain illustrative embodiments, this term may also apply to other powered systems. Similarly, sub-consists may exist. For example, the diesel powered system may have more than one diesel-fueled power generating unit. For example, a power plant may have more than one diesel electric power unit where optimization may be at the sub-consist level. Likewise, a locomotive may have more than one diesel power unit.

Throughout this document the term "notch" is also used. Though notch is generally interpreted as pre-set throttle settings, in the context of this invention the term is defined to include pre-set throttle settings and/or a continuous resolution throttle application, where notch is any throttle value.

Referring now to the drawings, embodiments of the present invention will be described. Exemplary embodiments of the invention can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the invention are discussed below.

Figure 7:
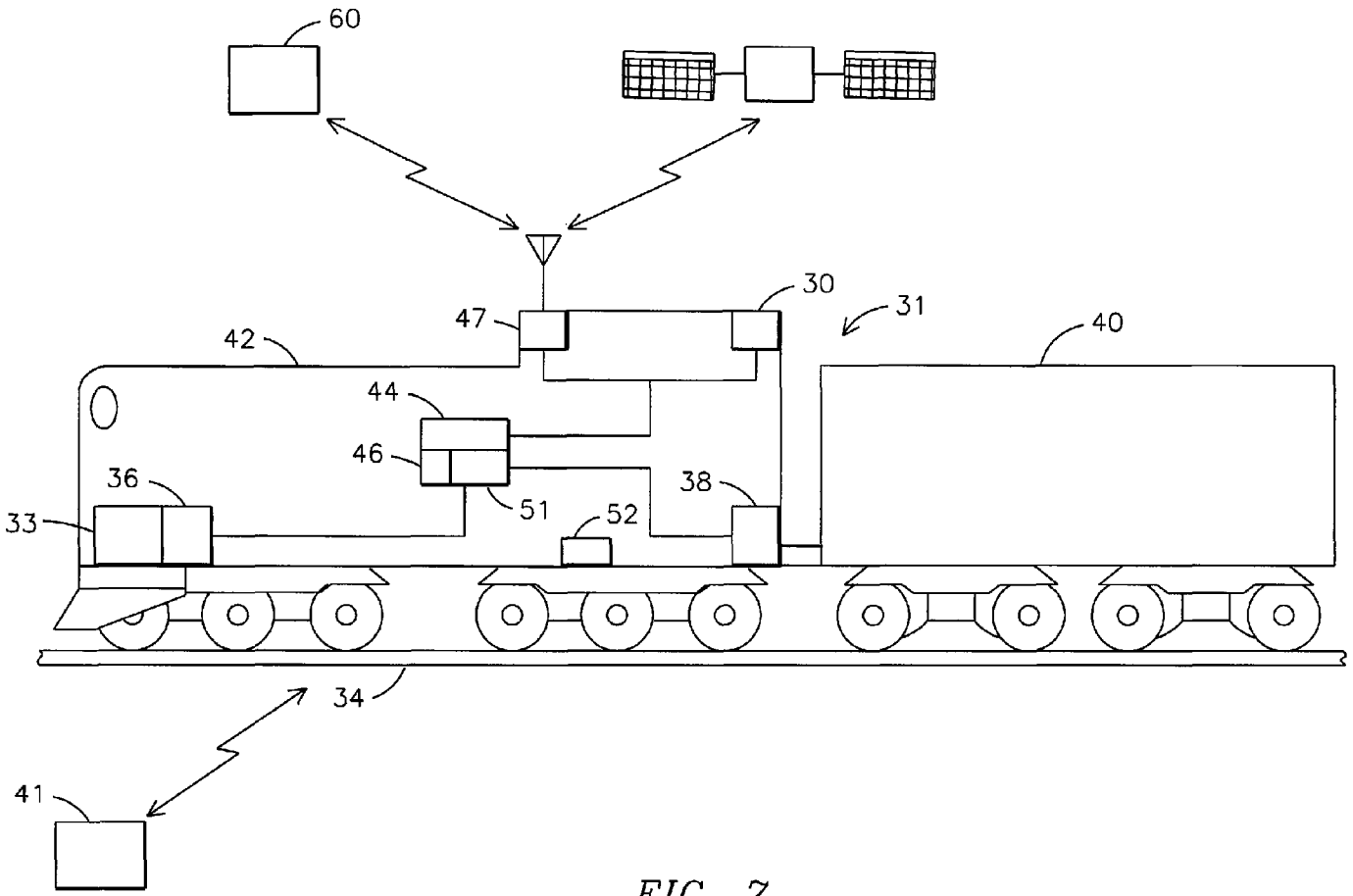
FIG. 7 depicts an exemplary embodiment of elements for trip optimization.

FIG. 1 depicts a flow chart of an exemplary embodiment of a method for trip optimization. FIG. 7 shows various elements of a powered system (e.g., train) that includes a trip optimizer system configured to carry out the method shown in FIG. 1. As illustrated, instructions are input specific to planning a trip either on board or from a remote location, such as a dispatch center 10. Such input information includes, but is not limited to, train position, consist description (such as locomotive models), locomotive power description, performance of locomotive traction transmission, consumption of engine fuel as a function of output power, cooling characteristics, the intended trip route (including information relating to effective track grade and curvature as function of milepost, and/or an "effective grade" component to reflect curvature following standard railroad practices), the train represented by car makeup and loading together with effective drag coefficients, trip desired parameters including, but not limited to, start time and location, end location, desired travel time, crew (user and/or operator) identification, crew shift expiration time, and route.

This data may be provided to the locomotive 42 (see FIG. 7) in a number of ways, such as, but not limited to, an operator manually entering this data into the locomotive 42 via an onboard display, inserting a memory device such as a hard card and/or USB flash drive containing the data into a receptacle aboard the locomotive, and transmitting the information via wireless communication from a central or wayside location 41, such as a track signaling device and/or a wayside device, to the locomotive 42. Locomotive 42 and train 31 load characteristics (e.g., drag) may also change over the route (e.g., with altitude, ambient temperature, and condition of the rails and rail-cars), and the plan may be updated to reflect such changes as needed by any of the methods discussed above and/or by real-time autonomous collection of locomotive/train conditions. This includes, for example, changes in locomotive or train characteristics detected by monitoring equipment on or off board the locomotive(s) 42.

The track signal system determines the allowable speed of the train. There are many types of track signal systems and operating rules associated with each of the signals. For example, some signals have a single light (on/off), some signals have a single lens with multiple colors, and some signals have multiple lights and colors. These signals can indicate that the track is clear and the train may proceed at a maximum allowable speed. They can also indicate that a reduced speed or stop is required. This reduced speed may need to be achieved immediately, or at a certain location (e.g., prior to the next signal or crossing).

The signal status is communicated to the train and/or operator through various means. Some systems have circuits in the track and inductive pick-up coils on the locomotives. Other systems have wireless communications systems. Signal systems can also require the operator to visually inspect the signal and take the appropriate actions.

The track signaling system may interface with the onboard signal system and adjust the locomotive speed according to the inputs and the appropriate operating rules. For signal systems that require the operator to visually inspect the signal status, the operator screen will present the appropriate signal options for the operator to enter based on the train's location. The type of signal systems and operating rules, as a function of location, may be stored in an onboard database 63.

Based on the specification data input into the trip optimizer system, an optimal plan which minimizes fuel use and/or emissions produced subject to speed limit constraints along the route with desired start and end times is computed to produce a trip profile 12. The profile contains the optimal speed and power (notch) settings the train is to follow, expressed as a function of distance and/or time, and such train operating limits, including but not limited to, the maximum notch power and brake settings, and speed limits as a function of location, and the expected fuel used and emissions generated. In an exemplary embodiment, the value for the notch setting is selected to obtain throttle change decisions about once every 10 to 30 seconds. Those skilled in the art will readily recognize that the throttle change decisions may occur at a longer or shorter duration, if needed and/or desired to follow an optimal speed profile. In a broader sense, it should be evident to ones skilled in the art that the profiles provide power settings for the train, either at the train level, consist level, and/or individual train level. Power comprises braking power, motoring power, and airbrake power. In another embodiment, instead of operating at the traditional discrete notch power settings, a continuous power setting, determined as optimal for the profile selected, may be selected. Thus, for example, if an optimal profile specifies a notch setting of 6.8, instead of operating at notch setting 7 (assuming discreet notch setting of, e.g., 6, 7, 8, and so on), the locomotive 42 can operate at 6.8. Allowing such intermediate power settings may bring additional efficiency benefits as described below.

The procedure used to compute the optimal profile can be any number of methods for computing a power sequence that drives the train 31 to minimize fuel and/or emissions subject to locomotive operating and schedule constraints, as summarized below. In some cases the required optimal profile may be close enough to one previously determined, owing to the similarity of the train configuration, route and environmental conditions. In these cases it may be sufficient to look up the driving trajectory within a database 63 and attempt to follow it. When no previously computed plan is suitable, methods to compute a new one include, but are not limited to, direct calculation of the optimal profile using differential equation models which approximate the train physics of motion. The setup involves selection of a quantitative objective function, commonly a weighted sum (integral) of model variables that correspond to rate of fuel consumption and emissions generation plus a term to penalize excessive throttle variation.

An optimal control formulation is set up to minimize the quantitative objective function subject to constraints including but not limited to, speed limits and minimum and maximum power (throttle) settings and maximum cumulative and instantaneous emissions. Depending on planning objectives at any time, the problem may be implemented flexibly to minimize fuel subject to constraints on emissions and speed limits, or to minimize emissions, subject to constraints on fuel use and arrival time. It is also possible to establish, for example, a goal to minimize the total travel time without constraints on total emissions or fuel use where such relaxation of constraints would be permitted or required for the mission.

Throughout the document exemplary equations and objective functions are presented for minimizing locomotive fuel consumption. These equations and functions are for illustration only as other equations and objective functions can be employed to optimize fuel consumption or to optimize other locomotive/train operating parameters.

Mathematically, the problem to be solved may be stated more precisely. The basic physics are expressed by:

$$\frac{dx}{dt} = v;\ x(0) = 0.0;\ x(T_f) = D$$

$$\frac{dv}{dt} = T_e(u, v) - G_a(x) - R(v);\ v(0) = 0.0;\ v(T_f) = 0.0$$

where x is the position of the train, v its velocity and t is time (in miles, miles per hour, and minutes or hours, as appropriate) and u is the notch (throttle) command input. Further, D denotes the distance to be traveled, $T_f$ the desired arrival time at distance D along the track, $T_e$ is the tractive effort produced by the locomotive consist, $G_a$ is the gravitational drag which depends on the train length, train makeup, and terrain on which the train is located, and R is the net speed dependent drag of the locomotive consist and train combination. The initial and final speeds can also be specified, but without loss of generality are taken to be zero here (e.g., train stopped at beginning and end). Finally, the model is readily modified to include other important dynamics such the lag between a change in throttle, u, and the resulting tractive effort or braking. Using this model, an optimal control formulation is set up to minimize the quantitative objective function subject to constraints including but not limited to, speed limits and minimum and maximum power (throttle) settings. Depending on planning objectives at any time, the problem may be set up flexibly to minimize fuel subject to constraints on emissions and speed limits, or to minimize emissions, subject to constraints on fuel use and arrival time.

It is also possible to implement, for example, a goal to minimize the total travel time without constraints on total emissions or fuel use where such relaxation of constraints would be permitted or required for the mission. All these performance measures can be expressed as a linear combination of any of the following:

$$\min_{u(t)} \int_0^{T_f} F(u(t))dt\text{-Minimize total fuel consumption} \tag{1}$$

$$\min_{u(t)} T_f\text{-Minimize Travel Time}$$

$$\min_{u_i} \sum_{i=2}^{n_d} (u_i - u_{i-1})^2\text{-Minimize notch jockeying}\begin{pmatrix} \textit{piecewise} \\ \text{constant} \\ \text{input} \end{pmatrix}$$

$$\min_{u(t)} \int_0^{T_f} (du/dt)^2 dt\text{-Minimize notch jockeying}\begin{pmatrix} \text{continuous} \\ \text{input} \end{pmatrix}$$

It is possible to replace the fuel term F in (1) with a term corresponding to emissions production. For example, for emissions $$\min_{u(t)} \int_0^{T_f} E(u(t))dt\text{-Minimize total emissions production.}$$

In this equation E is the quantity of emissions in gm/hphr for each of the notches (or power settings). In addition, a minimization could be done based on a weighted total of fuel and emissions.

A commonly used and representative objective function is thus:

$$\min_{u(t)} \alpha_1 \int_0^{T_f} F(u(t))dt + \alpha_3 T_f + \alpha_2 \int_0^{T_f} (du/dt)^2 dt \tag{OP}$$

The coefficients of the linear combination depend on the importance (weight) given to each of the terms. Note that in equation (OP), u(t) is the optimizing variable that is the continuous notch position. If discrete notch is required, e.g. for older locomotives, the solution to equation (OP) is discretized, which may result in lower fuel savings. Finding a minimum time solution ($\alpha_1$ set to zero and $\alpha_2$ set to zero or a relatively small value) is used to find a lower bound for the achievable travel time ($T_f = T_{fmin}$) In this case, both u(t) and $T_f$ are optimizing variables. In one embodiment, equation (OP) is solved for various values of $T_f$ with $T_f > T_{fmin}$ with $\alpha_3$ set to zero. In this latter case, $T_f$ is treated as a constraint.

For those familiar with solutions to such optimal problems, it may be necessary to adjoin constraints, e.g., the speed limits along the path:

$$0 \le v \le SL(x)$$

or when using minimum time as the objective, that an end point constraint must hold, e.g., total fuel consumed must be less than what is in the tank, e.g. via:

$$0 < \int_0^{T_f} F(u(t))dt \le W_F$$

Here, $W_F$ is the fuel remaining in the tank at $T_f$. Those skilled in the art will readily recognize that equation (OP) can be in other forms as well and that what is presented above is an exemplary equation for use in the exemplary embodiment of the present invention. For example, those skilled in the art will readily recognize that a variation of equation (OP) is required where multiple power systems, diesel and/or non-diesel, are used to provide multiple thrusters, such as, but not limited to, those that may be used when operating a marine vessel.

Reference to emissions in the context of the exemplary embodiment of the present invention is actually directed towards cumulative emissions produced in the form of oxides of nitrogen (NOx), carbon oxides ($CO_x$), unburned hydrocarbons (HC), particulate matter (PM), etc. However, other emissions may include, but not be limited to a maximum value of electromagnetic emission, such as a limit on radio frequency (RF) power output, measured in watts, for respective frequencies emitted by the locomotive. Yet another form of emission is the noise produced by the locomotive, typically measured in decibels (dB). An emission requirement may be variable based on a time of day, a time of year, and/or atmospheric conditions such as weather or pollutant level in the atmosphere. Emission regulations may vary geographically across a railroad system. For example, an operating area such as a city or state may have specified emission objectives, and an adjacent area may have different emission objectives, for example a lower amount of allowed emissions or a higher fee charged for a given level of emissions.

Accordingly, an emission profile for a certain geographic area may be tailored to include maximum emission values for each of the regulated emissions included in the profile to meet a predetermined emission objective required for that area. Typically, for a locomotive, these emission parameters are determined by, but not limited to, the power (notch) setting, ambient conditions, and engine control method. By design, every locomotive must be compliant with EPA emission standards, and thus in an embodiment of the present invention that optimizes emissions this may refer to mission-total emissions, for which there is no current EPA specification. Operation of the locomotive according to the optimized trip plan is at all times compliant with EPA emission standards. Those skilled in the art will readily recognize that because diesel engines are used in other applications, other regulations may also be applicable. For example, $CO_2$ emissions are considered in certain international treaties.

If an objective during a trip mission is to reduce emissions, the optimal control formulation, equation (OP), would be amended to consider this trip objective. A key flexibility in the optimization setup is that any or all of the trip objectives can vary by geographic region or mission. For example, for a high priority train, minimum time may be the only objective on one route because it is high priority traffic. In another example, emission output could vary from state to state along the planned train route.

To solve the resulting optimization problem, in an exemplary embodiment, a dynamic optimal control problem in the time domain is transcribed to an equivalent static mathematical programming problem with N decision variables, where the number 'N' depends on the frequency at which throttle and braking adjustments are made and the duration of the trip. For typical problems, this N can be in the thousands. For example, suppose a train is traveling a 172-mile (276.8 kilometers) stretch of track in the southwest United States. Utilizing the trip optimizer system, an exemplary 7.6% saving in fuel used may be realized when comparing a trip determined and followed using the trip optimizer system versus an actual driver throttle/speed history where the trip was determined by an operator. The improved savings is realized because the trip optimizer system produces a driving strategy with both less drag loss and little or no braking loss compared to the trip plan of the operator.

Figure 2:
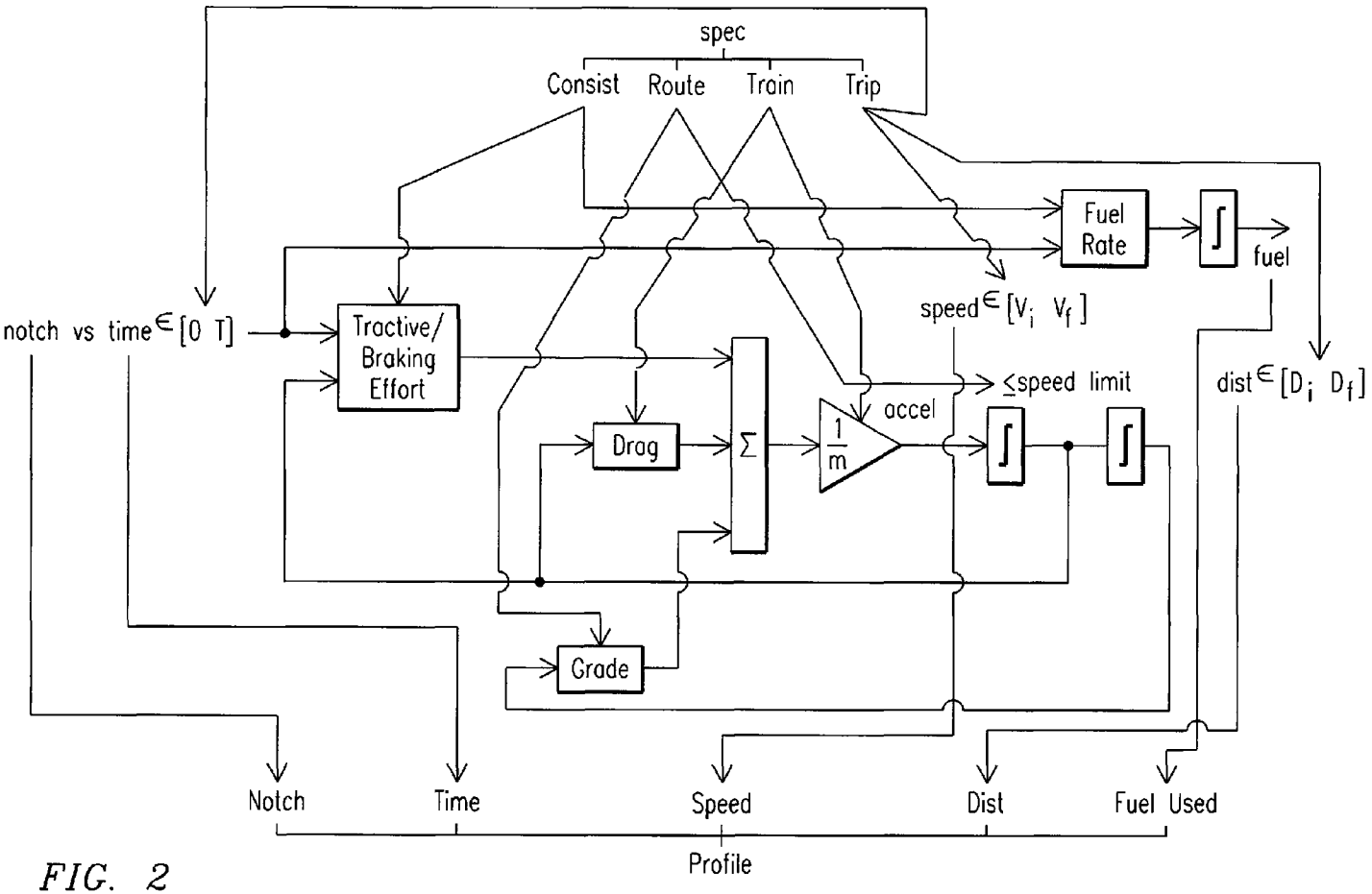
FIG. 2 depicts a simplified mathematical model of a train that may be employed in connection with an embodiment of the present invention.

To make the optimization described above computationally tractable, a simplified mathematical model of the train may be employed, such as illustrated in FIG. 2 and the equations discussed above. As illustrated, certain set specifications, such as but not limited to information about the consist, route information, train information, and/or trip information, are considered to determine a profile, such as an optimized profile. Such factors incorporated in the profile include, but are not limited to, speed, distance remaining in the mission, and/or fuel used. As disclosed herein, other factors that may be included in the profile are notch setting and time. One possible refinement to the optimal profile is produced by driving a more detailed model with the optimal power sequence generated, to test if other thermal, electrical, and mechanical constraints are violated. This leads to a modified profile with speed versus distance that is closest to a run that can be achieved without harming locomotive or train equipment, i.e., satisfying additional implied constraints such as thermal and electrical limits on the locomotive and inter-car forces in the train. Those skilled in the art will readily recognize how the equations discussed herein are utilized with FIG. 2.

Referring back to FIG. 1, once the trip is started 12, power commands are generated 14 to put the mission plan in motion. Depending on the operational set-up of the trip optimizer system, one command is for the locomotive to follow the optimized power command 16 so as to achieve the optimal speed. The trip optimizer system obtains actual speed and power information 18 from the locomotive consist of the train. Owing to the inevitable approximations in the models used for the optimization, a closed-loop calculation of corrections to optimized power is obtained to track the desired optimal speed. Such corrections of train operating limits can be made automatically or by the operator, who always has ultimate control of the train.

In some cases, the model used in the optimization may differ significantly from the actual train. This can occur for many reasons, including, but not limited to, extra cargo pick-ups or setouts, locomotives that may become inoperable in route, and errors in the initial database 63 or data entry by the operator. For these reasons a monitoring system is in place that uses real-time train data to estimate locomotive and/or train parameters in real time 20. The estimated parameters are then compared to the assumed parameters used when the trip was initially created 22. Based on any differences in the assumed and estimated values, the trip may be re-planned 24, should large enough savings accrue from a new plan.

Other reasons a trip may be re-planned include directives from a remote location, such as dispatch, and/or the operator requesting a change in objectives to be consistent with more global movement planning objectives. Additional global movement planning objectives may include, but are not limited to, other train schedules, allowing exhaust to dissipate from a tunnel, maintenance operations, etc. Another reason may be due to an onboard degradation of a component. Strategies for re-planning may be grouped into incremental and major adjustments depending on the severity of the disruption, as discussed in more detail below. In general, a "new" plan must be derived from a solution to the optimization problem equation (OP) described above, but frequently faster approximate solutions can be found, as described herein.

Figure 8:
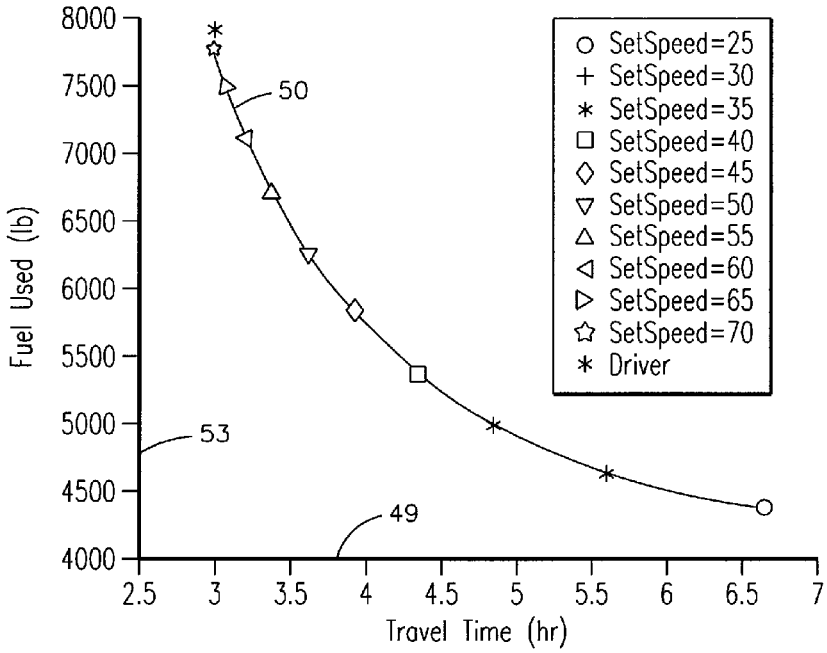
FIG. 8 depicts an exemplary embodiment of a fuel-use/travel time curve.

In operation, the locomotive 42 will continuously monitor system efficiency and continuously update the trip plan based on the actual efficiency measured, whenever such an update would improve trip performance. Re-planning computations may be carried out entirely within the locomotive(s) or fully or partially moved to a remote location, such as dispatch or wayside processing facilities where wireless technology is used to communicate the plans to the locomotive 42. In one embodiment, the trip optimizer system may also generate efficiency trends that can be used to develop locomotive fleet data regarding efficiency transfer functions. The fleet-wide data may be used when determining the initial trip plan, and may be used for network-wide optimization tradeoff when considering locations of a plurality of trains. For example, the travel-time fuel use tradeoff curve as illustrated in FIG. 8 as discussed in detail below, reflects a capability of a train on a particular route at a current time, updated from ensemble averages collected for many similar trains on the same route. Thus, a central dispatch facility collecting curves like FIG. 8 from many locomotives could use that information to better coordinate overall train movements to achieve a system-wide advantage in fuel use or throughput. As disclosed above, those skilled in the art will recognize that various fuel types, such as but not limited to diesel fuel, heavy marine fuels, palm oil, bio-diesel, etc. may be used.

Furthermore, as disclosed above, those skilled in the art will recognize that various energy storage devices may be used. For example, the amount of power withdrawn from a particular source, such as a diesel engine and batteries, could be optimized so that the maximum fuel efficiency/emission, which may be an objective function, is obtained. As further illustration, suppose the total power demand is 2000 horse power (HP), where the batteries can supply 1500 HP and the engine can supply 4400 HP. The optimum point could be when batteries are supplying 1200 HP and engine is supplying 200 HP.

Similarly, the amount of power may also be based on the amount of energy stored and the need for the energy in the future. For example, if there is a long high demand coming for power, the battery could be discharged at a slower rate. For example, if 1000 horsepower hour (HPhr) is stored in the battery and the demand is 4400 HP for the next 2 hours, it may be optimum to discharge the battery at 800 HP for the next 1.25 hours and take 3600 HP from the engine for that duration.

Many events in daily operations can lead to a need to generate or modify a currently executing plan, where it desired to keep the same trip objectives, for example when a train is not on schedule for a planned meet or pass with another train and it needs to make up time. Using the actual speed, power, and location of the locomotive, a comparison is made between a planned arrival time and the currently estimated (predicted) arrival time 25. Based on a difference in the times, as well as the difference in parameters (detected or changed by dispatch or the operator), the plan is adjusted 26. This adjustment may be made automatically according to a railroad company's desire for how such departures from plan should be handled, or alternatives may be manually proposed for the on-board operator and dispatcher to jointly decide the best way to get back on plan. Whenever a plan is updated, in the case where the original objectives (such as, but not limited to, arrival time) remain the same, additional changes may be factored in concurrently, e.g., new future speed limit changes, which could affect the feasibility of ever recovering the original plan. In such instances, if the original trip plan cannot be maintained, or in other words the train is unable to meet the original trip plan objectives, as discussed herein other trip plan(s) may be presented to the operator and/or remote facility, or dispatch.

A re-plan 24, or an adjustment to a plan 26, as illustrated in FIG. 1 may also be made when it is desired to change the original objectives. Such re-planning can be done at either fixed preplanned times, manually at the discretion of the operator or dispatcher, or autonomously when predefined limits, such as train operating limits, are exceeded. For example, if the current plan execution is running late by more than a specified threshold, such as thirty minutes, the exemplary embodiment of the present invention can re-plan the trip to accommodate the delay at the expense of increased fuel use, as described above, or to alert the operator and dispatcher how much of the time can be made up at all (e.g., what minimum time to go or the maximum fuel that can be saved within a time constraint). Other triggers for re-plan can also be envisioned based on fuel consumed or the health of the power consist, including but not limited time of arrival, loss of horsepower due to equipment degradation (such as operating too hot or too cold), and/or detection of gross setup errors, such as in the assumed train load. That is, if the change reflects impairment in the locomotive performance for the current trip, these may be factored into the models and/or equations used in the optimization.

Changes in plan objectives can also arise from a need to coordinate events where the plan for one train compromises the ability of another train to meet objectives and arbitration at a different level, e.g., the dispatch office, is required. For example, the coordination of meets and passes may be further optimized through train-to-train communications. Thus, as an example, if a train knows that it is behind schedule in reaching a location for a meet and/or pass, communications from the other train can notify the late train (and/or dispatch). The operator can then enter information pertaining to being late into the trip optimizer system, wherein the system will recalculate the train's trip plan.

The trip optimizer system can also be used at a high level, or network level, to allow a dispatch to determine which train should slow down or speed up should it be the case that a scheduled meet and/or pass time constraint may not be met. As discussed herein, this is accomplished by trains transmitting data to the dispatch to prioritize how each train should change its planning objective. A choice could be based on either schedule, fuel saving benefits and/or emission output, depending on the situation.

Therefore, as explained herein, a re-plan 24 or adjustment to a plan 26, as illustrated in FIG. 1, may be carried out either independent of dispatch or in coordination with dispatch. Furthermore, as disclosed herein, a re-plan may be initiated, in whole or in part, based on information received at the powered system from dispatch or on information that originates from other sources, such as, but not limited to another powered system passing nearby and/or a wayside device or equipment.

With respect to a train 31, one example relates to a situation where dispatch 60 determines that a train operator has entered incorrect information for optimizing a mission plan. In this example, when information is entered by the operator, such as, but not limited to, through a control counsel and/or display 68, for generating an optimized trip plan, the information is transmitted to dispatch 60, which is remote from the train. A wired and/or wireless communication system 47 is used for communicating with dispatch 60. Dispatch verifies the information. Dispatch may be an individual at a remote location or a remote system having a processor that is able to determine if the information provided is correct for the intended mission. If the information is incorrect, the trip/mission plan originally generated using the incorrect information may be adjusted, re-planned, or otherwise revised using new, correct, and/or corrected information (collectively, updated information). The source of this second information may come from the dispatch and/or any other system that may provide information updates to the train. Verification and, if required, re-plan may occur prior to commencing the mission, and/or while the mission is progressing.

Changes to the optimized mission plan may also be made when updated information has a bearing on the currently implemented mission. One example of when such updated information may be used includes, but is not limited to, when the train is performing other than as contemplated with a current mission plan, e.g., the train's performance degrades at some point while an original mission plan is being followed. The change in performance may also be attributed to degraded operation capability of a rail infrastructure (or route infrastructure), crew change, time-out, if the operator decides to manually operate the train and then returns control for autonomous operation, etc. In another example, updated information is received from at least one of another train, such as through inter-train communication, a wayside device, and/or another localized source. The information may be transferred train-to-train when the transmitting train has the needed information. This information can include, but is not limited to, information learned based on track that the transmitting train has recently traversed and/or information relayed to the transmitting train when it was in communication with dispatch for transmitting to other trains that are unable to communicate with dispatch due to a communication interruption. In yet another example, such updated information may include a change in the mission objective, e.g., the train is reclassified from a high priority level to a low priority level. Where the train is operating with other trains (such as, but not limited to, on multi-section tracks in an intersecting railroad network), the updated information may provide for further optimizing the particular train's mission to insure that all trains using the same network of railways are operated safely and where no prolonged delays to any trains are realized, such as having to wait too long at a meet and pass location.

Re-planning may be performed on board the train, even when dispatch is unaware of the information that causes the re-planning to take place. In such a situation, dispatch is subsequently informed of the re-plan.

Figure 3:
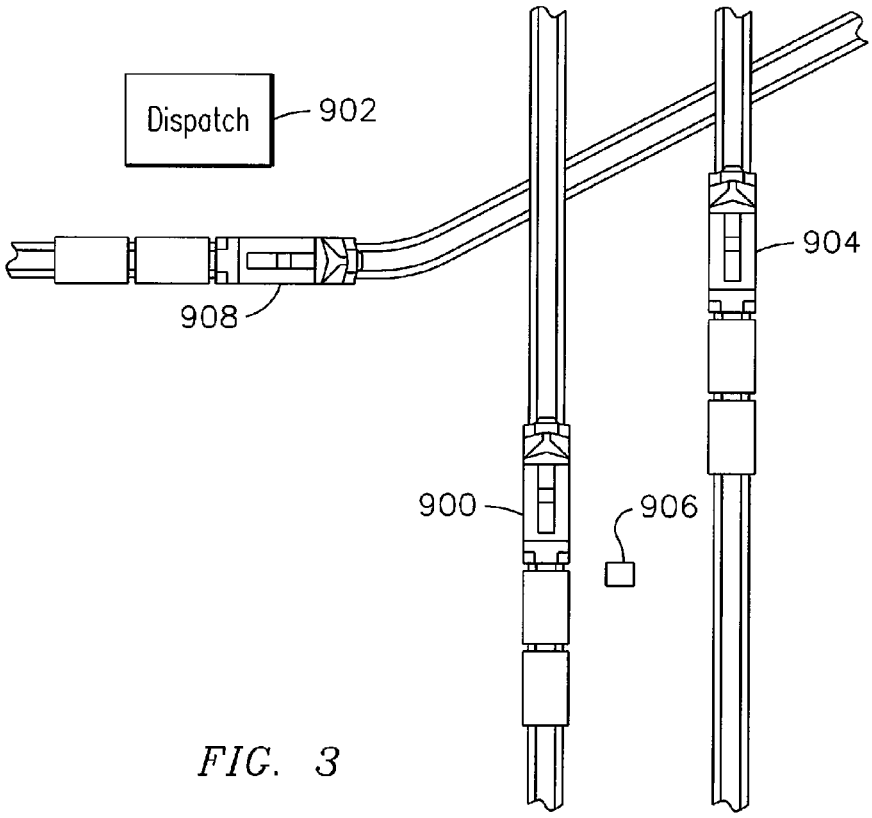
FIG. 3 depicts a diagram illustrating a top view of a railway system with a plurality of trains operating.

FIG. 3 depicts a diagram illustrating a top view of a railway system with a plurality of trains operating in the system. As disclosed herein, a first train 900 may receive updated mission optimization information from a remote facility 902, such as but not limited to dispatch. The first train 900 may also receive updated mission optimization information from another train 904 and/or a wayside device 906. Communication between the trains 900, 904 may be two-way; therefore, not only is the first train 900 receiving updated optimization information, the first train 900 may also provide updated optimization information to a second train 904, or provide updated optimization information back to the remote facility 902. In a similar manner, the first train 900 may also provide information to the wayside device 906 which can then pass it along to the second train 904 when the second train 904 is in range of the wayside device 906. A plurality of trains may be used. As illustrated, a third train 908 is also disclosed. Depending on the mission objective, the updated mission information may be used to meet a mission objective.

The mission objective may be based on at least one of a plurality of factors, such as, but not limited to, fuel usage, emission output, mission time, speed, arrival time at a destination or any intermediate point, such as, but not limited to, a meet/pass location, train type (such as whether a passenger train, cargo train, and/or coal train), train symbol (which is used to identify a type of train), arrival/departure/in-route stations, train classification, and/or whether the train is a distributed power train or a conventional train. Those skilled in the art will recognize that a train symbol identifies a type of train and at least a partial amount of information is associated with the train symbol.

Figure 4:
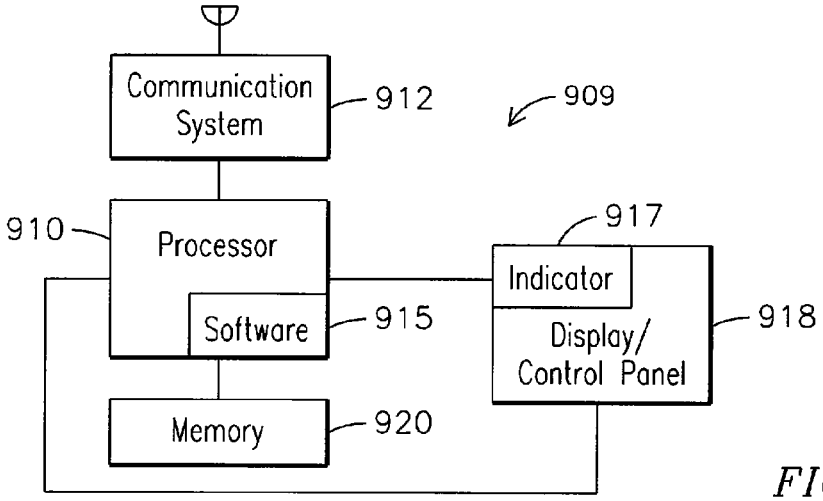
FIG. 4 depicts a block diagram illustrating a system for providing current information for use in establishing a mission plan.

FIG. 4 depicts a block diagram illustrating a system for providing current information for use in establishing a mission plan, and for operating a powered system based on the mission plan. As illustrated, the system 909 has a processor 910 that determines whether a mission plan is correct to satisfy at least one mission objective of the mission plan. The processor is configured to perform the methods disclosed below in FIGS. 5 and 6. A communication system 912 receives information from a remote location, wherein the information received is used to update the mission plan. The remote location may be a plurality of locations, such as, but not limited to, a remote facility 902, a remote train 904, 909, or powered system, and/or a wayside device 906, as illustrated in FIG. 3. Computer-readable instructions 915, or an algorithm or software, that when executed by the processor 910, cause the processor 910 to update or revise the mission plan based on the updated information received from the remote location(s). The powered system is subsequently controlled based on the updated/revised mission plan. (As should be appreciated, "update," "revise," "re-plan," and "correct" are used synonymously herein unless otherwise specified.)

In an exemplary embodiment, updating the mission plan as disclosed herein is performed autonomously in a closed-loop process. An indicator 917, such as, but not limited to, a display or some other notifying device, notifies the operator when the mission plan needs updating and/or has been updated. In another example, the operator may have an ability to provide input, more specifically an ability to allow the mission update to take place, such as, but not limited to, commanding the processor. Those skilled in the art will readily recognize that in this example the indicator may be part of a control panel 918 that is provided for the operator to interact with the system. A memory device 920, or other data storage device, is also provided to store updated information received from the remote location 902, 904, 906, 908.

Figure 5:
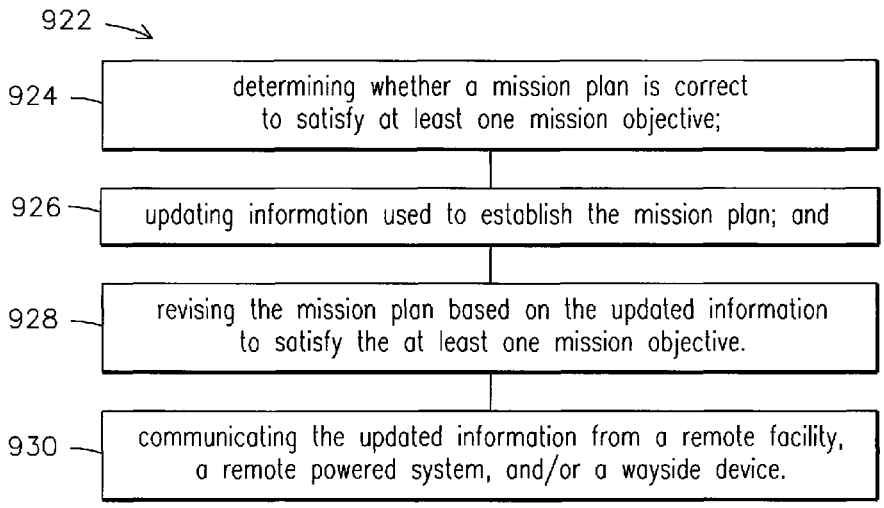
FIG. 5 depicts a flowchart illustrating an exemplary embodiment of a method for real time optimization of at least one mission objective of an optimized mission.

FIG. 5 depicts a flowchart 922 illustrating an exemplary embodiment of a method for real time optimization of at least one mission objective of an optimized mission, and for controlling a powered system based on a mission plan. As disclosed below with respect to a processor 44 provided in FIG. 7, the method is performed with a uniquely configured processor. As illustrated, a determination is made whether the optimized mission plan is correct to satisfy at least one mission objective, at 924. This determination may be made repeatedly, or recurrently, either initiated by an exception (by which it is meant a triggering event or condition), based on a schedule, and/or a combination of the two.

The exception may include, but is not limited to, if a larger than expected change is realized with respect to an arrival time, fuel used, travel time, speed, etc. For example, the exception is identified if the arrival time is going to be later than a pre-set window. In other words, if the arrival time is a few minutes later than planned, this may not trigger the exception, but if the arrival time is longer than fifteen or thirty minutes, the exception may be triggered. Another exception may be based on a change in train priority or another train's priority. For example, if another train with a higher priority is occupying the same track, the optimized mission plan may be changed to accommodate this higher priority train. Similarly, if the priority of a train changes, the mission plan may be changed to reflect the changed priority. Another exception may be based on a manual input from the operator. Yet another exception may be due to degraded operation of the train, degraded operation of at least another train using the same network of tracks, degraded operation capability of the rail infrastructure, a crew change, time-out, etc. Another exception may be based on a comparison of fuel versus time solely based on partial/incomplete data. For example, if using train symbols, all information about a train is not available. Additionally, the partial/incomplete data may be associated with a slow change order that deviates from the initial information provided prior to the start of the mission.

The determination of whether the optimized mission plan is correct to satisfy at least one mission objective may be made prior to beginning the mission and/or during the mission. If the at least one mission objective is not being met, updated mission information is provided to the powered system, at 926, to revise, update, or correct the current mission plan, at 928. The revision may be performed to satisfy the at least one mission objective. The updated mission information may be provided on a set schedule and/or when a determination is made that the mission objective is not satisfied, or is being met. The updated information may be communicated from a remote facility, a remote powered system, and/or a wayside device, at 930. A new mission plan (i.e., revised/updated mission plan) is established which will satisfy the at least one current mission objective. As disclosed herein, the mission objective may be associated with reducing fuel use and/or improved emission output. The method shown in flowchart 922 may also be implemented with a computer readable media that is operable with a processor.

Figure 6:
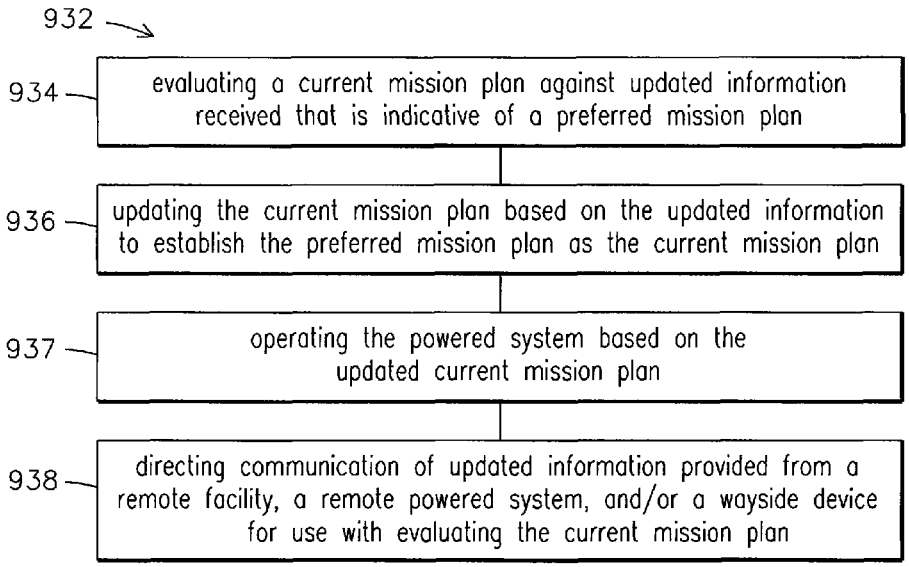
FIG. 6 depicts another flowchart illustrating an exemplary embodiment of a method for real time optimization of at least one mission objective of an optimized mission.

FIG. 6 depicts another flowchart 932 illustrating an exemplary embodiment of a method for determining whether a mission plan is correct to satisfy a mission objective of the mission plan. As disclosed below with respect to the processor 44 provided in FIG. 7, the method is performed with a uniquely configured processor. In the method, a current mission plan is evaluated against received, updated information that is indicative of a preferred mission plan, at 934. As disclosed above, the updated information may be based on an exception. The current mission plan is updated based on the updated information, wherein the updated mission plan is established as the current mission plan, at 936. (In other words, the current mission plan is revised based on updated information, resulting in an updated mission plan. The updated mission plan is then used to control the powered system (e.g., train), and as such becomes the new current mission plan of the powered system.) Evaluating and changing the current mission plan may occur prior to beginning a mission and/or during the mission. Therefore, a change to the mission plan may occur prior to beginning the mission and/or during the mission. Communication of updated information is directed from a remote facility, a remote powered system, and/or a wayside device for use with evaluating the current mission plan, at 938. The method shown in flowchart 932 may also be implemented with a computer readable media that is operable with a processor.

Figure 9:
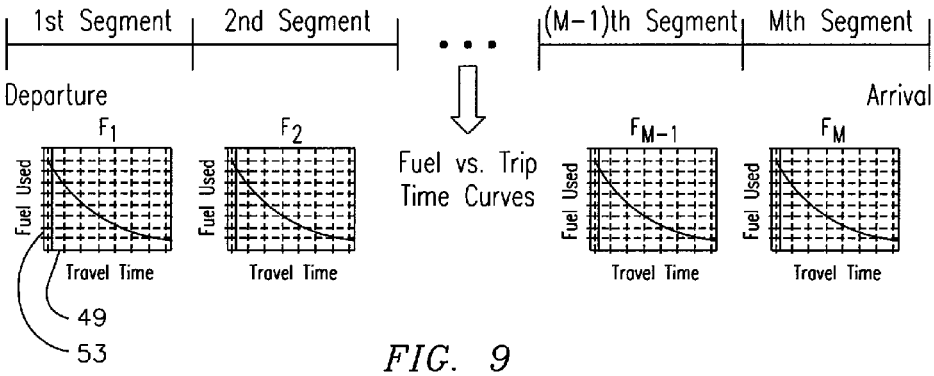
FIG. 9 depicts an exemplary embodiment of a segmentation decomposition for trip planning.

For any of the manually or automatically initiated re-plans, exemplary embodiments of the present invention may present more than one trip/mission plan to the operator. In an exemplary embodiment, the trip optimizer system presents different profiles to the operator, allowing the operator to select the arrival time and understand the corresponding fuel and/or emission impact. Such information can also be provided to the dispatch for similar consideration, either as a simple list of alternatives or as a plurality of tradeoff curves such as illustrated in FIG. 9.

The trip optimizer system has the ability to learn and adapted to key changes in the train and power consist, which can be incorporated either in the current plan and/or in future plans. For example, one of the triggers discussed above is loss of horsepower. When building up horsepower over time, either after a loss of horsepower or when beginning a trip, transition logic is utilized to determine when desired horsepower is achieved. This information can be saved in the locomotive database 61 for use in optimizing either future trips or the current trip should loss of horsepower occur again.

Likewise, in a similar fashion where multiple thrusters are available, each may need to be independently controlled. For example, a marine vessel may have many force producing elements, or thrusters, such as but not limited to propellers. Each propeller may need to be independently controlled to produce the optimum output. Therefore, utilizing transition logic, the trip optimizer system may determine which propeller to operate based on what has been learned previously and by adapting to key changes in the marine vessel's operation.

As noted above, FIG. 7 depicts various elements that may part of an exemplary trip optimizer system, according to an embodiment of the invention. A locator element 30 to determine a location of the train 31 is provided. The locator element 30 can be a GPS sensor, or a system of sensors, that determines a location of the train 31. Examples of such other systems include, but are not limited to, wayside devices, such as radio frequency automatic equipment identification (RF AEI) tags, dispatch, and/or video determination. Another system may include the tachometer(s) aboard a locomotive and distance calculations from a reference point. As discussed previously, a wireless communication system 47 may also be provided to allow for communications between trains and/or with a remote location, such as dispatch 60. Information about travel locations may also be transferred from other trains.

A track characterization element 33, which provides information about a track, principally grade and elevation and curvature information, is also provided. The track characterization element 33 may include an on-board track integrity database 36. Sensors 38 are used to measure a tractive effort 40 being hauled by the locomotive 42, throttle setting of the locomotive consist 42, locomotive consist 42 configuration information, speed of the locomotive consist 42, individual locomotive configuration, individual locomotive capability, etc. In an exemplary embodiment, the locomotive consist 42 configuration information may be loaded without the use of a sensor 38, but is input in other manners as discussed above. Furthermore, the health of the locomotives in the consist may also be considered. For example, if one locomotive in the consist is unable to operate above power notch level 5, this information is used when optimizing the trip plan.

Information from the locator element may also be used to determine an appropriate arrival time of the train 31. For example, if there is a train 31 moving along a track 34 towards a destination and no train is following behind it, and the train has no fixed arrival deadline to adhere to, the locator element, including, but not limited to, RF AEI tags, dispatch, and/or video determination, may be used to gage the exact location of the train 31. Furthermore, inputs from these signaling systems may be used to adjust the train speed. Using the on-board track database, discussed below, and the locator element, such as GPS, the trip optimizer system can adjust the operator interface to reflect the signaling system state at the given locomotive location. In a situation where signal states would indicate restrictive speeds ahead, the planner may elect to slow the train to conserve fuel consumption.

Information from the locator element 30 may also be used to change planning objectives as a function of distance to destination. For example, owing to inevitable uncertainties about congestion along the route, "faster" time objectives on the early part of a route may be employed as a hedge against delays that statistically occur later. If it happens on a particular trip that delays do not occur, the objectives on a latter part of the journey can be modified to exploit the built-in slack time that was banked earlier, and thereby recover some fuel efficiency. A similar strategy could be invoked with respect to emissions restrictive objectives, e.g., approaching an urban area.

As an example of the hedging strategy, if a trip is planned from New York to Chicago, the system may have an option to operate the train slower at either the beginning of the trip or at the middle of the trip or at the end of the trip. In one embodiment, the trip optimizer system would optimize the trip plan to allow for slower operation at the end of the trip since unknown constraints, such as, but not limited to, weather conditions and track maintenance, may develop and become known during the trip. As another consideration, if traditionally congested areas are known, the plan is developed with an option to have more flexibility around these traditionally congested regions. Therefore, the trip optimizer system may also consider weighting/penalty as a function of time/distance into the future and/or based on known/past experience. At any time during the trip, planning and re-planning may also take into consideration weather conditions, track conditions, other trains on the track, etc., wherein the trip plan is adjust accordingly.

FIG. 7 further discloses other elements that may be part of the trip optimizer system. A processor 44 is provided that is operable to receive information from the locator element 30, track characterization element 33, and sensors 38. Those skilled in the art will readily recognize that the processor 44 is more than a general/generic processor since it is uniquely configured to perform the methods disclosed herein and/or is further configured to withstand environmental conditions realized with respect to the powered system. The unique configuration includes input and output processes/hardware that are sufficient to ensure the processor is a robust/reliable element. Furthermore the processor may be uniquely designed to operate within environmental conditions experienced by the powered system. Furthermore, those skilled in the art will further recognize that the processor performs more than the functions disclosed with respect to exemplary embodiments of the invention.

An algorithm 46 operates within the processor 44. The algorithm 46 is used to compute an optimized trip/mission plan based on parameters involving the locomotive 42, train 31, track 34, and objectives of the mission as described above. In an exemplary embodiment, the trip plan is established based on models for train behavior as the train 31 moves along the track 34 as a solution of non-linear differential equations derived from physics with simplifying assumptions that are provided in the algorithm. The algorithm 46 has access to the information from the locator element 30, track characterizing element 33, and/or sensors 38 to create a trip plan minimizing fuel consumption of a locomotive consist 42, minimizing emissions of a locomotive consist 42, establishing a desired trip time, and/or ensuring proper crew operating time aboard the locomotive consist 42. In an exemplary embodiment, a controller element 51 (and/or driver or operator) is also provided. As discussed herein, the controller element 51 is used for controlling the train as it follows the trip plan. In an exemplary embodiment discussed further herein, the controller element 51 makes train operation decisions autonomously. In another exemplary embodiment, the operator may be involved with directing the train to follow the trip plan.

A feature of an exemplary embodiment of the trip optimizer system is the ability to initially create and quickly modify "on the fly" any plan that is being executed. This includes creating the initial plan when a long distance is involved, owing to the complexity of the plan optimization algorithm. When a total length of a trip profile exceeds a given distance, an algorithm 46 may be used to segment the mission, wherein the mission may be divided by waypoints. Though only a single algorithm 46 is discussed, those skilled in the art will readily recognize that more than one algorithm may be used (and/or that the same algorithm may be executed a plurality of times) where the algorithms may be connected together. The waypoints may include natural locations where the train 31 stops, such as, but not limited to, sidings where a meet with opposing traffic (or pass with a train behind the current train) is scheduled to occur on a single-track rail, or at yard sidings or industry where cars are to be picked up and set out, and locations of planned work. At such waypoints, the train 31 may be required to be at the location at a scheduled time and be stopped or moving with speed in a specified range. The time duration from arrival to departure at waypoints is called "dwell time."

In an exemplary embodiment, the trip optimizer system is able to break down a longer trip into smaller segments in a special systematic way. Each segment can be somewhat arbitrary in length, but is typically picked at a natural location such as a stop or significant speed restriction, or at key mileposts that define junctions with other routes. Given a partition, or segment, selected in this way, a driving profile is created for each segment of track as a function of travel time taken as an independent variable, such as shown in FIG. 8. The fuel used/travel-time tradeoff associated with each segment can be computed prior to the train 31 reaching that segment of track. A total trip plan can be created from the driving profiles created for each segment. The exemplary embodiment of the invention distributes travel time amongst all the segments of the trip in an optimal way so that the total trip time required is satisfied and total fuel consumed over all the segments is as small as possible. An exemplary three-segment trip is disclosed in FIG. 10 and discussed below. Those skilled in the art will recognize, however, that although segments are discussed, the trip plan may comprise a single segment representing the complete trip.

FIG. 8 depicts an exemplary embodiment of a fuel-use/travel time curve 50. As mentioned previously, such a curve 50 is created when calculating an optimal trip profile for various travel times for each segment. That is, for a given travel time 49, fuel used 53 is the result of a detailed driving profile computed as described above. Once travel times for each segment are allocated, a power/speed plan is determined for each segment from the previously computed solutions. If there are any waypoint constraints on speed between the segments, such as, but not limited to, a change in a speed limit, they are matched up during creation of the optimal trip profile. If speed restrictions change in only a single segment, the fuel use/travel-time curve 50 has to be re-computed for only the segment changed. This reduces time for having to re-calculate more parts, or segments, of the trip. If the locomotive consist or train changes significantly along the route, e.g., from loss of a locomotive or pickup or set-out of cars, then driving profiles for all subsequent segments must be recomputed, thereby creating new instances of the curve 50. These new curves 50 would then be used along with new schedule objectives to plan the remaining trip.

Once a trip plan is created as discussed above, a trajectory of speed and power versus distance is used to reach a destination with minimum fuel use and/or emissions at the required trip time. There are several ways in which to execute the trip plan. As provided below in more detail, in an exemplary embodiment, when in an operator "coaching" mode, information is displayed to the operator for the operator to follow to achieve the required power and speed determined according to the optimal trip plan. In this mode, the operating information includes suggested operating conditions that the operator should use. In another exemplary embodiment, acceleration and maintaining a constant speed are autonomously performed. However, when the train 31 must be slowed, the operator is responsible for applying a braking system 52. In another exemplary embodiment, commands for powering and braking are provided as required to follow the desired speed-distance path.

Feedback control strategies are used to provide corrections to the power control sequence in the profile to correct for events such as, but not limited to, train load variations caused by fluctuating head winds and/or tail winds. Another such error may be caused by an error in train parameters, such as, but not limited to, train mass and/or drag, when compared to assumptions in the optimized trip plan. A third type of error may occur with information contained in the track database 36. Another possible error may involve un-modeled performance differences due to the locomotive engine, traction motor thermal deration, and/or other factors. Feedback control strategies compare the actual speed as a function of position to the speed in the desired optimal profile. Based on this difference, a correction to the optimal power profile is added to drive the actual velocity toward the optimal profile. To assure stable regulation, a compensation algorithm may be provided which filters the feedback speeds into power corrections so that closed-performance stability is assured. Compensation may include standard dynamic compensation as used by those skilled in the art of control system design to meet performance objectives.

The trip optimizer system provides the simplest and therefore fastest means to accommodate changes in trip objectives, which is the rule, rather than the exception in railroad operations. In an exemplary embodiment, to determine the fuel-optimal trip from point "A" to point "B" where there are stops along the way, and for updating the trip for the remainder of the trip once the trip has begun, a sub-optimal decomposition method is usable for finding an optimal trip profile. Using modeling methods, the computation method can find the trip plan with specified travel time and initial and final speeds, so as to satisfy all the speed limits and locomotive capability constraints when there are stops. Though the following discussion is directed towards optimizing fuel use, it can also be applied to optimize other factors, such as, but not limited to, emissions, schedule, crew comfort, and load impact. The method may be used at the outset in developing a trip plan, and more importantly to adapting to changes in objectives after initiating a trip.

Figure 10:
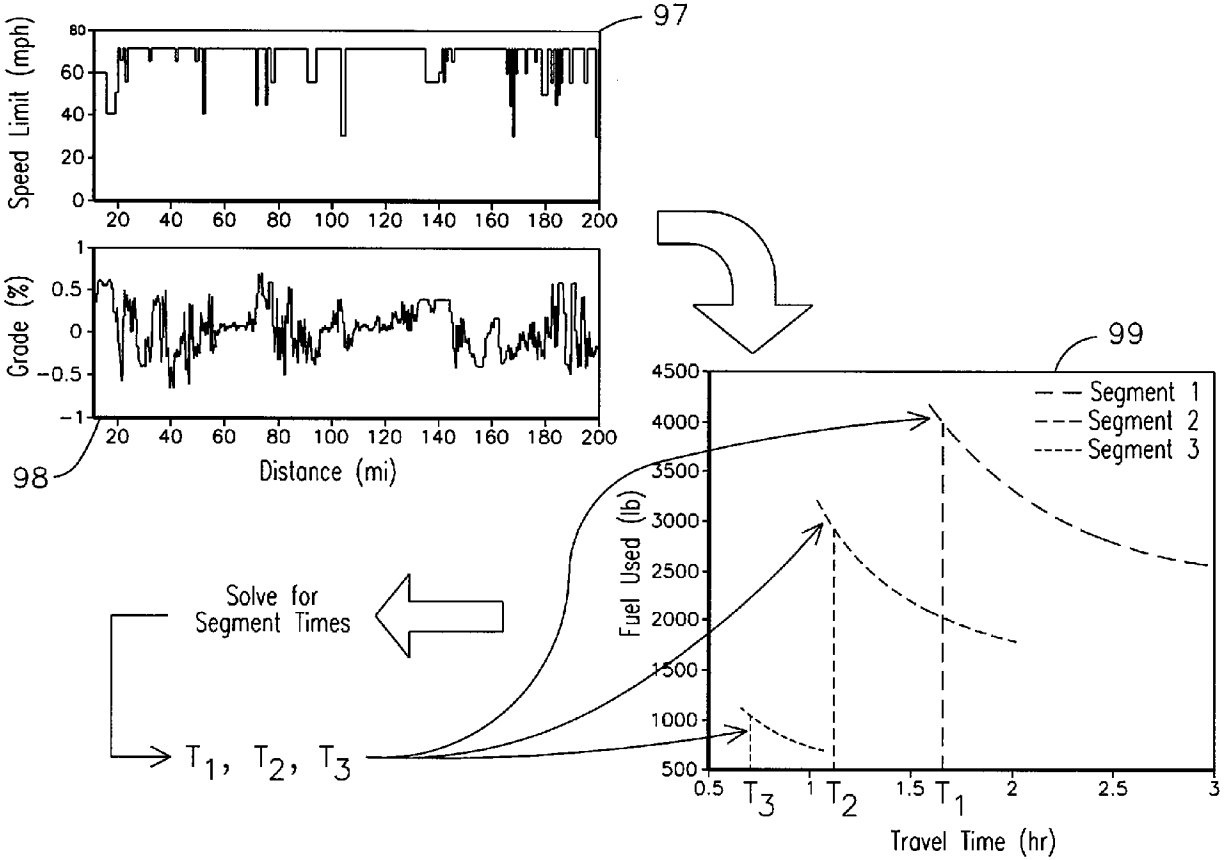
FIG. 10 depicts another exemplary embodiment of a segmentation decomposition for trip planning.

As discussed herein, exemplary embodiments of the present invention may employ a setup as illustrated in the exemplary flow chart depicted in FIG. 9, and as an exemplary three-segment example depicted in detail in FIG. 10. As illustrated, the trip may be broken into two or more segments, T1, T2, and T3. (As noted above, it is possible to consider the trip as a single segment.) As discussed herein, the segment boundaries may not result in equal segments. Instead, the segments may use natural or mission specific boundaries. Optimal trip plans are pre-computed for each segment. If fuel use versus trip time is the trip object to be met, fuel versus trip time curves are built for each segment. As discussed herein, the curves may be based on other factors, wherein the factors are objectives to be met with a trip plan. When trip time is the parameter being determined, trip time for each segment is computed while satisfying the overall trip time constraints. FIG. 10 illustrates speed limits 97 for an exemplary three-segment, 200-mile (321.9 kilometers) trip. Further illustrated are grade changes 98 over the 200-mile (321.9 kilometers) trip. A combined chart 99 illustrating curves for each segment of the trip of fuel used over the travel time is also shown.

Using the optimal control setup described previously and the computation methods described herein, the trip optimizer system can generate the trip plan with specified travel time and initial and final speeds, so as to satisfy all the speed limits and locomotive capability constraints when there are stops. Though the following detailed discussion is directed towards optimizing fuel use, it can also be applied to optimize other factors as discussed herein, such as, but not limited to, emissions. A key flexibility is to accommodate desired dwell time at stops and to consider constraints on earliest arrival and departure at a location as may be required, for example, in single-track operations where the time to be in or get by a siding is critical.

Exemplary embodiments of the present invention find a fuel-optimal trip from distance $D_0$ to $D_M$, traveled in time T, with M−1 intermediate stops at $D_1, \ldots, D_{M-1}$, and with the arrival and departure times at these stops constrained by:

$$t_{min}(i) \le t_{arr}(D_i) \le t_{max}(i) - \Delta t_i$$

$$t_{arr}(D_i) + \Delta t_i \le t_{dep}(D_i) \le t_{max}(i) \quad i = 1, \ldots, M-1$$

where $t_{arr}(D_i)$, $t_{dep}(D_i)$, and $\Delta t_i$ are the arrival, departure, and minimum stop time at the $i^{th}$ stop, respectively. Assuming that fuel-optimality implies minimizing stop time, therefore $t_{dep}(D_i) = t_{arr}(D_i) + \Delta t_i$ which eliminates the second inequality above. Suppose for each i=1, . . . , M, the fuel-optimal trip from $D_{i-1}$ to $D_i$ for travel time t, $T_{min}(i) \le t \le T_{max}(i)$, is known.

Let $F_i(t)$ be the fuel-use corresponding to this trip. If the travel time from $D_{j-1}$ to $D_j$ is denoted $T_j$, then the arrival time at $D_i$ is given by:

$$t_{arr}(D_i) = \sum_{j=1}^{i} (T_j + \Delta t_{j-1})$$

where $\Delta t_0$ is defined to be zero. The fuel-optimal trip from $D_0$ to $D_M$ for travel time T is then obtained by finding $T_i$, i=1, . . . , M, which minimize $$\sum_{i=1}^{M} F_i(T_i) T_{min}(i) \le T_i \le T_{max}(i)$$

subject to:

$$t_{min}(i) \le \sum_{j=1}^{i} (T_j + \Delta t_{j-1}) \le t_{max}(i) - \Delta t_i \quad i = 1, \ldots, M-1$$

$$\sum_{j=1}^{M} (T_j + \Delta t_{j-1}) = T$$

Once a trip is underway, the issue is re-determining the fuel-optimal solution for the remainder of a trip (originally from $D_0$ to $D_M$ in time T) as the trip is traveled, but where disturbances preclude following the fuel-optimal solution. Let the current distance and speed be x and v, respectively, where $D_{i-1}<x\le D_i$. Also, let the current time since the beginning of the trip be tact. Then the fuel-optimal solution for the remainder of the trip from x to $D_M$, which retains the original arrival time at $D_M$, is obtained by finding $\tilde{T}_i$, $T_j$, j=i+1, . . . M, which minimize:

$$\tilde{F}_i(\tilde{T}_i, x, v) + \sum_{j=i+1}^{M} F_j(T_j)$$

subject to:

$$t_{min}(i) \le t_{act} + \tilde{T}_i \le t_{max}(i) - \Delta t_i$$

$$t_{min}(k) \le t_{act} + \tilde{T}_i + \sum_{j=i+1}^{k} (T_j + \Delta t_{j-1}) \le t_{max}(k) - \Delta t_k$$

$$k = i+1, \ldots, M-1$$

$$t_{act} + \tilde{T}_i + \sum_{j=i+1}^{M} (T_j + \Delta t_{j-1}) = T$$

Here, $\tilde{F}_i(t, x, v)$ is the fuel-used of the optimal trip from x to $D_i$, traveled in time t, with initial speed at x of v.

As discussed above, an exemplary way to enable more efficient re-planning is to construct the optimal solution for a stop-to-stop trip from partitioned segments. For the trip from $D_{i-1}$ to $D_i$, with travel time T1, choose a set of intermediate points $D_{ij}$, j=1, . . . , $N_i-1$. Let $D_{i0}=D_{i-1}$ and $D_{iN}=D_i$. Then express the fuel-use for the optimal trip from $D_{i-1}$ to $D_i$ as:

$$F_i(t) = \sum_{j=1}^{N_i} f_{ij}(t_{ij} - t_{i,j-1}, v_{i,j-1}, v_{ij})$$

where $f_{ij}(t, v_{i,j-1}, v_{ij})$ is the fuel-use for the optimal trip from $D_{i,j-1}$ to $D_{ij}$, traveled in time t, with initial and final speeds of $v_{i,j-1}$ and $v_{ij}$. Furthermore, $t_{ij}$ is the time in the optimal trip corresponding to distance $D_{ij}$. By definition, $t_{iN_i}-t_{i0}=T_i$. Since the train is stopped at $D_{i0}$ and $D_{iN_i}$, $v_{i0}=v_{iN_i}=0$.

The above expression enables the function $F_i(t)$ to be alternatively determined by first determining the functions $f_{ij}(\bullet)$, $1\le j\le N_i$, then finding $\tau_{ij}$, $1\le j\le N_i$ and $v_{ij}$, $1\le j\le N_i$, which minimize:

$$F_i(t) = \sum_{j=1}^{N_i} f_{ij}(\tau_{ij}, v_{i,j-1}, v_{ij})$$

subject to:

$$\sum_{j=1}^{N_i} \tau_{ij} = T_i$$

$$v_{min}(i, j) \le v_{ij} \le v_{max}(i, j) \quad j = 1, \ldots, N_i - 1$$

$$v_{i0} = v_{iN_i} = 0$$

By choosing $D_{ij}$ (e.g., at speed restrictions or meeting points), $v_{max}(i,j)-v_{min}(i,j)$ can be minimized, thus minimizing the domain over which $f_{ij}(\ )$ needs to be known.

Based on the partitioning above, a simpler suboptimal re-planning approach than that described above is to restrict re-planning to times when the train is at distance points $D_{ij}$, $1\le i\le M$, $1\le j\le N_i$. At point $D_{ij}$, the new optimal trip from $D_{ij}$ to $D_M$ can be determined by finding $\tau_{ik}$, $j\le k\le N_i$, $v_{ik}$, $j<k<N_i$, and $\tau_{mn}$, $i<m\le M$, $1\le n\le N_m$, $v_{mn}$, $i<m\le M$, $1\le n\le N_m$ which minimize:

$$\sum_{k=j+1}^{N_i} f_{ik}(\tau_{ik}, v_{i,k-1}, v_{ik}) + \sum_{m=i+1}^{M} \sum_{n=1}^{N_m} f_{mn}(\tau_{mn}, v_{m,n-1}, v_{mn})$$

subject to:

$$t_{min}(i) \le t_{act} + \sum_{k=j+1}^{N_i} \tau_{ik} \le t_{max}(i) - \Delta t_i$$

$$t_{min}(n) \le t_{act} + \sum_{k=j+1}^{N_i} \tau_{ik} + \sum_{m=i+1}^{n} (T_m + \Delta t_{m-1}) \le t_{max}(n) - \Delta t_n$$

$$n = i+1, \ldots, M-1$$

$$t_{act} + \sum_{k=j+1}^{N_i} \tau_{ik} + \sum_{m=i+1}^{M} (T_m + \Delta t_{m-1}) = T$$

where:

$$T_m = \sum_{n=1}^{N_m} \tau_{mn}$$

A further simplification is obtained by waiting on the re-computation of $T_m$, $i<m\leq M$, until distance point $D_i$ is reached. In this way, at points D between $D_{i-1}$ and $D_i$, the minimization above needs only be performed over $\tau_{ik}$, $j<k\leq N_i$, $v_{ik}$, $j<k<N_i$. $T_i$ is increased as needed to accommodate any longer actual travel time from $D_{i-1}$ to $D_{ij}$ than planned. This increase is later compensated, if possible, by the re-computation of $T_m$, $i<m\leq M$, at distance point $D_i$.

With respect to the closed-loop configuration disclosed above, the total input energy required to move a train 31 from point A to point B consists of the sum of four components, specifically, difference in kinetic energy between points A and B; difference in potential energy between points A and B; energy loss due to friction and other drag losses; and energy dissipated by the application of brakes. Assuming the start and end speeds to be equal (e.g., stationary), the first component is zero. Furthermore, the second component is independent of driving strategy. Thus, it suffices to minimize the sum of the last two components.

Following a constant speed profile minimizes drag loss. Following a constant speed profile also minimizes total energy input when braking is not needed to maintain constant speed. However, if braking is required to maintain constant speed, applying braking just to maintain constant speed will most likely increase total required energy because of the need to replenish the energy dissipated by the brakes. A possibility exists that some braking may actually reduce total energy usage if the additional brake loss is more than offset by the resultant decrease in drag loss caused by braking, by reducing speed variation.

After completing a re-plan from the collection of events described above, the new optimal notch/speed plan can be followed using the closed loop control described herein. However, in some situations there may not be enough time to carry out the segment decomposed planning described above, and particularly when there are critical speed restrictions that must be respected, an alternative is needed. Exemplary embodiments of the present invention accomplish this with an algorithm referred to as "smart cruise control." The smart cruise control algorithm is an efficient way to generate, on the fly, an energy-efficient (hence fuel-efficient) sub-optimal prescription for driving the train 31 over a known terrain. This algorithm assumes knowledge of the position of the train 31 along the track 34 at all times, as well as knowledge of the grade and curvature of the track versus position. The method relies on a point-mass model for the motion of the train 31, whose parameters may be adaptively estimated from online measurements of train motion as described earlier.

The smart cruise control algorithm has three principal components, specifically, a modified speed limit profile that serves as an energy-efficient (and/or emissions efficient or any other objective function) guide around speed limit reductions; an ideal throttle or dynamic brake setting profile that attempts to balance between minimizing speed variation and braking; and a mechanism for combining the latter two components to produce a notch command, employing a speed feedback loop to compensate for mismatches of modeled parameters when compared to reality parameters. Smart cruise control can accommodate strategies in exemplary embodiments of the present invention that do no active braking (e.g., the driver is signaled and assumed to provide the requisite braking) or a variant that does active braking.

With respect to the cruise control algorithm that does not control dynamic braking, the four exemplary components are a modified speed limit profile that serves as an energy-efficient guide around speed limit reductions, a notification signal directed to notify the operator when braking should be applied, an ideal throttle profile that attempts to balance between minimizing speed variations and notifying the operator to apply braking, a mechanism employing a feedback loop to compensate for mismatches of model parameters to reality parameters.

Also included in exemplary embodiments of the trip optimizer system is an approach to identify key parameter values of the train 31. For example, with respect to estimating train mass, a Kalman filter and a recursive least-squares approach may be utilized to detect errors that may develop over time.

Figure 11:
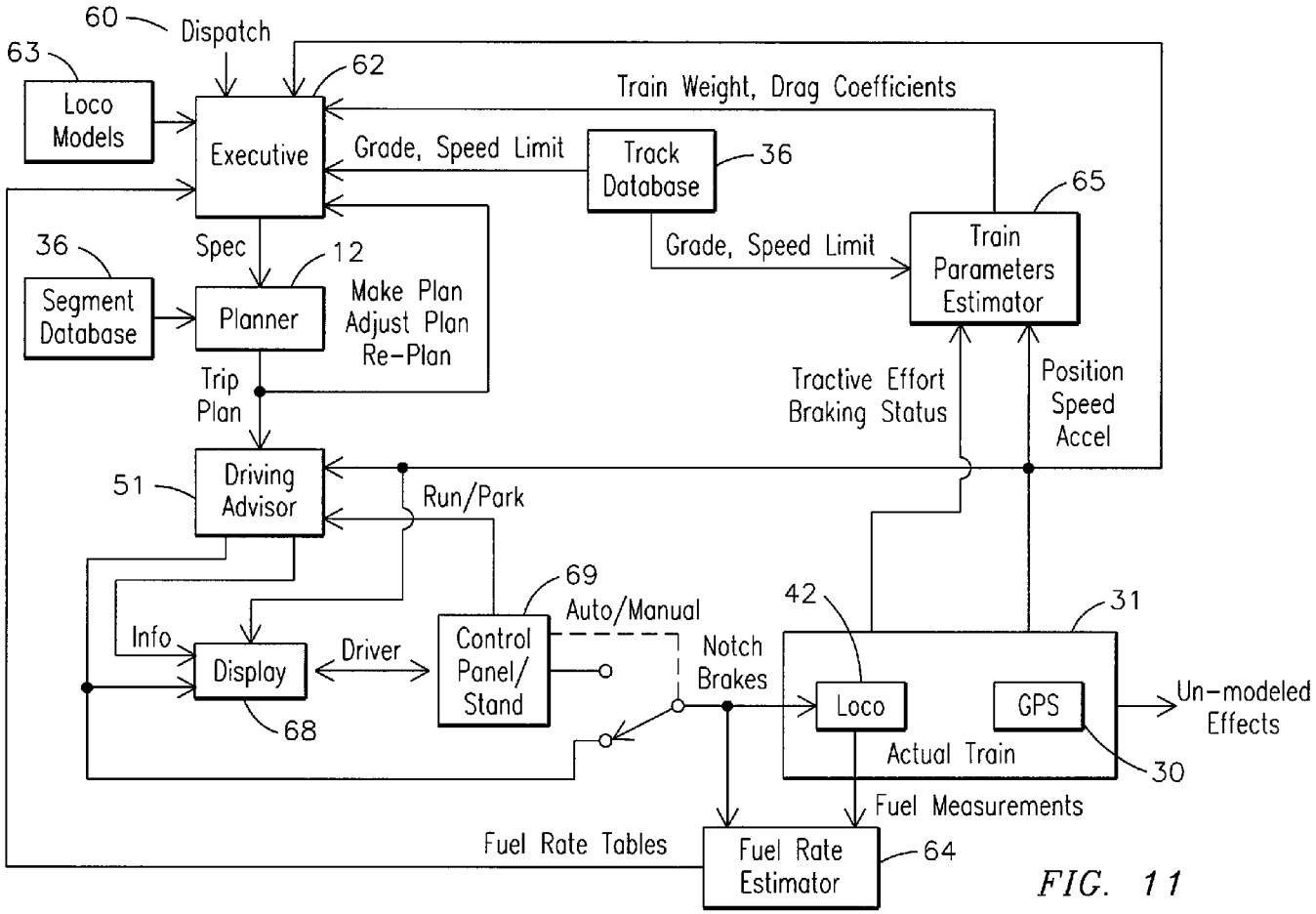
FIG. 11 is a flowchart that depicts another exemplary embodiment of a method of trip optimization.

FIG. 11 is a schematic diagram, showing information flow between elements, of an embodiment of the trip optimizer system. As discussed previously, a remote facility, such as a dispatch 60, can provide information. As illustrated, such information is provided to an executive control element 62. Also supplied to the executive control element 62 is information from a locomotive modeling database 63 ("Loco Models"), information from a track and/or segment database 36 (including, for example, track grade information and speed limit information, and estimated train parameters such as, but not limited to, train weight and drag coefficients), and fuel rate tables from a fuel rate estimator 64. The executive control element 62 supplies information to the trip profile planner 12, which is disclosed in more detail in FIG. 1. Once a trip plan has been calculated, the plan is supplied to a driving advisor, driver/operator, or controller element 51. The trip plan is also supplied to the executive control element 62 so that it can compare the trip when other new data is provided.

As discussed above, the controller element 51 can automatically set a notch power, either a pre-established notch setting or an optimum continuous notch power. In addition to supplying a speed command to the train 31, a display 68 is provided so that the operator can view what the planner has recommended. The operator also has access to a control panel/stand 69. Through the control panel 69 the operator can decide whether to apply the notch power recommended. Towards this end, the operator may limit a targeted or recommended power. That is, at any time the operator always has final authority over what power setting the locomotive consist will operate at. This includes deciding whether to apply braking if the trip plan recommends slowing the train 31. For example, if operating in dark territory, or where information from wayside equipment cannot electronically transmit information to a train and instead the operator views visual signals from the wayside equipment, the operator inputs commands based on information contained in the track database and visual signals from the wayside equipment. Based on how the train 31 is functioning, information regarding fuel measurement is supplied to the fuel rate estimator 64. Since direct measurement of fuel flows is not typically available in a locomotive consist, all information on fuel consumed so far within a trip and projections into the future following optimal plans is carried out using calibrated physics models such as those used in developing the optimal plans. For example, such predictions may include, but are not limited to, the use of measured gross horsepower and known fuel characteristics and emissions characteristics to derive the cumulative fuel used and emissions generated.

The train 31 also has a locator element 30 such as a GPS sensor, as discussed above. Information is supplied to the train parameters estimator 65. Such information may include, but is not limited to, GPS sensor data, tractive/braking effort data, braking status data, speed, and any changes in speed data. With information regarding grade and speed limit information, train weight and drag coefficients information is supplied to the executive control element 62.

Exemplary embodiments of the present invention may also allow for the use of continuously variable power throughout the optimization planning and closed loop control implementation. In a conventional locomotive, power is typically quantized to eight discrete levels. Modern locomotives can realize continuous variation in horsepower, which may be incorporated into the previously described optimization methods. With continuous power, the locomotive 42 can further optimize operating conditions, e.g., by minimizing auxiliary loads and power transmission losses, and fine tuning engine horsepower regions of optimum efficiency, or to points of increased emissions margins. Example include, but are not limited to, minimizing cooling system losses, adjusting alternator voltages, adjusting engine speeds, and reducing number of powered axles. Further, the locomotive 42 may use the on-board track database 36 and the forecasted performance requirements to minimize auxiliary loads and power transmission losses to provide optimum efficiency for the target fuel consumption/emissions. Examples include, but are not limited to, reducing a number of powered axles on flat terrain and pre-cooling the locomotive engine prior to entering a tunnel.

Exemplary embodiments of the trip optimizer system may also use the on-board track database 36 and the forecasted performance to adjust the locomotive performance, such as to insure that the train has sufficient speed as it approaches a hill and/or tunnel. For example, this could be expressed as a speed constraint at a particular location that becomes part of the optimal plan generation created solving the equation (OP). Additionally, the trip optimizer system may incorporate train-handling rules, such as, but not limited to, tractive effort ramp rates and maximum braking effort ramp rates. These may be incorporated directly into the formulation for optimum trip profile or alternatively incorporated into the closed loop regulator used to control power application to achieve the target speed.

In one embodiment, the trip optimizer system is only installed on a lead locomotive of the train consist. Even though exemplary embodiments of the present invention are not dependant on data or interactions with other locomotives, it may be integrated with a consist manager, as disclosed in U.S. Pat. No. 6,691,957 and U.S. Pat. No. 7,021,588 (owned by the Assignee and both incorporated by reference), and/or a consist optimizer functionality to improve efficiency. Interaction with multiple trains is not precluded, as illustrated by the example of dispatch arbitrating two "interdependently optimized" trains described herein.

Trains with distributed power systems can be operated in different modes. One mode is where all locomotives in the train operate at the same notch command. So if the lead locomotive is commanding motoring—N8, all units in the train will be commanded to generate motoring—N8 power. Another mode of operation is "independent" control. In this mode, locomotives or sets of locomotives distributed throughout the train can be operated at different motoring or braking powers. For example, as a train crests a mountaintop, the lead locomotives (on the down slope of mountain) may be placed in braking, while the locomotives in the middle or at the end of the train (on the up slope of mountain) may be in motoring. This is done to minimize tensile forces on the mechanical couplers that connect the railcars and locomotives. Traditionally, operating the distributed power system in "independent" mode required the operator to manually command each remote locomotive or set of locomotives via a display in the lead locomotive. Using the physics based planning model, train set-up information, on-board track database, on-board operating rules, location determination system, real-time closed loop power/brake control, and sensor feedback, the system is able to automatically operate the distributed power system in "independent" mode.

When operating in distributed power, the operator in a lead locomotive can control operating functions of remote locomotives in the remote consists via a control system, such as a distributed power control element. Thus, when operating in distributed power, the operator can command each locomotive consist to operate at a different notch power level (or one consist could be in motoring and another could be in braking), wherein each individual locomotive in the locomotive consist operates at the same notch power. In an exemplary embodiment, with the trip optimizer system installed on the train and in communication with the distributed power control element, when a notch power level for a remote locomotive consist is desired as recommended by the optimized trip plan, the trip optimizer system will communicate this power setting to the remote locomotive consists for implementation. As discussed below, the same is true regarding braking.

Exemplary embodiments of the present invention may be used with consists in which the locomotives are not contiguous, e.g., with one or more locomotives up front and others in the middle and/or at the rear for train. Such configurations are called "distributed power," wherein the standard connection between the locomotives is replaced by radio link or auxiliary cable to link the locomotives externally. When operating in distributed power, the operator in a lead locomotive can control operating functions of remote locomotives in the consist via a control system, such as a distributed power control element. In particular, when operating in distributed power, the operator can command each locomotive consist to operate at a different notch power level (or one consist could be in motoring and other could be in braking), wherein each individual in the locomotive consist operates at the same notch power.

In an exemplary embodiment, with the trip optimizer system installed on the train and in communication with the distributed power control element, when a notch power level for a remote locomotive consist is desired as recommended by the optimized trip plan, the trip optimizer system will communicate this power setting to the remote locomotive consists for implementation. As discussed below, the same is true regarding braking. When operating with distributed power, the optimization problem previously described can be enhanced to allow additional degrees of freedom, in that each of the remote units can be independently controlled from the lead unit. The value of this is that additional objectives or constraints relating to in-train forces may be incorporated into the performance function, assuming the model to reflect the in-train forces is also included. Thus, exemplary embodiments of the present invention may include the use of multiple throttle controls to better manage in-train forces as well as fuel consumption and emissions.

In a train utilizing a consist manager, the lead locomotive in a locomotive consist may operate at a different notch power setting than other locomotives in that consist. The other locomotives in the consist operate at the same notch power setting. The trip optimizer system may be utilized in conjunction with the consist manager to command notch power settings for the locomotives in the consist. Thus, based on the trip optimizer system, since the consist manager divides a locomotive consist into two groups, namely, lead locomotive and trail units, the lead locomotive will be commanded to operate at a certain notch power and the trail locomotives are commanded to operate at another certain notch power. In an exemplary embodiment, the distributed power control element may be the system and/or apparatus where this operation is housed.

Likewise, when a consist optimizer is used with a locomotive consist, the trip optimizer system can be used in conjunction with the consist optimizer to determine notch power for each locomotive in the locomotive consist. For example, suppose that a trip plan recommends a notch power setting of 4 for the locomotive consist. Based on the location of the train, the consist optimizer will take this information and then determine the notch power setting for each locomotive in the consist. In this implementation, the efficiency of setting notch power settings over intra-train communication channels is improved. Furthermore, as discussed above, implementation of this configuration may be performed utilizing the distributed control system.

Furthermore, as discussed previously, exemplary embodiments of the present invention may be used for continuous corrections and re-planning with respect to when the train consist uses braking based on upcoming items of interest, such as, but not limited to, railroad crossings, grade changes, approaching sidings, approaching depot yards, and approaching fuel stations, where each locomotive in the consist may require a different braking option. For example, if the train is coming over a hill, the lead locomotive may have to enter a braking condition, whereas the remote locomotives, having not reached the peak of the hill may have to remain in a motoring state.

Figure 12:
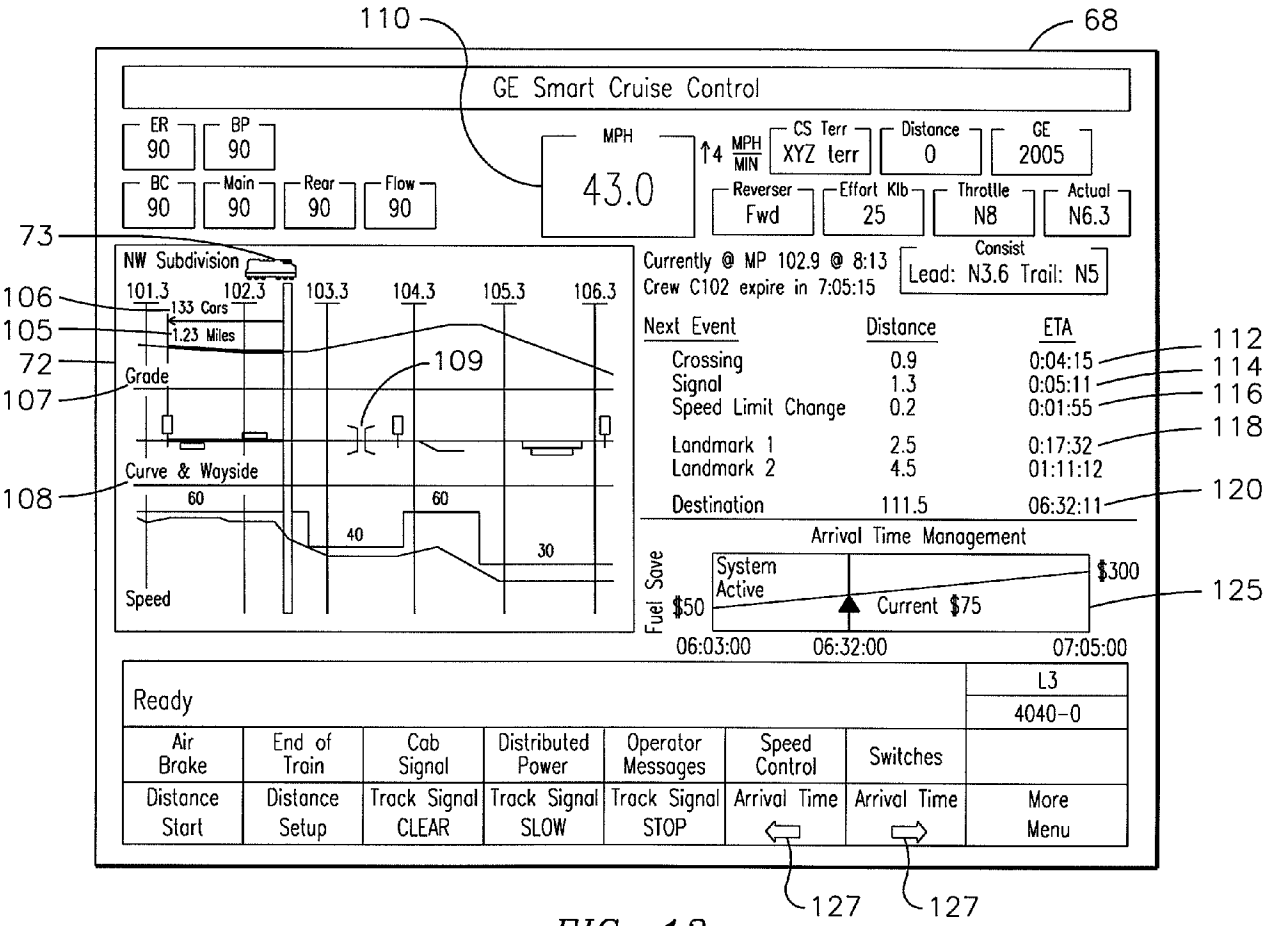
FIG. 12 depicts an exemplary embodiment of a dynamic display for use by an operator.
Figure 13:
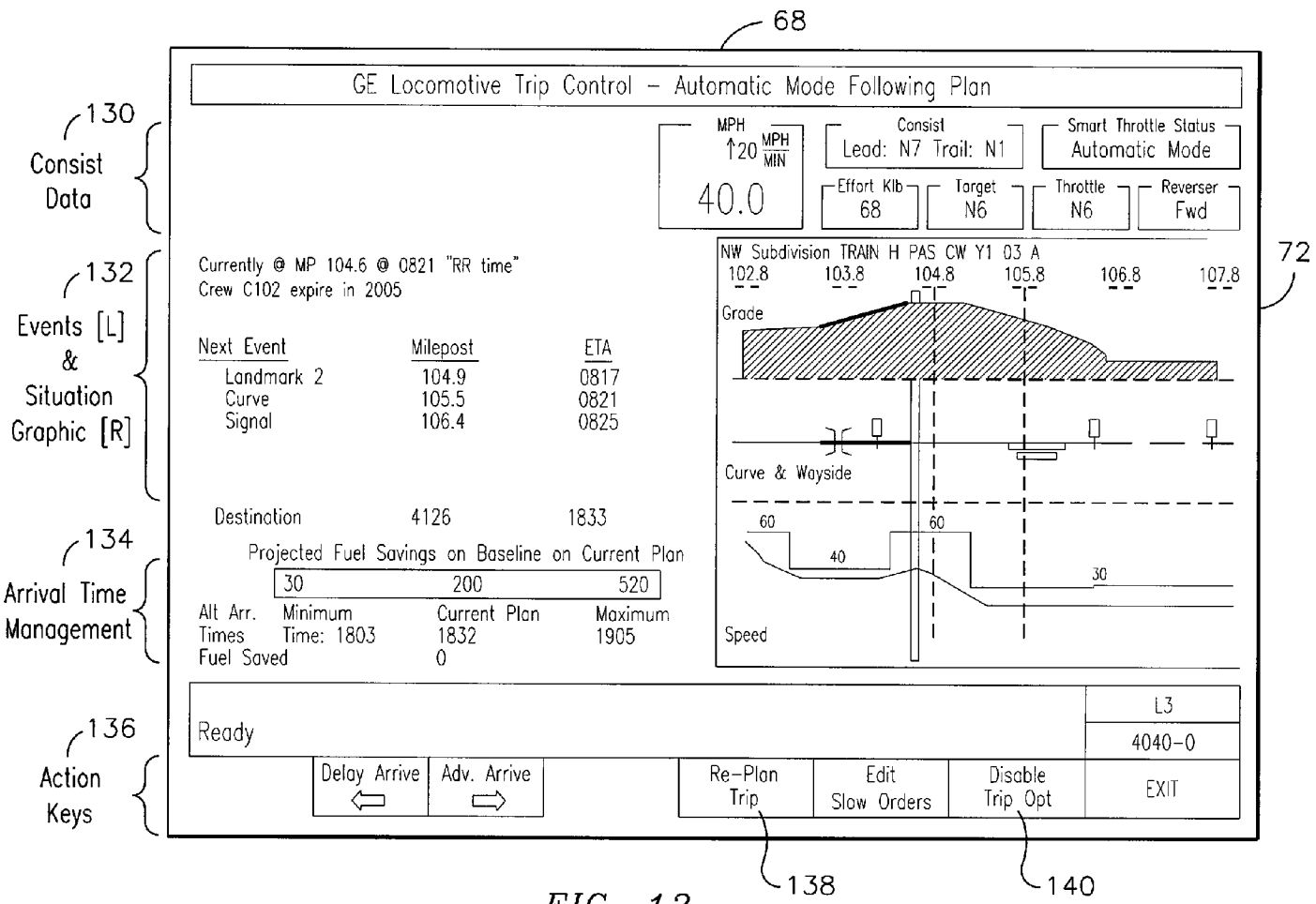
FIG. 13 depicts another exemplary embodiment of a dynamic display for use by the operator.
Figure 14:
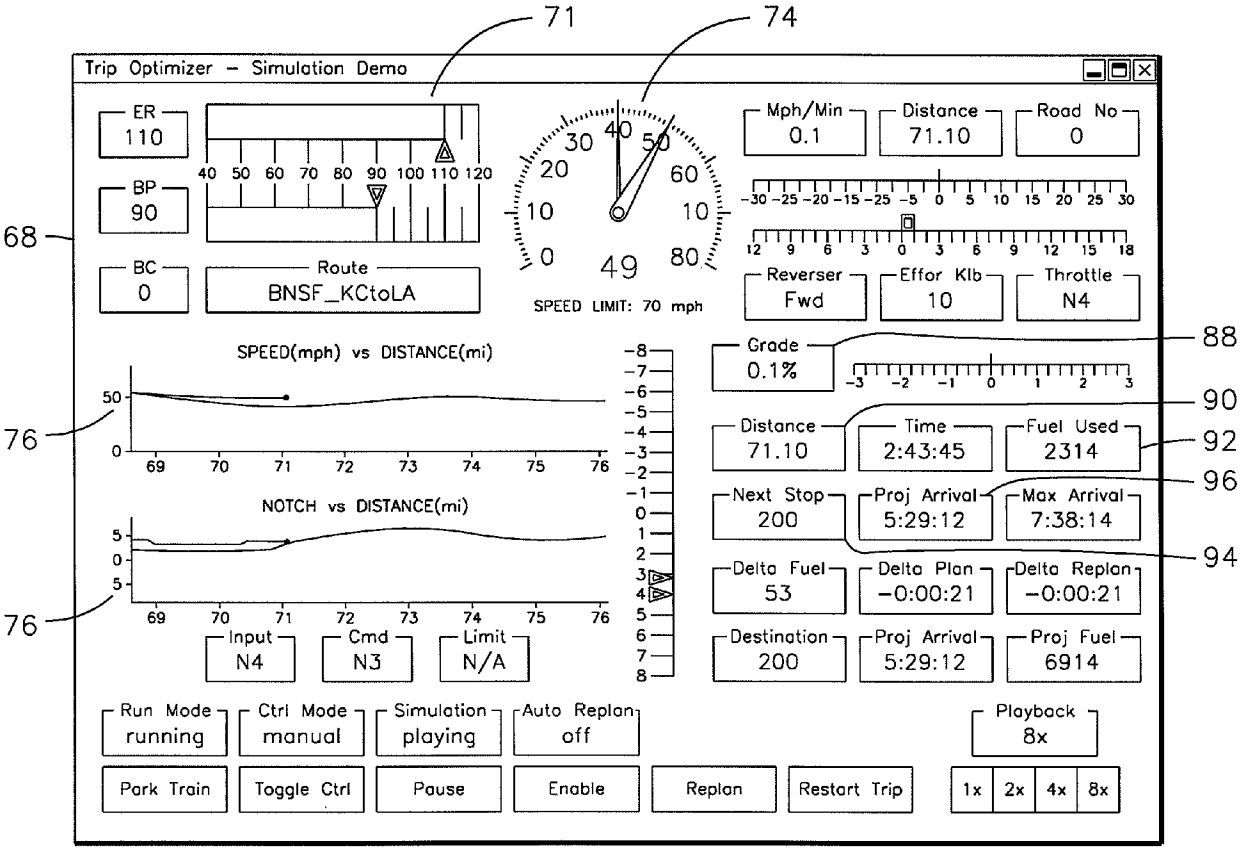
FIG. 14 depicts another exemplary embodiment of a dynamic display for use by the operator.

FIGS. 12, 13 and 14 are illustrations of dynamic displays 68 for use by the operator, according to various embodiments of the present invention. As shown in FIG. 12, a trip profile 72 may be provided as part of the dynamic display 68. Within the profile a location 73 of the locomotive is provided. Such information as train length 105 and the number of cars 106 in the train is provided. Display elements are also provided regarding track grade 107, curve and wayside elements 108, including bridge location 109, and train speed 110. The display 68 allows the operator to view such information and also see where the train is along the route. Information pertaining to distance and/or estimated time of arrival to such locations as crossings 112, signals 114, speed changes 116, landmarks 118, and destinations 120 is provided. An arrival time management tool 125 is also provided to allow the user to determine the fuel savings that is being realized during the trip. The operator has the ability to vary arrival times 127 and witness how this affects the fuel savings. As discussed herein, those skilled in the art will recognize that fuel saving is an example of only one objective that can be reviewed with a management tool. Towards this end, depending on the parameter being viewed, other parameters discussed herein can be viewed and evaluated with a management tool that is visible to the operator. The operator is also provided information about how long the crew has been operating the train. In exemplary embodiments time and distance information may either be illustrated as the time and/or distance until a particular event and/or location, or it may provide a total elapsed time.

As illustrated in FIG. 13, an exemplary display provides information about consist data 130, an events and situation graphic 132, an arrival time management tool 134, and action keys 136. Similar information as discussed above is provided in this display as well. This display 68 also provides action keys 138 to allow the operator to re-plan, as well as to disengage 140 the trip optimizer system.

FIG. 14 depicts another exemplary embodiment of the display. Data typical of a modern locomotive including airbrake status 71, analog speedometer with digital insert 74, and information about tractive effort in pounds force (or traction amps for DC locomotives) is visible. An indicator 74 is provided to show the current optimal speed in the plan being executed, as well as an accelerometer graphic to supplement the readout in mph/minute. Important new data for optimal plan execution is in the center of the screen, including a rolling strip graphic 76 with optimal speed and notch setting versus distance compared to the current history of these variables. In this exemplary embodiment, the location of the train is derived using the locator element. As illustrated, the location is provided by identifying how far the train is away from its final destination, an absolute position, an initial destination, an intermediate point, and/or an operator input.

The strip chart provides a look-ahead to changes in speed required to follow the optimal plan, which is useful in manual control, and monitors plan versus actual during automatic control. As discussed herein, such as when in the coaching mode, the operator can follow either the notch or speed suggested by exemplary embodiments of the present invention. The vertical bar gives a graphic of desired and actual notch, which are also displayed digitally below the strip chart. When continuous notch power is utilized, as discussed above, the display will simply round to the closest discrete equivalent. The display may be an analog display so that an analog equivalent or a percentage or actual horse power/tractive effort is displayed.

Critical information on trip status is displayed on the screen, and shows the current grade the train is encountering 88, either by the lead locomotive, a location elsewhere along the train, or an average over the train length. Also displayed are a distance traveled so far in the plan 90, cumulative fuel used 92, where the next stop is planned 94 (and/or a distance to the next planned stop), and current and projected arrival time 96 for the next stop. The display 68 also shows the maximum possible time to destination possible with the computed plans available. If a later arrival was required, a re-plan would be carried out. Delta plan data shows status for fuel and schedule ahead or behind the current optimal plan. Negative numbers mean less fuel or early compared to plan, positive numbers mean more fuel or late compared to plan, and typically trade-off in opposite directions (slowing down to save fuel makes the train late and conversely).

At all times, these displays 68 give the operator a snapshot of where the train stands with respect to the currently instituted driving plan. This display is for illustrative purpose only as there are many other ways of displaying/conveying this information to the operator and/or dispatch. Towards this end, the information disclosed above could be intermixed to provide a display different than the ones disclosed.

Other features that may be included in the trip optimizer system include, but are not limited to, allowing for the generation of data logs and reports. This information may be stored on the train and downloaded to an off-board system at some point in time. The downloads may occur via manual and/or wireless transmission. This information may also be viewable by the operator via the locomotive display. The data may include information such as, but not limited to, operator inputs, the time the system is operational, fuel saved, fuel imbalance across locomotives in the train, train journey off course, and system diagnostic issues such as if a GPS sensor is malfunctioning.

Since trip plans must also take into consideration allowable crew operation time, exemplary embodiments of the present invention may take such information into consideration as a trip is planned. For example, if the maximum time a crew may operate is eight hours, then the trip is fashioned to include stopping location for a new crew to take the place of the present crew. Such specified stopping locations may include, but are not limited to, rail yards, meet/pass locations, and the like. If, as the trip progresses, the trip time may be exceeded, the trip optimizer system may be overridden by the operator to meet criteria as determined by the operator. Ultimately, regardless of the operating conditions of the train (e.g., high load, low speed, and train stretch conditions), the operator remains in control to command a speed and/or operating condition of the train.

Using the trip optimizer system, the train may operate in a plurality of operational manners/configurations. In one operational concept, the trip optimizer system may provide commands for commanding propulsion and dynamic braking. The operator then handles all other train functions. In another operational concept, the trip optimizer system may provide commands for commanding propulsion only. The operator then handles dynamic braking and all other train functions. In yet another operational concept, the trip optimizer system may provide commands for commanding propulsion, dynamic braking, and application of the airbrake. The operator then handles all other train functions.

The trip optimizer system may also be used to notify the operator of upcoming items of interest and/or of actions to be taken. Specifically, using the forecasting logic of exemplary embodiments of the present invention, the continuous corrections and re-planning to the optimized trip plan, and/or the track database, the operator can be notified of upcoming crossings, signals, grade changes, brake actions, sidings, rail yards, fuel stations, etc. This notification may occur audibly and/or through the operator interface.

Specifically, using the physics based planning model, train set-up information, on-board track database, on-board operating rules, location determination system, real-time closed loop power/brake control, and sensor feedback, the system presents and/or notifies the operator of required actions. The notification can be visual and/or audible. Examples include notifying of crossings that require the operator to activate the locomotive horn and/or bell, and notifying of "silent" crossings that do not require that the operator activate the locomotive horn or bell.

In another exemplary embodiment, using the physics based planning model discussed above, train set-up information, on-board track database, on-board operating rules, location determination system, real-time closed power/brake control, and sensor feedback, the operator may be presented with information (e.g., a gauge on display) that allows the operator to see when the train will arrive at various locations, as illustrated in FIG. 13. The system allows the operator to adjust the trip plan (e.g., target arrival time). This information (actual estimated arrival time or information needed to derive off-board) can also be communicated to the dispatch center to allow the dispatcher or dispatch system to adjust the target arrival times. This allows the system to quickly adjust and optimize for the appropriate target function (for example trading off speed and fuel usage).

Figure 15:
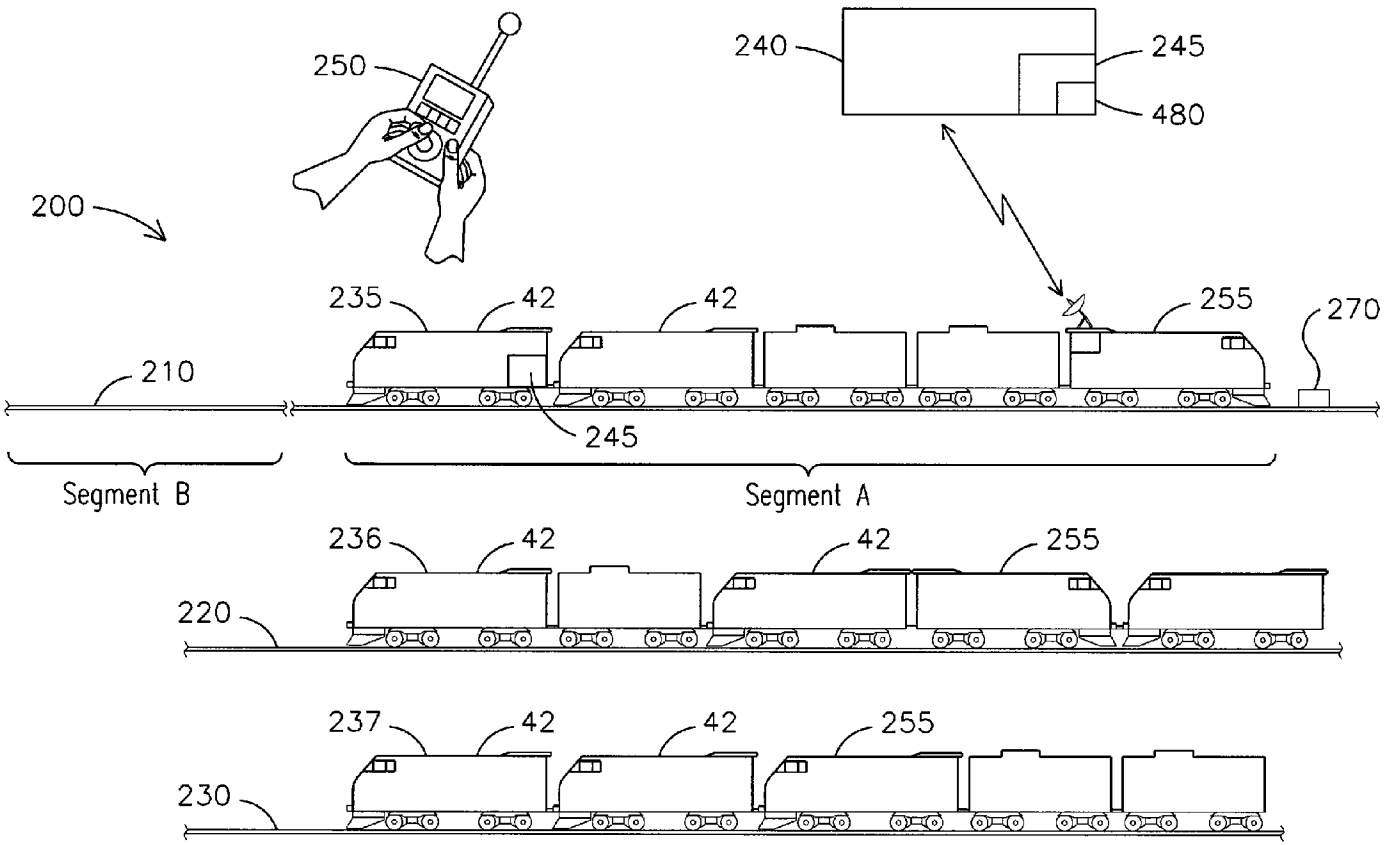
FIG. 15 depicts an exemplary embodiment of a network of railway tracks with multiple trains.

FIG. 15 depicts an exemplary embodiment of a network of railway tracks with multiple trains. In the railroad network 200, it is desirable to obtain an optimized fuel efficiency and time of arrival for the overall network of multiple interacting tracks 210, 220, 230, and trains 235, 236, 237. As illustrated, multiple tracks 210, 220, 230 are shown with a train 235, 236, 237 on each respective track. Though locomotive consists 42 are illustrated as part of the trains 235, 236, 237, those skilled in the art will readily recognize that any train may only have a single locomotive consist having a single locomotive. As disclosed herein, a remote facility 240 may also be involved with improving fuel efficiency and reducing emissions of a train through optimized train power makeup. This may be accomplished with a processor 245, such as a computer, located at the remote facility 240. In another exemplary embodiment a hand-held device 250 may be used to facilitate improving fuel efficiency of the train 235, 236, 237 through optimized train power makeup. Typically in either of these approaches, configuring of the train 235, 236, 237 usually occurs at a hump, rail yard, or the like, when the train is being compiled.

Alternatively, as discussed below, the processor 245 may be located on the train 235, 236, 237 or aboard another train, wherein train setup may be accomplished using inputs from the other train. For example, if a train has recently completed a mission over the same tracks, input from that train's mission may be supplied to the current train as it either is performing and/or is about to begin its mission. Thus, configuring the train may occur at train run time, and even during the run time. For example, real time configuration data may be utilized to configure the train locomotives. One such example is provided above with respect to using data from another train. Another example entails using other data associated with trip optimization of the train as discussed above. Additionally, the train setup may be performed using input from a plurality of sources, such as, but not limited to, a dispatch system, a wayside system 270, an operator, an off-line real time system, an external setup, a distributed network, a local network, and/or a centralized network.

Figure 16:
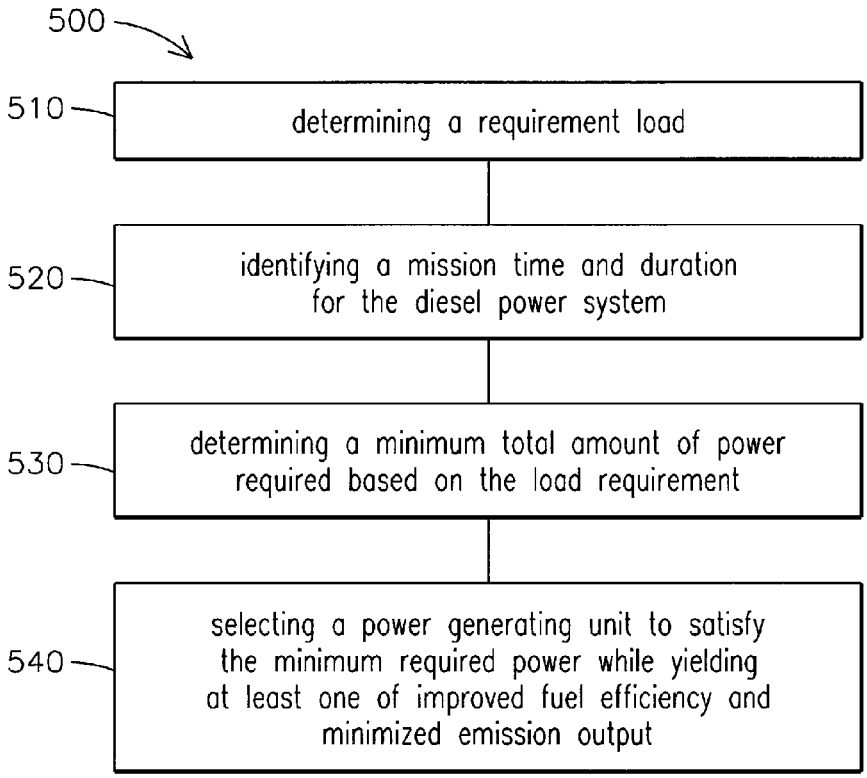
FIG. 16 is a flowchart of a method for improving fuel efficiency of a train through optimized train power makeup, according to an additional embodiment of the invention.

FIG. 16 is a flowchart depicting an exemplary embodiment of a method for improving fuel efficiency and reducing emission output through optimized train power makeup. As disclosed above, to minimize fuel use and emissions while preserving time arrival, acceleration and matched breaking may be minimized. Undesired emissions may also be minimized by powering a minimal set of locomotives. For example, in a train with several locomotives or locomotive consists, powering a minimal set of locomotives at a higher power setting while putting the remaining locomotives into idle, unpowered standby, or an automatic engine start-stop ("AESS") mode as discussed below, will reduce emissions. This is at least partly because exhaust emissions after-treatment devices on the locomotives (e.g., catalytic converters) are at a temperature below which they optimally operate, when locomotives are run at lower power settings (e.g., notch 1-3). Therefore, using the minimum number of locomotives or locomotive consists to make the mission on time, operating at high power settings will allow for the exhaust emission treatment devices to operate at optimal temperatures, thereby further reducing emissions.

Figure 17:
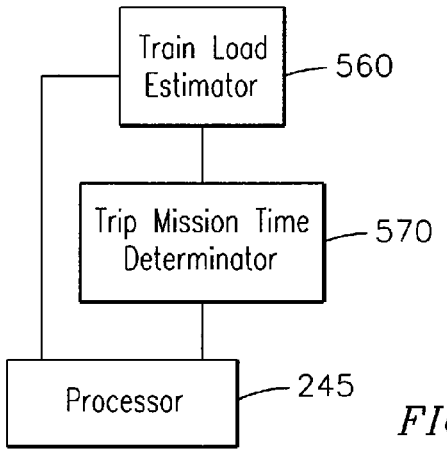
FIG. 17 depicts a block diagram of exemplary elements included in a system for optimized train power makeup.

The method illustrated in flowchart 500 in FIG. 16 provides for determining a train load, at 510. When the engine is used in other applications, the load is determined based on the engine configuration. The train load may be determined with a load, or train load, estimator 560, as illustrated in FIG. 17. In an exemplary embodiment, the train load is estimated based on information obtained as disclosed in a train makeup docket 480, as illustrated in FIG. 15. For example, the train makeup docket 480 may be contained in the processor 245 (illustrated in FIGS. 15 and 17), wherein the processor 245 makes the estimation, or may be on paper wherein an operator makes the estimation. The train makeup docket 480 may include information such as the number of cars, car weight, car content, car age, etc. In another exemplary embodiment, the train load is estimated using historical data, such as, but not limited to, prior train missions making the same trip, and similar train car configurations. As discussed above, using historical data may be accomplished with a processor or manually. In yet another exemplary embodiment, the train load is estimated using a rule of thumb or table data. For example, the operator configuring the train 235, 236, 237 may determine the train load required based on established guidelines such as, but not limited to, a number of cars in the train, types of cars in the train, weight of the cars in the train, and an amount of products being transported by the train. This same rule of thumb determination may also be accomplished using the processor 245.

Referring back to FIG. 16, identifying a mission time and/or duration for the diesel power system, at 520, is disclosed. With respect to engines used in other applications, identifying a mission time and/or duration for the diesel power system may be equated to defining the mission time within which the engine configuration is expected to accomplish the mission. A determination is made about a minimum total amount of power required based on the train load, at 530. The locomotive is selected to satisfy the minimum required power while yielding improved fuel efficiency and/or minimized emission output, at 540. The locomotive may be selected based on a type of locomotive (based on its engine) needed and/or a number of locomotives (based on a number of engines) needed. Similarly, with respect to diesel engines used in other power applications, such as but not limited to marine, OHV, and stationary power stations, multiple units of each are used to accomplish an intended mission unique for the specific application.

Towards this end, a trip mission time determinator 570, as illustrated in FIG. 17, may be used to determine the mission time based on information such as, but not limited to, weather conditions, track conditions, and the like. The locomotive makeup may be based on the types of locomotives needed, as a function of power output or otherwise, and/or a minimum number of locomotives needed. For example, based on the available locomotives, a selection is made of those locomotives that just meet the total power required. Towards this end, as an example, if ten locomotives are available, a determination of the power output from each locomotive is made. Based on this information, the fewest number and type of locomotives needed to meet the total power requirements are selected. For example, the locomotives may have different horse power (HP) ratings or starting tractive effort (TE) ratings. In addition to the total power required, the distribution of power and type of power in the train can be determined. For example, to limit the maximum coupler forces on heavy trains, the locomotives may be distributed within the train. Another consideration is the capability of the locomotive. It may be possible to put four DC locomotives on the head end of a train; however, four AC units with the same HP may not be used at the head end since the total drawbar forces may exceed designated limits.

In another exemplary embodiment, the selection of locomotives may not be based solely on reducing a number of locomotives used in a train. For example, if the total power requirement is minimally met by five of the available locomotives when compared to also meeting the power requirement by the use of three of the available locomotives, the five locomotives are used instead of the three. In view of these options, those skilled in the art will readily recognize that a minimum number of locomotives may be selected from a sequential (and random) set of available locomotives. Such an approach may be used when the train 235, 236, 237 is already compiled and a decision is being made at run time and/or during a mission wherein the remaining locomotives are not used to power the train 235, 236, 237, as discussed in further detail below.

While compiling the train 235, 236, 237, if the train 235, 236, 237 requires backup power, incremental locomotive 255, or locomotives, may be added (see FIG. 15). However, this additional locomotive 255 is isolated to minimize fuel use, emission output, and power variation, but may be used to provide backup power in case an operating locomotive becomes inoperable, and/or to provide additional power to accomplish the trip within an established mission time. The isolated locomotive 255 may be put into an AESS mode to minimize fuel use while having the locomotive be available when needed. In an exemplary embodiment, if a backup, or isolated, locomotive 255 is provided, its dimensions (e.g., weight) may be taken into consideration when determining the train load.

Thus, as discussed above in more detail, determining minimum power needed to power the train 235, 236, 237 may occur at train run time and/or during a run (or mission). In this instance, once a determination is made as to optimized train power and the locomotives or locomotive consists 42 in the train 235, 236, 237 are identified to provide the requisite power needed, the additional locomotive(s) 255 not identified for use are put in the idle, or AESS, mode.

In an exemplary embodiment, the total mission run may be broken into a plurality of sections, or segments, such as but not limited to at least 2 segments, such as segment A and segment B as illustrated in FIG. 15. Based on the amount of time taken to complete any segment, the backup power provided by the isolated locomotive 255 is made available in case incremental power is needed to meet the trip mission objective. Towards this end, the isolated locomotive 255 may be utilized for a specific trip segment to get the train 235, 236, 237 back on schedule and then switched off for subsequent segments, if the train 235, 236, 237 remains on schedule.

Thus, in operation, the lead locomotive may put the locomotive 255 provided for incremental power into an isolation mode until the power is needed. This may be accomplished by use of wired or wireless modems or communications from the operator, usually on the lead locomotive, to the isolated locomotive 255. In another exemplary embodiment, the locomotives operate in a distributed power configuration and the isolated locomotive 255 is already integrated in the distributed power configuration, but is idle, and is switched on when the additional power is required. In yet another embodiment, the operator puts the isolated locomotive 255 into the appropriate mode.

In an exemplary embodiment, the initial setup of the locomotives, based on train load and mission time, is updated by the trip optimizer, as disclosed above, and adjustments to the number and type of powered locomotives are made. As an exemplary illustration, consider a locomotive consist 42 of three locomotives having relative available maximum power of 1, 1.5 and 0.75, respectively. (Relative available power is relative to a "reference" locomotive, which is used to determine the total consist power. For example, in the case of a '3000 HP' reference locomotive, the first locomotive has 3000 HP, the second 4500 HP, and the third 2250 HP.) Suppose that the mission is broken into seven segments. Given the above scenario, the following combinations are available and can be matched to the track section load: 0.75, 1, 1.5, 1.75, 2.25, 2.5, 3.25, which is the combination of maximum relative HP settings for the consist. Thus, for each respective relative HP setting mentioned above, for the 0.75 setting the third locomotive is on and the first and second are off, for 1 the first locomotive is on and the second and third are off, etc. In one embodiment, the trip optimizer selects the maximum required load and adjusts via notch calls while minimizing an overlap of power settings. Hence, if a segment calls for between 2 and 2.5 (times 3000 HP) then locomotive 1 and locomotive 2 are used while locomotive 3 is in either idle or in standby mode, depending on the time it is in this segment and the restart time of the locomotive.

In another exemplary embodiment, an analysis may be performed to determine a trade off between emission output and locomotive power settings to maximize higher notch operation where the emissions from the exhaust after treatment devices are more optimal. This analysis may also take into consideration one of the other parameters discussed above regarding train operation optimization. This analysis may be performed for an entire mission run, segments of a mission run, and/or combinations of both.

FIG. 17 depicts a block diagram of elements included in a system for optimized train power makeup, according to one aspect of the present invention. As illustrated and discussed above, a train load estimator 560 is provided. A trip mission time determinator 570 is also provided. A processor 245 is also provided. As disclosed above, though directed at a train, similar elements may be used for other engines not being used within a rail vehicle, such as but not limited to off-highway vehicles, marine vessels, and stationary units. The processor 245 calculates a total amount of power required to power the train 235, 236, 237 based on the train load determined by the train load estimator 560 and a trip mission time determined by the trip mission time determinator 570. A determination is further made of a type of locomotive needed and/or a number of locomotives needed, based on each locomotive power output, to minimally achieve the minimum total amount of power required based on the train load and trip mission time.

The trip mission time determinator 570 may segment the mission into a plurality of mission segments, such as a segment A and a segment B, as discussed above. The total amount of power may then be individually determined for each segment of the mission. As further discussed above, an additional locomotive 255 is part of the train 235, 236, 237 and is provided for backup power. The power from the backup locomotive 255 may be used incrementally as a requirement is identified, such as but not limited to providing power to get the train 235, 236, 237 back on schedule for a particular trip segment. In this situation, the train 235, 236, 237 is operated to achieve and/or meet the trip mission time.

The train load estimator 560 may estimate the train load based on information contained in the train makeup docket 480, historical data, a rule of thumb estimation, and/or table data. Furthermore, the processor 245 may determine a trade off between emission output and locomotive power settings to maximize higher notch operation where the emissions from the exhaust after-treatment devices are optimized.

Figure 18:
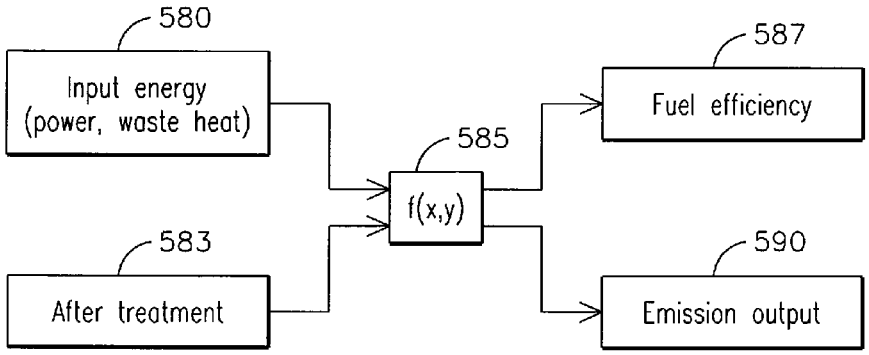
FIG. 18 depicts a block diagram of a transfer function for determining a fuel efficiency and emissions for a diesel powered system.

FIG. 18 depicts a block diagram of a transfer function for determining a fuel efficiency and emissions for a diesel powered system. Such diesel-powered systems include, but are not limited to, locomotives, marine vessels, OHV, and/or stationary generating stations. As illustrated, information pertaining to input energy 580 (such as power, waste heat, etc.) and information about an after treatment process 583 are provided to a transfer function 585 ("f(x,y)"). The transfer function 585 utilizes this information to determine an optimum fuel efficiency 587 and emission output 590.

Figure 19:
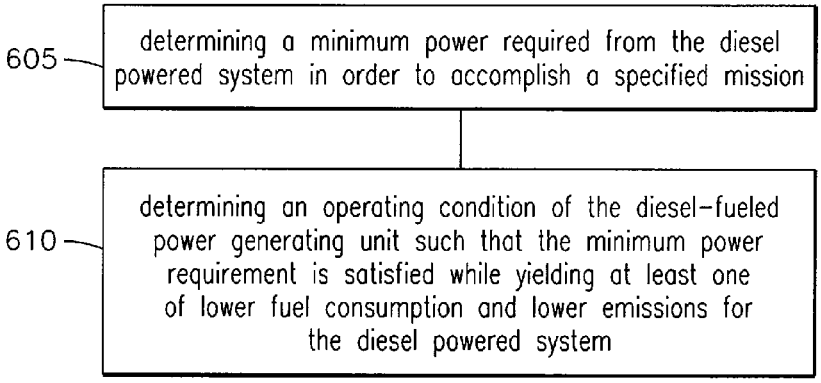
FIG. 19 is a flow chart depicting an exemplary embodiment of a method for determining a configuration of a diesel powered system having at least one diesel-fueled power generating unit.

FIG. 19 depicts an exemplary embodiment of a method for determining a configuration of a diesel-powered system having at least one diesel-fueled power generating unit. As shown in flowchart 600, the method includes determining a minimum power required from the diesel-powered system in order to accomplish a specified mission, at 605. An operating condition of the diesel-fueled power generating unit is determined such that the minimum power requirement is satisfied while yielding at least one of lower fuel consumption and/or lower emissions for the diesel powered system, as at 610. As disclosed above, the method illustrated in flowchart 600 is applicable for a plurality of diesel-fueled power generating units, such as, but not limited to, locomotives, marine vessels, OHVs, and/or stationary generating stations. Additionally, this flowchart 600 may be implemented using a computer software program that may reside on a computer readable media.

Figure 20:
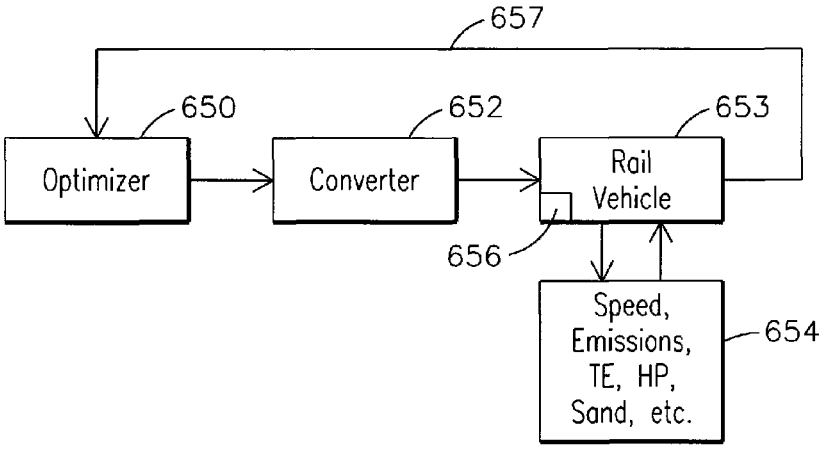
FIG. 20 depicts an exemplary embodiment of a closed-loop system for operating a rail vehicle.

FIG. 20 depicts an exemplary embodiment of a closed-loop system for operating a rail vehicle. As illustrated, the system includes an optimizer 650, a converter 652, a rail vehicle 653, and at least one output 654 from gathering specific information, such as, but not limited to, speed, emissions, tractive effort, horse power, and a friction modifier technique (e.g., applying sand). The output 654 may be determined by a sensor 656 that is part of the rail vehicle 653, or in another exemplary embodiment independent of the rail vehicle 653. Information initially derived from information generated from the trip optimizer 650 and/or a regulator is provided to the rail vehicle 653 through the converter 652. Locomotive data gathered by the sensor 656 from the rail vehicle is then communicated back to the optimizer 650 over a close-loop communication pathway 657.

The optimizer 650 determines operating characteristics for at least one factor that is to be regulated, such as speed, fuel, emissions, etc. The optimizer 650 determines at least one of a power and/or torque setting based on a determined optimized value. The converter 652 is provided to convert information about power, torque, speed, emissions, a friction modifying technique (such as but not limited to applying sand), setup, configurations, etc., into a form suitable for applying to the control inputs for the rail vehicle 653, usually a locomotive. Specifically, this information or data may be converted to an electrical signal.

Figure 21:
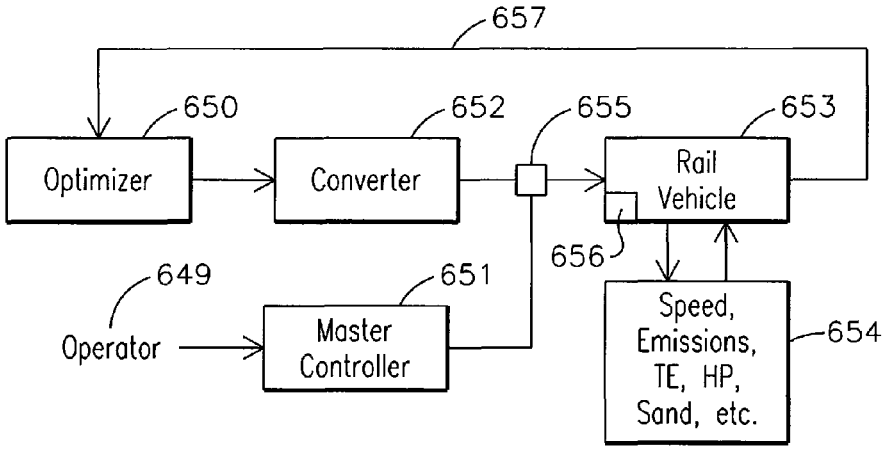
FIG. 21 depicts the closed loop system of FIG. 16 integrated with a master control unit.

As illustrated in further detail below, the converter 652 may interface with any one of a plurality of devices, such as a master controller, remote control locomotive controller, a distributed power drive controller, a train line modem, analog input, etc. FIG. 21 depicts the closed loop system integrated with a master control unit or controller 651. The converter, for example, may selectively disconnect or disable the output of the master controller (or actuator) 651. (The master controller 651 is normally used by the operator to command the locomotive, as relating to power, horsepower, tractive effort, implementation of a friction modifying technique (such as but not limited to applying sand), braking (including at least one of dynamic braking, air brakes, hand brakes, etc.), propulsion, and the like. Those skilled in the art will readily recognize that the master controller may be used to control both hard switches and software-based switches used in controlling the locomotive.) Once the master controller 651 is disconnected, the converter 652 then generates control signals in place of the master controller 651. The disconnection of the actuator 651 may be by electrical wires, software switches, a configurable input selection process, etc. A switching device 655 is illustrated to perform this function. More specifically, the operator control input of the master controller 651 is disconnected.

Though FIG. 21 discloses a master controller 651, this is specific to a locomotive. Those skilled in the art will recognize that in other applications, such as those disclosed above, other devices may provide a function equivalent to that of the master controller as used in a locomotive. For example, an accelerator pedal is used in an OHV or transportation bus, and an excitation control is used on a generator. With respect to marine vessels, there may be multiple force producers (e.g., propellers), in different angles/orientation, that are controlled in a closed-loop manner.

As discussed above, the same technique may be used for other devices, such as a control locomotive controller, a distributed power drive controller, a train line modem, analog input, etc. Though not illustrated, those skilled in the art will readily recognize that the converter similarly could use these devices and their associated connections to the locomotive for applying input control signals to the locomotive. The communication system 657 for these other devices may be either wireless or wired. More specifically, the converter may be interfaced with devices (such as a drive controller, a modem, etc.) other than the master controller 651.

Figure 22:
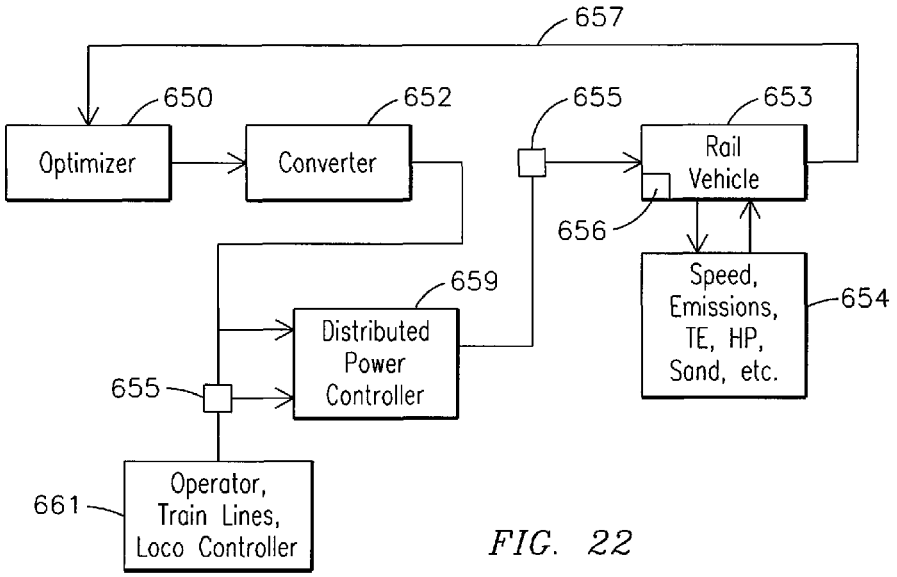
FIG. 22 depicts an exemplary embodiment of a closed-loop system for operating a rail vehicle integrated with another input operational subsystem of the rail vehicle.

FIG. 22 depicts an exemplary embodiment of a closed-loop system for operating a rail vehicle integrated with another input operational subsystem of the rail vehicle. For example, the distributed power drive controller 659 may receive inputs from various sources 661 (such as, but not limited to, the operator, train lines, and locomotive controllers) and transmit the information to locomotives in the remote positions. The converter 652 may provide information directly to the input of the DP controller 659 (as an additional input) or break one of the input connections and transmit the information to the DP controller 659. A switch 655 is provided to direct how the converter 652 provides information to the DP controller 659 as discussed above. The switch 655 may be a software-based switch and/or a wired switch. Additionally, the switch 655 is not necessarily a two-way switch. The switch may have a plurality of switching directions based on the number of signals it is controlling.

Figure 23:
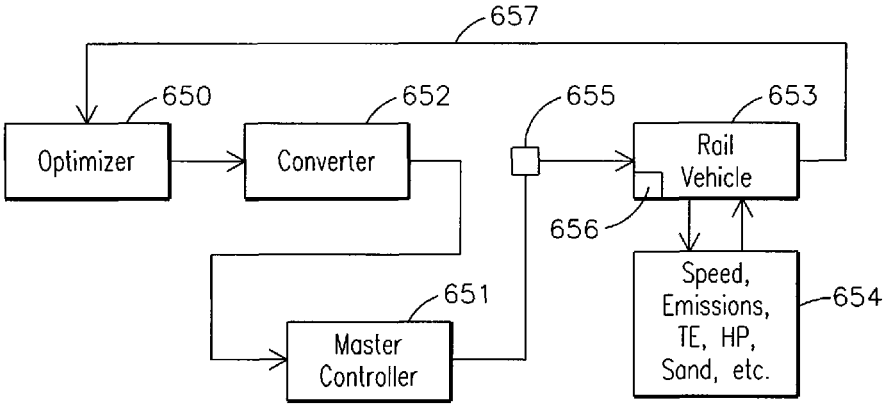
FIG. 23 depicts another exemplary embodiment of the closed-loop system with a converter which may command operation of the master control unit.

In another exemplary embodiment, the converter may command operation of the master controller, as illustrated in FIG. 23. The converter 652 has a mechanical means for moving the actuator 651 automatically based on electrical signals received from the optimizer 650.

Sensors 656 are provided aboard the locomotive to gather operating condition data 654, such as speed, emissions, tractive effort, horse power, etc. Locomotive output information from the sensors 656 is then provided to the optimizer 650, usually through the rail vehicle 653, thus completing the closed loop system.

Figure 24:
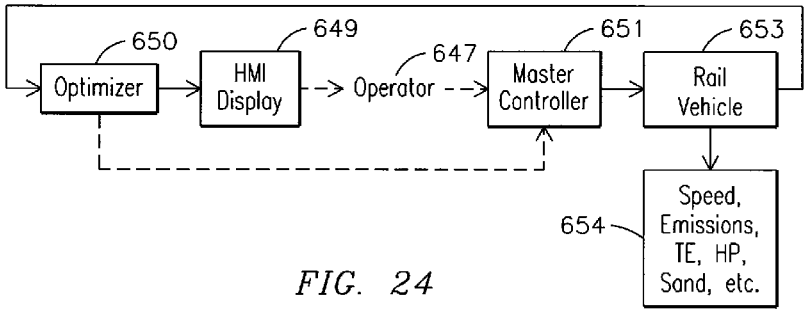
FIG. 24 depicts another exemplary embodiment of a closed-loop system.

FIG. 24 depicts another closed loop system, but where an operator is in the loop. The optimizer 650 generates the power/operating characteristic required for the optimum performance. The information is communicated to the operator 647, through a human machine interface (HMI) and/or display 649 or the like. Information could be communicated in various forms including audio, text or plots, or video displays. The operator 647 in this case can operate the master controller or pedals or any other actuator 651 to follow the optimum power level.

If the operator follows the plan, the optimizer continuously displays the next operation required. If the operator does not follow the plan, the optimizer may recalculate/re-optimize the plan, depending on the deviation and the duration of the deviation of power, speed, position, emission, etc. from the plan. If the operator is unable to meet an optimized plan to an extent where re-optimizing the plan is not possible or where safety criteria have been or may be exceeded, in an exemplary embodiment the optimizer may take control of the vehicle to ensure optimized operation, annunciate a need to consider the optimized mission plan, or simply record the occurrence for future analysis and/or use. In such an embodiment, the operator could retake control by manually disengaging the optimizer.

Figure 25:
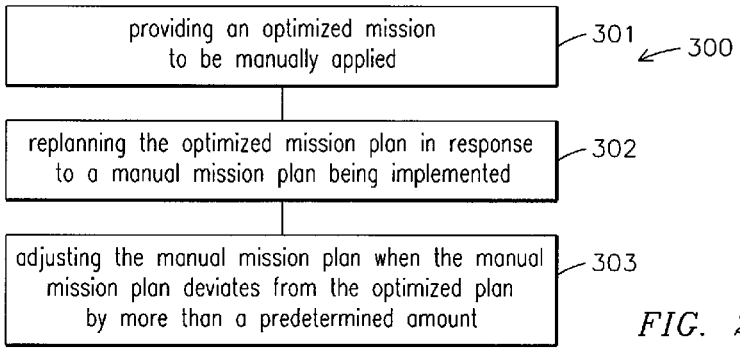
FIG. 25 is a flowchart showing an exemplary embodiment of a trip optimization method for when an operator input may be included in the decision loop.

FIG. 25 is a flowchart 300 of an exemplary trip (or other mission) optimization process, for when an operator input may be in the decision loop. An optimized plan is provided that may be manually applied, at 301. More specifically, an input device is available through which the operator may control the vehicle based on information contained in the optimized plan. The optimized mission plan is re-planned in response to a manual mission plan being implemented, at 302. When the manual plan deviates from the optimized plan by more than a predetermined amount, the manual plan may be adjusted, such as autonomously based on information contained in the optimized plan, at 303. For example, if the optimized mission plan provides for a certain speed for a given segment of the mission, if the manually applied mission plan results in exceeding that speed, the optimized mission plan may be autonomously implemented to apply a correction to insure the speed remains at an acceptable rate. Such an approach may be utilized for example when a hard limit is about to be breached or when a soft limit has been exceeded for a predetermine amount of time.

In another example, when the vehicle is being controlled based on the optimized mission plan, the operator is allowed to modify, adjust, or trim a value determined by the optimized mission plan by a select amount or for a given time period. By way of illustration, if the optimizer has commanded a specific velocity for a specific segment of track, but, as an example only, this is a segment of the mission that the operator has traversed previously and prefers a different velocity, the trip optimizer is configured to allow the operator to adjust the velocity, provided that the adjusted velocity is within a preset adjustment range as established within the trip optimizer. If the adjustment is outside of the adjustment range, the operator has an option to disengage the trip optimizer and then set the velocity preferred. Similarly, the optimizer may be configured to modify the operator command by a select amount.

Figure 27:
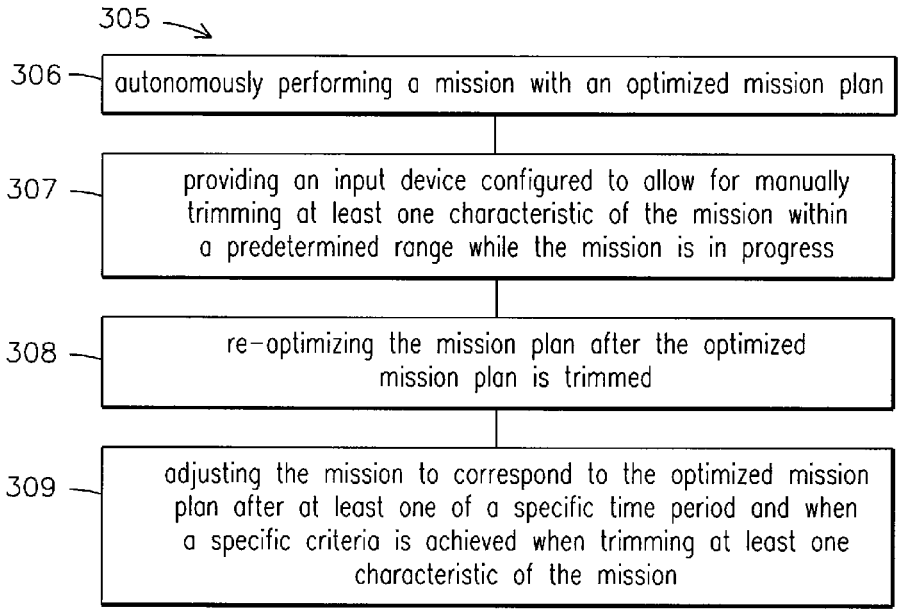
FIG. 27 is a flowchart illustrating an exemplary embodiment of a trip optimization method, where an operator interface is available for the operator to trim an optimized mission plan.

FIG. 27 shows a flowchart that depicts an exemplary embodiment of a trip optimization method, where an operator interface is available for the operator to adjust, modify, and/or trim an optimized mission plan or commands. In this flowchart 305, a mission is being autonomously performed according to an optimized mission plan, at 306. Autonomous performance may include performing the optimized mission using a closed-loop technique. The mission plan is manually adjusted. More specifically, an input device is provided which is configured to allow for manually trimming at least one characteristic of the mission within a predetermined range while the mission is in progress, at 307. The mission plan may be re-optimized after the optimized mission plan is trimmed, at 308. More specifically, re-optimization of the mission plan occurs at other times rather than only before implementation of the mission plan. The mission plan may be adjusted to correspond to the optimized mission plan after a specific time period and/or a specific criterion has been achieved when trimming at least one characteristic of the mission, at 308. For example, in cases where the operator desires to operate the locomotive at a given speed for a certain part of the mission, when the operator adjusts the mission plan, the operator may also implement a command or sequence for when the operator wants the optimized mission plan to be followed again, such as after leaving a tunnel. Prior to utilizing the optimized mission plan again, a re-plan of the optimized mission plan may be performed. The terms "adjusting" and "trimming" are both used here. Trimming is also meant to mean adjusting; however, trimming may be viewed as making a more minor adjustment.

Figure 28:
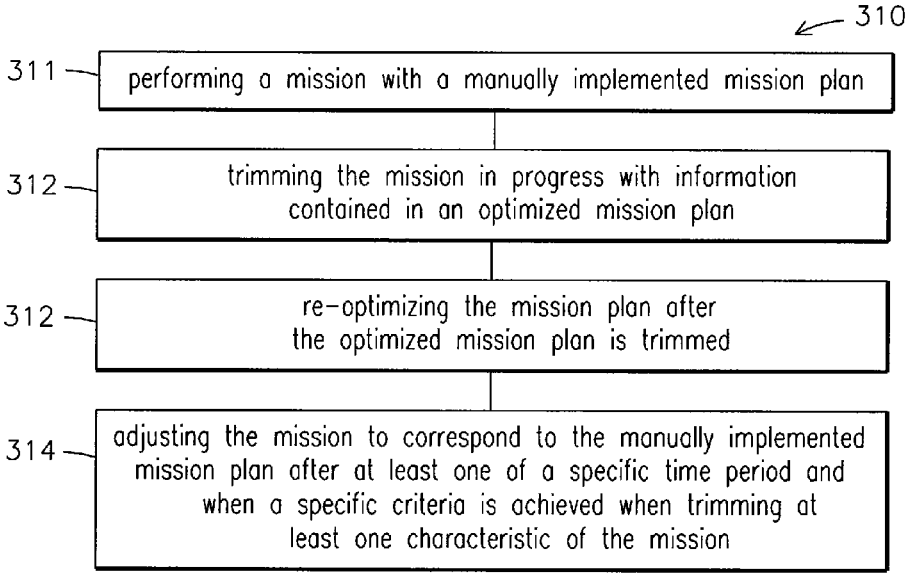
FIG. 28 is a flowchart illustrating an exemplary embodiment of a trip optimization method, where the optimizer may modify an operator's mission plan.

The converse of the above exemplary embodiment disclosed in FIG. 27 is also possible. More specifically, FIG. 28 shows a flowchart illustrating an exemplary embodiment of a trip optimization method where the optimizer may modify an operator's mission plan or commands. The flowchart 310 illustrates a mission that is performed according to a manually implemented mission plan, at 311. The manually implemented mission, while in progress, is trimmed, adjusted, and/or modified with information contained in an optimized mission plan, at 312. The mission plan is re-optimized after the manually implemented mission plan is trimmed, adjusted, and/or modified. As is further disclosed, the mission is adjusted to correspond to the manually implemented mission plan after a specific time period and/or when a specific criterion is achieved when trimming at least one characteristic of the mission.

In another example, the operator and the trip optimizer may work together to operate the diesel powered system. For example, the operator may control a characteristic, such as but not limited to pitch, and the optimizer is configured to control at least one other characteristic, such as but not limited to thrust. In another exemplary embodiment, where multiple thrusters and/or engines are available, the operator may control at least one thruster and/or engine and the trip optimizer may control at least one other thruster and/or engine.

Figure 26:
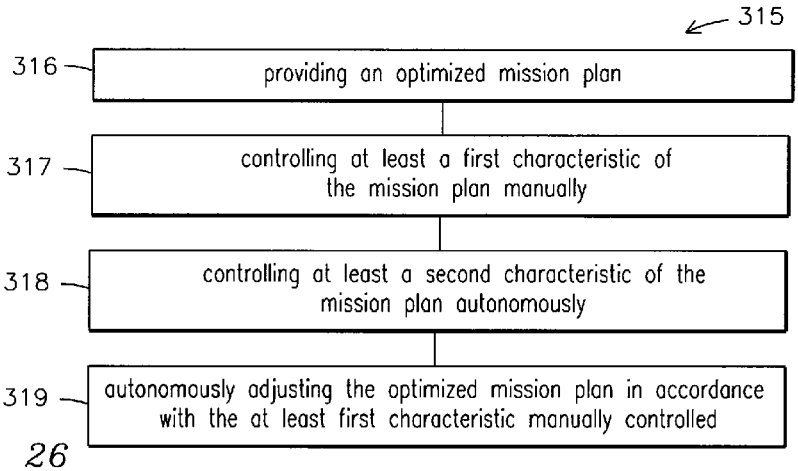
FIG. 26 is a flowchart illustrating an exemplary embodiment of a trip optimization method, where parts of mission are divided between at least the trip optimizer and another entity.

FIG. 26 depicts an exemplary embodiment of a flowchart illustrating where parts of mission are divided between at least the trip optimizer and another entity, such as but not limited to the operator. In this flowchart 315, an optimized mission plan is provided, at 316. At least one characteristic of the mission plan is controlled manually, at 317. At least another one characteristic of the mission plan is autonomously controlled, at 318. The optimized mission plan is autonomously adjusted, through a closed loop process in accordance with the at least one manually controlled characteristic, at 319.

Figure 29:
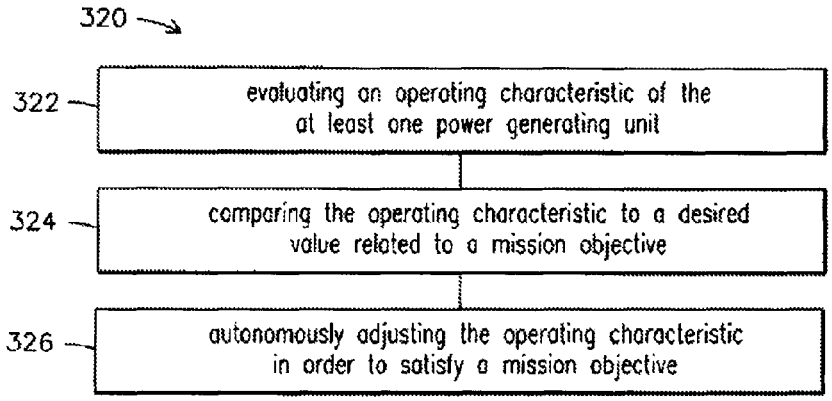
FIG. 29 is a flowchart showing an exemplary embodiment of a method for operating a powered system.

The embodiments disclosed herein may also be used where a powered system is part of a fleet and/or a network of powered systems. FIG. 29 shows a flowchart 320 depicting an exemplary embodiment of a method for operating a powered system having at least one power generating unit, where the powered system may be part of a fleet and/or a network of powered systems. Evaluating an operating characteristic of at least one power generating unit is disclosed, at 322. The operating characteristic is compared to a desired value related to a mission objective, at 324. The operating characteristic is autonomously adjusted in order to satisfy a mission objective, at 326. As disclosed herein, autonomous adjustment may be performed using a closed-loop technique.

Figure 30:
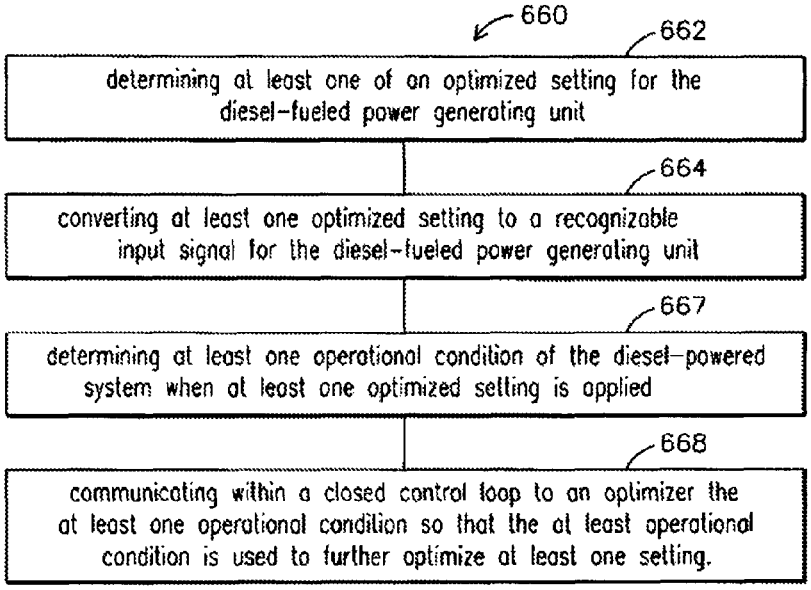
FIG. 30 is a flowchart showing an exemplary embodiment of a method for operating a rail vehicle in a closed-loop process.

FIG. 30 shows a flowchart 660 that depicts an exemplary embodiment of a method for operating a rail vehicle in a closed-loop process. The method includes determining an optimized setting for a locomotive consist, at 662. The optimized setting may include a setting for any setup variable such as, but not limited to, at least one of power level, optimized torque emissions, and/or other locomotive configurations. The optimized power level and/or the torque setting is converted to a recognizable input signal for the locomotive consist, at 664. At least one operational condition of the locomotive consist is determined when at least one of the optimized power level and the optimized torque setting is applied, at 667. The at least one operational condition is communicated to an optimizer within a closed control loop, for further use in optimizing at least one of power level and torque setting, at 668.

As disclosed above, the method shown in flowchart 660 may be performed using a computer software code having one or more computer software modules. Therefore, for rail vehicles that may not initially have the ability to utilize the method(s) disclosed herein, electronic media containing the computer software modules may be accessed by a computer on the rail vehicle so that the software modules may be loaded onto the rail vehicle for implementation. Electronic media is not meant to be limiting, since any of the computer software modules may also be loaded through an electronic media transfer system, including a wireless and/or wired transfer system, such as but not limited to using the Internet to accomplish the installation.

Locomotives produce emissions at rates based on notch levels. In reality, a lower notch level does not necessarily result in a lower emission per unit output, e.g., gm/hp-hr, and the reverse is true as well. Such emissions may include, but are not limited to, particulates, exhaust, and heat. Similarly, noise levels from a locomotive also may vary based on notch levels, in particular noise frequency levels. Therefore, when emissions are mentioned herein, those skilled in the art will readily recognize that exemplary embodiments of the invention are also applicable for reducing noise levels produced by a diesel powered system. Therefore, even though both emissions and noise are disclosed at various times herein, the term emissions should be read to also include noise.

When an operator calls for a specific horse power level, or notch level, the operator is expecting the locomotive to operate at a certain traction power or tractive effort. In an exemplary embodiment, to minimize emission output, the locomotive is able to switch between notch/power/engine speed levels while maintaining the average traction power desired by the operator. For example, suppose that the operator calls for notch setting 4 or 2000 HP. Then the locomotive may operate at notch 3 for a given period, such as a minute, and then move to notch 5 for a period and then back to notch 3 for a period such that the average power produced corresponds to notch 4. The locomotive moves to notch 5 because the emission output of the locomotive at this notch setting is already known to be less than when at notch 4. During the total time that the locomotive is moving between notch settings, the average is still notch 4, thus the tractive power desired by the operator is still realized.

The time for each notch is determined by various factors, such as but not limited to, the emissions at each notch, power levels at each notch, and the operator sensitivity. Those skilled in the art will readily recognize that embodiments of the invention are operatable when the locomotive is being operated manually, and/or when operation is automatically performed, such as but not limited to when controlled by an optimizer, and during low speed regulation.

In another exemplary embodiment, multiple set points are used. These set points may be determined by considering a plurality of factors such as, but not limited to, notch setting, engine speed, power, and engine control settings. In another exemplary embodiment, when multiple locomotives are used but may operate at different notch/power settings, the notch/power setting are determined as a function of performance and/or time. When emissions are being reduced, other factors that may be considered for a tradeoff include, but are not limited to, fuel efficiency and noise. Likewise, if the desire is to reduce noise, emissions and fuel efficiency may be considered. A similar analysis may be applied if fuel efficiency is what is to be improved.

Figure 31:
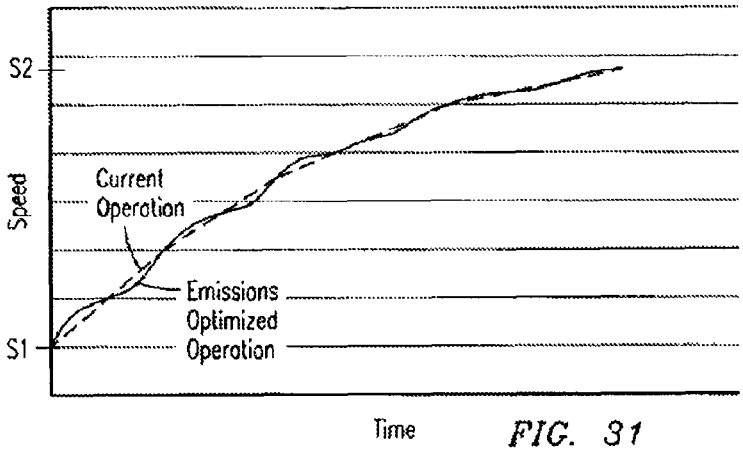
FIG. 31 depicts an embodiment of a speed versus time graph comparing current operations to emissions optimized operation.

FIG. 31 depicts an embodiment of a speed versus time graph comparing current operations to emissions optimized operation. The speed change compared to desirable speed can be arbitrarily minimized. For example, if the operator desires to move from one speed (S1) to another speed (S2) within a desired time, it can be achieved with minor deviations.

Figure 32:
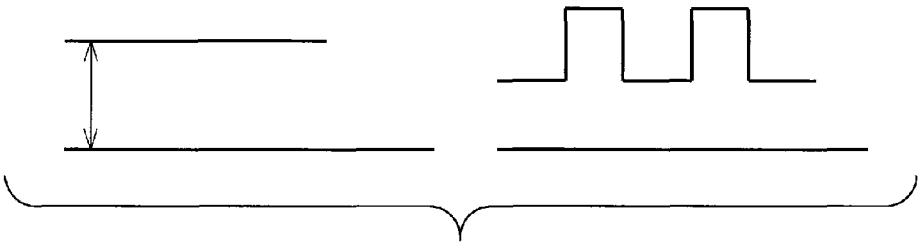
FIG. 32 depicts a modulation pattern compared to a given notch level.

FIG. 32 depicts a modulation pattern that results in maintaining a constant desired notch and/or horsepower. The amount of time at each notch depends on the number of locomotives and the weight of the train and its characteristics. Essentially, the inertia of the train is used to integrate the tractive power/effort to obtain a desired speed. For example, if the train is heavy, the time between transitions of notches 3 to 5 (and vice versa) in the example can be large. In another example, if the number of locomotives for a given train is great, the times between transitions need to be smaller. More specifically, the time modulation and/or cycling will depend on train and/or locomotive characteristics.

As discussed previously, emission output may be based on an assumed notch distribution, but the operator/rail road is not required to have that overall distribution. Therefore, it is possible to enforce the notch distribution over a period of time, over many locomotives over a period of time, and/or for a fleet locomotives over a period of time. By being provided with emission data, the trip optimizer described herein compares the desired notch/power setting with emission output based on notch/power settings and determines the notch/power cycle to meet the speed required while minimizing emission output. The optimization could be explicitly used to generate the plan, or the plan could be modified to enforce, reduce, and/or meet the emissions required.

Figure 33:
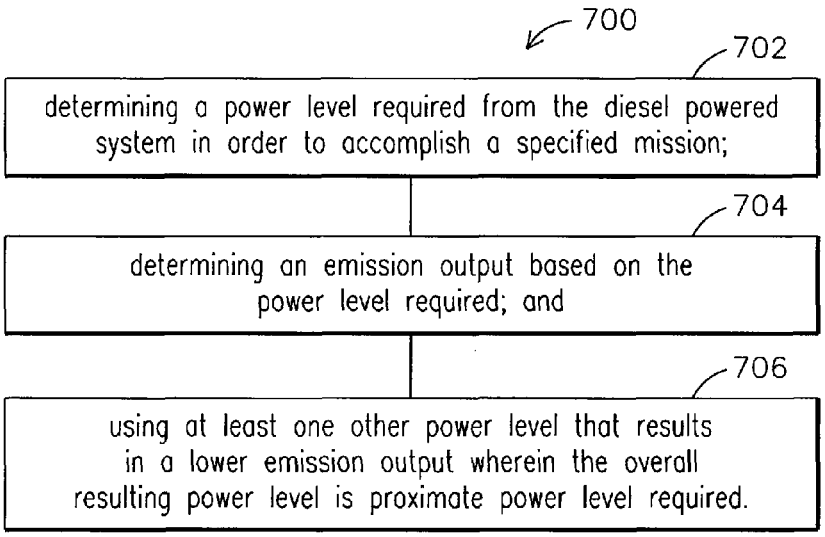
FIG. 33 is a flowchart showing an exemplary embodiment of a method for determining a configuration of a diesel powered system.

FIG. 33 depicts a flowchart 700 of an exemplary embodiment of a method for determining a configuration of a diesel powered system having at least one diesel-fueled power generating unit. The flowchart 700 provides for determining a minimum power, or power level, required from the diesel powered system in order to accomplish a specified mission, at 702. An emission output based on the minimum power, or power level, required is determined, at 704. Using at least one other power level that results in a lower emission output wherein the overall resulting power is proximate the power required, at 706, is also disclosed. Therefore, in operation, the desired power level with at least another power level may be used, and/or two power levels, not including the desired power level, may be used. In the second example, as disclosed above, if the desired power level is notch 4, the two power levels used may include notch 3 and notch 5.

As disclosed, emission output data based on notch speed is provided to the trip optimizer system. If a certain notch speed produces a high amount of emission, the trip optimizer can function by cycling between notch settings that produce lower amounts of emission output so that the locomotive will avoid operating at the particular notch while still meeting the speed of the avoided notch setting. For example, applying the same example provided above, if notch 4 is identified as a less than optimum operational setting because of emission output, but notch 3 and 5 produce lower emission outputs, the trip optimizer may cycle between notch 3 and 5 where that the average speed equates to speed realized at notch 4. Therefore, while providing speed associated with notch 4, the total emission output is less than the emission output expected at notch 4.

Therefore, when operating in this configuration, although speed constraints imposed based on defining notch limitations may not actually be adhered to, total emission output over a complete mission may be improved. More specifically, although a region may impose that rail vehicles are not to exceed notch 5, the trip optimizer may determine that cycling between notch 6 and 4 is preferable to reach the notch 5 speed limit but while also improving emission output, because emission outputs for the combination of notch 6 and 4 are better than when operating at notch 5 since either notch 4 or notch 6 or both are better than notch 5.

Figure 34:
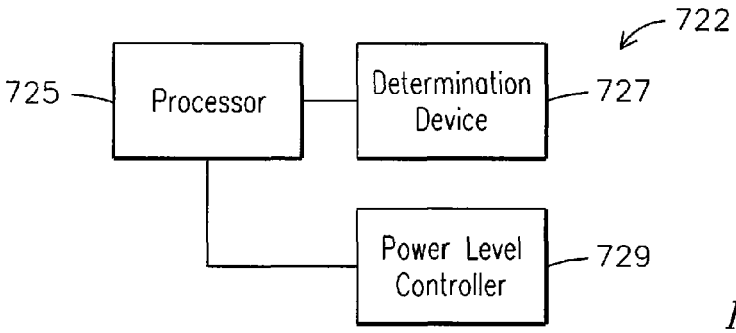
FIG. 34 depicts a system for minimizing emission output.

FIG. 34 illustrates a system 722 for minimizing emission output, noise level, etc. from a diesel powered system having at least one diesel-fueled power generating unit, while maintaining a specific speed. The system 722 includes a processor 725 for determining a minimum power required from the diesel-powered system, such as the train 31, in order to accomplish a specified mission. The processor 725 may also determine when to alternate between two power levels. A determination device 727 is used to determine an emission output based on the minimum power required. A power level controller 729 for alternating between power levels to achieve the minimum power required is also included. The power level controller 729 functions to produce a lower emission output while the overall average resulting power is proximate the minimum power required.

Figure 35:
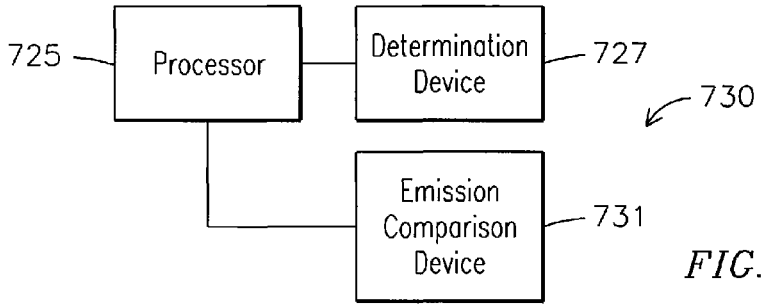
FIG. 35 depicts a system for minimizing emission output from a diesel powered system.

FIG. 35 illustrates a system 730 for minimizing one or more outputs (e.g., emission output and noise output) from a diesel powered system having at least one diesel-fueled power generating unit, while maintaining a specific speed. The system includes the determination device 727 for determining a power level required by the diesel-powered system in order to accomplish a specified mission. The determination device 727 may also determine an emission output based on the required power level. The system also includes an emission comparison device 731. The emission comparison device 731 compares emission outputs for other power levels with the emission output based on the power level required. The emission output of the diesel-fueled power generating unit, such as a train 31, is reduced based on the power level required by alternating between at least two other power levels which produce less emission output than the power level required, wherein alternating between the at least two other power levels produces an average power level proximate the power level required while producing a lower emission output than the emission output of the power level required. As disclosed herein, alternating power levels in this manner may simply result in using at least one other power level. Therefore, although characterized as an alternating operation, this term is not meant to be limiting. Towards this end, the system 730 may include a device (not shown) for alternating between the at least two power levels and/or using at least one other power level.

Although the above examples illustrate cycling between two notch levels to meet a third notch level, those skilled in the art will readily recognize that more than two notch levels may be used when seeking to meet a specific desired notch level. Therefore, three or more notch levels may be included in cycling to achieve a specific desired net level to improve emissions while still meeting speed requirements. Additionally, one of the notch levels that are alternated with may include the desired notch level. Therefore, at a minimum, the desired notch level and another notch level may be the two power levels that are alternated between.

Figure 36:
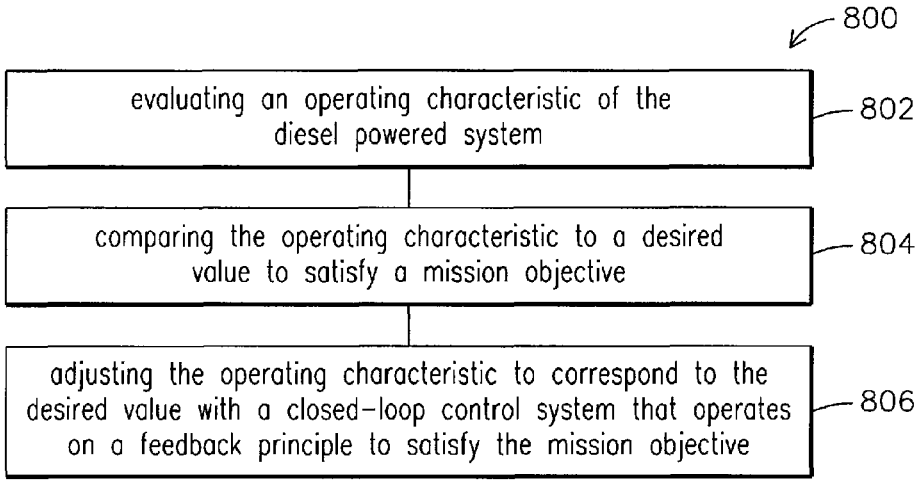
FIG. 36 depicts a method for operating a diesel powered system having at least one diesel-fueled power generating unit.

FIG. 36 discloses a flowchart 800 that illustrates an exemplary embodiment of a method for operating a diesel powered system having at least one diesel-fueled power generating unit, to meet at least one mission objective. The mission objective may include consideration of at least one of total emissions, maximum emission, fuel consumption, speed, reliability, wear, forces, power, mission time, time of arrival, time of intermediate points, and/or braking distance. The mission objective may further include other objectives based on the specific mission of the diesel powered system. For example, as disclosed above, a mission objective of a locomotive is different than that that of a stationary power generating system. Therefore the mission objective is based on the type of diesel powered system the method of flowchart 800 is utilized with.

The flowchart 800 discloses evaluating an operating characteristic of the diesel powered system, at 802. The operating characteristic may include at least one of emissions, speed, horse power, friction modifier, tractive effort, overall power output, mission time, fuel consumption, energy storage, and/or condition of a surface upon which the diesel powered system operates. Energy storage is important when the diesel powered system is a hybrid system having for example a diesel fueled power generating unit as its primary power generating system, and an electrical, hydraulic, or other power generating system as its secondary power generating system. With respect to speed, this operating characteristic may be further subdivided with respect to time varying speed and position varying speed.

The operational characteristic may further be based on a position of the diesel powered system when used in conjunction with at least one other diesel powered system. For example, in a train, when viewing each locomotive as a diesel powered system, a locomotive consist may be utilized with a train. Therefore, there will be a lead locomotive and a remote locomotive. For those locomotives that are in a trail position, trail mode considerations are also involved. The operational characteristic may further be based on an ambient condition, such as but not limited to temperature and/or pressure.

Also disclosed in the flowchart 800 is comparing the operating characteristic to a desired value to satisfy the mission objective, at 804. The desired value may be determined from at least one of the operational characteristic, capability of the diesel powered system, and/or at least one design characteristic of the diesel powered system. With respect to the design characteristics of the diesel powered system, there are various modules of locomotives where the design characteristics vary. The desired value may be determined at a remote location, such as but not limited to a remote monitoring station, and/or at a location that is a part of the diesel powered system.

The desired value may be based on a location and/or operating time of the diesel powered system. As with the operating characteristic the desired value is further based on at least one of emissions, speed, horse power, friction modifier, tractive effort, ambient conditions including at least one of temperature and pressure, mission time, fuel consumption, energy storage, and/or condition of a surface upon which the diesel powered system operates. The desired value may be further determined based on a number of diesel-fueled power generating units that are either a part of the diesel powered system and/or a part of a consist, or at the sub-consist level as disclosed above.

The method of FIG. 36 further comprises adjusting the operating characteristic to correspond to the desired value with a closed-loop control system that operates in a feedback process to satisfy the mission objective, at 806. The feedback process may include feedback principles readily known to those skilled in the art. In general, but not to be considered limiting, the feedback process receives information and makes determinations based on the information received. The closed-loop approach allows for the implementation of the method of flowchart 800 without outside interference. However, if required due to safety issues, a manual override is also provided. The operating characteristic may be adjusted based on an ambient condition. As disclosed above, the method of flowchart 800 may also be implemented in a computer software code where the computer software code may reside on a computer readable media.

Figure 37:
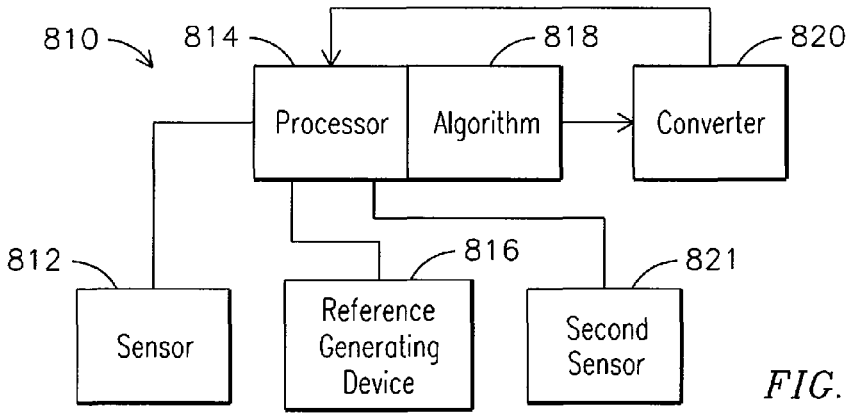
FIG. 37 depicts a block diagram of an exemplary system for operating a diesel powered system having at least one diesel-fueled power generating unit.

FIG. 37 discloses a block diagram of an exemplary system 810 for operating a diesel powered system having at least one diesel-fueled power generating unit. The system 810 includes a sensor 812 that is configured for determining at least one operating characteristic of the diesel powered system. In an exemplary embodiment, a plurality of sensors 812 are provided to gather operating characteristics from a plurality of locations on the diesel powered system and/or a plurality of subsystems within the diesel powered system. Those skilled in the art will also recognize that the sensor 812 may be an operation input device. Therefore, the sensor 812 can gather operating characteristics, or information, about emissions, speed, horse power, friction modifier, tractive effort, ambient conditions including at least one of temperature and pressure, mission time, fuel consumption, energy storage, and/or the condition of a surface upon which the diesel powered system operates. A processor 814 is in communication with the sensor 812. A reference generating device 816 is provided and is configured to identify the preferred operating characteristic. The reference generating device 816 is in communication with the processor 814. When the term "in communication" is used, those skilled in the art will readily recognize that the form of communication may be facilitated through a wired communication system/device and/or through a wireless communication system/device. The reference generating device 816 may be remote from the diesel powered system, a part of the diesel powered system, or both (i.e., part of the device 816 may be remote, another part local).

The processor 814 is outfitted with an algorithm 818 that operates in a feedback process for comparing the operating characteristic to the preferred operating characteristic, to determine a desired operating characteristic. A converter 820, in closed loop communication with the processor 814 and/or algorithm 818, is further provided to implement the desired operating characteristic. The converter 820 may be a master controller, a remote control controller, a distributed power controller, and/or a train line modem. More specifically, when the diesel powered system is a locomotive system, the converter may be a remote control locomotive controller, a distributed power locomotive controller, and a train line modem.

As further illustrated, the system 810 may include a second sensor 821. The second sensor is configured to measure at least one ambient condition, information about which is provided to the algorithm 818 and/or processor 814 to determine a desired operating characteristic. As disclosed above, examples of an ambient condition include, but are not limited to, temperature and pressure.

Another embodiment relates to a method for controlling operations of a train. The method is also applicable to controlling other vehicles or other powered systems. As disclosed above, the method may be performed with a unique processor configured to satisfy the method and further configured to withstand the environmental conditions that it may experience on the powered vehicle. According to the method, the train is controlled based on an optimized mission plan, typically for reducing fuel use and/or reducing emissions output. For calculating the mission plan, the following steps may be carried out. First, route data and train data is received, e.g., from a database or otherwise. The route data includes data relating to one or more characteristics of a track on which the train is to travel along a route and data relating to at least one speed limit along the route. The train data relates to one or more characteristics of the train. The mission plan is created on-board the train at any time during travel of the train along the route. The mission plan is created at a first point along the route based on the received data, and covers at least a segment of the route extending to a second point further along the route than the first point. The mission plan is created for covering the entirety of the segment based on, and regardless of, all the different geographic features or other characteristics of the route along the segment for which data is available. By this, it is meant: (i) the mission plan takes into consideration all the different geographic features or other characteristics of the route segment for which data is available, and (ii) the mission plan is created regardless of what particular geographic features or other characteristics of the route are along the segment. Thus, no matter what known geographic features or other route characteristics are along a route segment, a mission plan is created for that segment.

Figure 38:
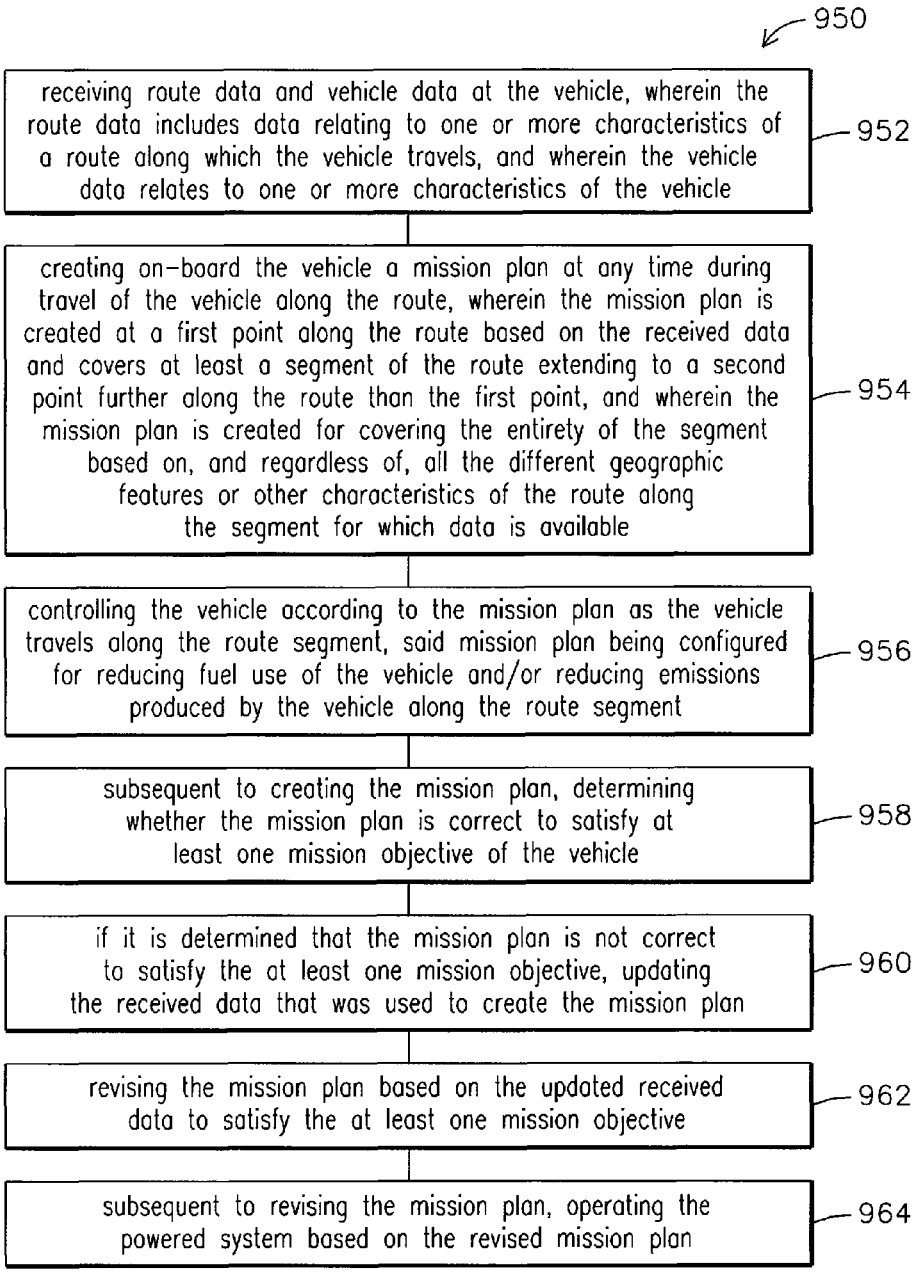
FIG. 38 depicts a flowchart showing an exemplary embodiment of a method for operating a vehicle.

Another embodiment relates to a method for operating a vehicle, as illustrated in the flowchart 950 shown in FIG. 38. As disclosed above, the method may be performed with a processor uniquely configured to satisfy the method and further configured to withstand the environmental conditions that it may experience on the powered vehicle. The method comprises receiving route data and vehicle data at the vehicle, at 952. The route data includes data relating to one or more characteristics of a route along which the vehicle travels, and the vehicle data relates to one or more characteristics of the vehicle. The method further comprises creating on-board the vehicle a mission plan at any time during travel of the vehicle along the route, at 954. The mission plan is created at a first point along the route based on the received data and covers at least a segment of the route extending to a second point further along the route than the first point. The mission plan is created for covering the entirety of the segment based on, and regardless of, all the different geographic features or other characteristics of the route along the segment for which data is available. The method further comprises controlling the vehicle according to the mission plan as the vehicle travels along the route segment, at 956. The mission plan is configured for reducing fuel use of the vehicle and/or reducing emissions produced by the vehicle along the route segment.

Subsequent to creating the mission plan, it is determined whether the mission plan is correct to satisfy at least one mission objective of the vehicle, at 958. If it is determined that the mission plan is not correct to satisfy the at least one mission objective, the method further comprises updating the received data that was used to create the mission plan, at 960. The mission plan is then revised based on the updated received data, to satisfy the at least one mission objective, at 962. Subsequent to revising the mission plan, the method further comprises operating the powered system based on the revised mission plan, at 964.

As should be appreciated, any description herein relating to a "trip plan" is also applicable to a "mission plan," since a trip plan is one species of a mission plan, i.e., a trip plan is a mission plan for a vehicle. The same is true for "trip" and "mission" generally, i.e., a trip is a particular species of mission.

While the invention has been described with reference to various exemplary embodiments, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A method comprising:

obtaining a current mission plan that includes designated operational settings of a powered system for travel of the powered system along a route for a mission;

determining when one or more exception events to the current mission plan occur while the powered system travels along the route according to the current mission plan, the one or more exception events being triggered by a larger than expected change between a first amount of fuel and a second amount of fuel, the first amount of fuel is an amount that is calculated as being consumed by the powered system based on planned travel according to the current mission plan and the second amount of fuel is an amount that actually is consumed by the powered system during travel along the route;

responsive to the one or more exception events occurring, autonomously revising the current mission plan to a revised mission plan based on the one or more exception events, the revised mission plan including revised designated operational settings of the powered system for travel of the powered system along the route for the mission; and operating the powered system according to the revised mission plan.

2. The method according to claim 1, wherein the one or more exception events include a difference between a first speed of the powered system that is calculated based on the mission plan and an actual speed of the powered system.

3. The method according to claim 1, wherein the one or more exception events include a change in priority of the powered system relative to one or more other powered systems.

4. The method according to claim 1, wherein the one or more exception events include an operator manually taking over control of the powered system from autonomous control of the powered system according to the current mission plan.

5. The method according to claim 1, wherein the one or more exception events include at least one of a braking output or tractive output of the powered system being degraded.

6. The method according to claim 1, wherein determining when the one or more exception events occur is performed onboard the powered system at least one of prior to beginning the mission of the powered system or during the mission.

7. The method according to claim 1, further comprising, when the one or more exception events occur, receiving updated mission information from at least one of a remote facility, a second, remote powered system, or a wayside device that differs from previous information upon which the current mission plan is generated, wherein the current mission plan is autonomously revised to the revised mission plan using the updated mission information.

8. The method according to claim 1, wherein determining when the one or more exception events occur comprises scheduling at least one recurrent period to repeatedly determine if the one or more exception events occur during travel of the powered system for the mission.

9. The method according to claim 1, wherein the one or more exception events comprise a difference between a first calculated arrival time of the powered system at a location that is based on travel of the powered system according to the current mission plan and a second calculated arrival time of the powered system at the location that is based on actual travel of the powered system.

10. The method according to claim 1, wherein the powered system comprises a rail vehicle, an off-highway vehicle, an agricultural vehicle, a transportation vehicle, or a marine vessel.

11. A method comprising:

controlling a powered system according to a current mission plan that designates operations of the powered system as the powered system travels along a route to perform a mission;

evaluating actual operations of the powered system against the operations designated by the current mission plan as the powered system travels along the route in order to identify one or more exception events, the one or more exception events being triggered by a larger than expected change between a first amount of fuel and a second amount of fuel, the first amount of fuel is an amount that is calculated as being consumed by the powered system based on planned travel according to the current mission plan and the second amount of fuel is an amount that actually is consumed by the powered system during travel along the route;

responsive to the one or more exception events being identified, autonomously updating the current mission plan to an updated current mission plan based on the one or more exception events, the updated current mission plan designating updated operations of the powered system as the powered system travels along the route to perform the mission; and operating the powered system according to the updated current mission plan.

12. The method according to claim 11, wherein the one or more exception events comprise a difference between a first calculated arrival time of the powered system at a location that is based on travel of the powered system according to the current mission plan and a second calculated arrival time of the powered system at the location that is based on actual travel of the powered system.

13. The method according to claim 11, wherein the one or more exception events include a difference between a first speed of the powered system that is calculated based on the current mission plan and an actual speed of the powered system.

14. The method according to claim 11, wherein the one or more exception events include a change in priority of the powered system relative to one or more other powered systems.

15. The method according to claim 11, wherein the one or more exception events include an operator manually taking over control of the powered system from autonomous control of the powered system according to the current mission plan.

16. The method according to claim 11, wherein the one or more exception events include at least one of a braking output or tractive output of the powered system being degraded.

17. The method according to claim 11, wherein evaluating the actual operations is executed at least one of prior to beginning the mission that is the powered system is to perform or during performance of the mission by the powered system.

18. The method according to claim 11, further comprising, when the one or more exception events are identified, receiving updated mission information from at least one of a remote facility, a remote powered system, or a wayside device, wherein the current mission plan is autonomously updated using the updated mission information.

19. The method according to claim 11, wherein evaluating the actual operations comprises scheduling evaluation of the actual operations according to a recurring time period.

20. The method according to claim 11, wherein the powered system comprises a rail vehicle, an off-highway vehicle, an agricultural vehicle, a transportation vehicle, or a marine vessel.

21. A computer readable medium including one or more computer modules configured to direct a processor to:

control a powered system according to a current mission plan that designates operations of the powered system as the powered system travels along a route to perform a mission;

evaluate actual operations of the powered system against the operations designated by the current mission plan as the powered system travels along the route in order to identify one or more exception events, the one or more exception events being triggered by a larger than expected change between a first amount of fuel and a second amount of fuel, the first amount of fuel is an amount that is calculated as being consumed by the powered system based on planned travel according to the current mission plan and the second amount of fuel is an amount that actually is consumed by the powered system during travel along the route;

responsive to the one or more exception events being identified, autonomously update the current mission plan to an updated current mission plan based on the one or more exception events, the updated current mission plan designating updated operations of the powered system as the powered system travels along the route to perform the mission; and operate the powered system according to the updated current mission plan.

22. The computer readable medium according to claim 21, wherein the one or more exception events comprise a difference between a first calculated arrival time of the powered system at a location that is based on travel of the powered system according to the current mission plan and a second calculated arrival time of the powered system at the location that is based on actual travel of the powered system.

23. The computer readable medium according to claim 21, wherein the one or more exception events include a difference between a first speed of the powered system that is calculated based on the current mission plan and an actual speed of the powered system.

24. The computer readable medium according to claim 21, wherein the one or more exception events include a change in priority of the powered system relative to one or more other powered systems.

25. The computer readable medium according to claim 21, wherein the one or more exception events include an operator manually taking over control of the powered system from autonomous control of the powered system according to the current mission plan.

26. The computer readable medium according to claim 21, wherein the one or more exception events include at least one of a braking output or tractive output of the powered system being degraded.

27. The computer readable medium according to claim 21, wherein the one or more computer software modules are configured to direct the processor to change the current mission plan to the updated current mission plan at least one of prior to a mission of the powered system or during the mission.

28. The computer readable medium according to claim 21, wherein, when the one or more exception events are identified, the one or more computer software modules direct the processor to receive updated mission information from at least one of a remote facility, a second, remote powered system, or a wayside device, wherein the current mission plan is autonomously updated using the updated mission information.

29. A system comprising:

a communication system configured to obtain a current mission plan that includes designated operational settings of a powered system for travel of the powered system along a route for a mission; and a processor configured to be disposed onboard the powered system to determine when one or more exception events to the current mission plan occur while the powered system travels along the route according to the current mission plan, the one or more exception events being triggered by a larger than expected change between a first amount of fuel and a second amount of fuel, the first amount of fuel is an amount that is calculated as being consumed by the powered system based on planned travel according to the current mission plan and the second amount of fuel is an amount that actually is consumed by the powered system during travel along the route;

wherein the processor is further configured, responsive to the one or more exception events occurring, to autonomously revise the current mission plan to a revised mission plan based on the one or more exception events and to operate the powered system according to the revised mission plan, the revised mission plan including revised designated operational settings of the powered system for travel of the powered system along the route for the mission.

30. The system according to claim 29, wherein the one or more exception events comprise a difference between a first calculated arrival time of the powered system at a location that is based on travel of the powered system according to the current mission plan and a second calculated arrival time of the powered system at the location that is based on actual travel of the powered system.

31. The system according to claim 29, wherein the one or more exception events include a difference between a first speed of the powered system that is calculated based on the current mission plan and an actual speed of the powered system.

32. The system according to claim 29, wherein the one or more exception events include a change in priority of the powered system relative to one or more other powered systems.

33. The system according to claim 29, wherein the one or more exception events include an operator manually taking over control of the powered system from autonomous control of the powered system according to the current mission plan.

34. The system according to claim 29, wherein the one or more exception events include at least one of a braking output or tractive output of the powered system being degraded.

35. The system according to claim 29, wherein the powered system comprises a rail vehicle, an off-highway vehicle, an agricultural vehicle, a transportation vehicle, or a marine propulsion vessel.

36. The system according to claim 29, wherein, when the one or more exception events occur, the communication system is configured to receive updated mission information from at least one of a remote facility, a remote powered system, or a wayside device, wherein the processor is configured to autonomously revise the current mission plan to the revised mission plan using the updated mission information received by the communication system.

37. The system according to claim 29, wherein the processor is configured to autonomously update the current mission plan in a closed-loop process.

38. The system according to claim 29, further comprising an indicator configured to notify an operator when the current mission plan is updated.

39. The system according to claim 29, further comprising a memory device configured to store the one or more exception events.

40. the method according to claim 1, wherein operating the powered system according to the revised mission plan includes at least partially autonomously controlling movement the powered system according to the revised mission plan.

41. The method according to claim 1, wherein the designated operational settings and the revised designated operational settings comprise at least one of throttle or braking settings that the powered system is to use during travel along the route as a function of at least one of distance or time.

42. the method according to claim 11, wherein operating the powered system according to the updated current mission plan includes at least partially autonomously controlling movement of the powered system according to the updated current mission plan.

43. The method according to claim 11, wherein the designated operations and the designated updated operations comprise at least one of throttle or braking setings for the powered system to use during travel along the route as a function of at least one of distance or time.

44. The computer readable medium according to claim 21, wherein the processor is directed to operate the powered system according to the updated current mission plan by at least partially autonomously controlling movement of the powered system according to the updated current mission plan.

45. The computer readable medium according to claim 21, wherein the designated operations and the designated updated operations comprise at least one of throttle or braking settings for the powered system to use during travel along the route as a function of at least one of distance or time.

46. The system according to claim 29, wherein the processor operates the powered system according to the revised mission plan by at least partially autonomously controlling movement of the powered system according to the revised mission plan.

47. The system according to claim 29, wherein the designated operational settings and the revised designated operational settings comprise at least one of throttle or braking settings the powered system is to use during travel along the route as a function of at least one of distance or time.

* * * * *